US011804153B2

(12) United States Patent
Mizutani et al.

(10) Patent No.: US 11,804,153 B2
(45) Date of Patent: Oct. 31, 2023

(54) MEDIUM INCLUDING RELEASE MATERIAL AND PRINTING LABEL AND METHOD OF WRAPPING PEELED-OFF LABEL

(71) Applicant: BROTHER KOGYO KABUSHIKI KAISHA, Nagoya (JP)

(72) Inventors: Shiori Mizutani, Chiryu (JP); Yuki Hokari, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 99 days.

(21) Appl. No.: 17/483,740

(22) Filed: Sep. 23, 2021

(65) Prior Publication Data

US 2022/0013042 A1 Jan. 13, 2022

Related U.S. Application Data

(63) Continuation of application No. PCT/JP2020/011098, filed on Mar. 13, 2020.

(30) Foreign Application Priority Data

Mar. 26, 2019 (JP) ..... 2019-058169

(51) Int. Cl.
*B42D 15/00* (2006.01)
*G09F 3/20* (2006.01)
(Continued)

(52) U.S. Cl.
CPC ..... *G09F 3/0288* (2013.01); *B41J 3/4075* (2013.01); *B41M 5/502* (2013.01); *G09F 3/10* (2013.01);
(Continued)

(58) Field of Classification Search
CPC .. G09F 3/10; G09F 3/0295; G09F 2003/0229; G09F 3/02; B32B 7/12; B32B 2405/00; B32B 2519/00
See application file for complete search history.

(56) References Cited

U.S. PATENT DOCUMENTS 5,658,648 A 8/1997 Doerr et al.
5,707,082 A * 1/1998 Murphy ..... B41J 3/4075 283/67
(Continued)

FOREIGN PATENT DOCUMENTS

CN 101146716 3/2008
CN 201413599 2/2010
(Continued)

OTHER PUBLICATIONS

International Search Report and Written Opinion of the International Search Report for PCT/JP2020/011098 dated Jun. 9, 2020.
(Continued)

*Primary Examiner* — Shin H Kim
(74) *Attorney, Agent, or Firm* — Kenealy Vaidya LLP

(57) ABSTRACT

A medium is configured to be mounted in and printed with a printer. The medium includes: a release material; and a printing label. The release material is provided with a cut-out area. The cut-out area is surrounded by a hole or a cut or a series of holes or a series of cuts and has at least a first side and a second side. The first side and the second side oppose each other. The printing label is affixed to the release material so as to extend across the first side and the second side of the cut-out area. The first side and the second side are configured to include different types of the holes or the cuts or the series of holes or the series of cuts from each other.

12 Claims, 36 Drawing Sheets

(51) Int. Cl.

| | |
|---|---|
| ***G09F 3/04*** | (2006.01) |
| ***G09F 3/10*** | (2006.01) |
| ***G09F 3/02*** | (2006.01) |
| ***B41J 3/407*** | (2006.01) |
| ***B41M 5/50*** | (2006.01) |

(52) U.S. Cl.

CPC ..... *G09F 2003/0201* (2013.01); *G09F 2003/0202* (2013.01); *G09F 2003/023* (2013.01); *G09F 2003/0229* (2013.01); *G09F 2003/0257* (2013.01); *G09F 2003/0269* (2013.01)

(56) References Cited

U.S. PATENT DOCUMENTS

| | | | | |
|---|---|---|---|---|
| 6,224,110 | B1 | 5/2001 | Ambridge et al. | |
| 6,303,201 | B1 * | 10/2001 | Baierl | G09F 3/04 40/6 |
| 7,520,079 | B2 * | 4/2009 | Stallings | G09F 3/005 40/633 |
| 8,167,336 | B2 * | 5/2012 | Minor | G09F 3/0288 40/6 |
| 8,263,201 | B2 * | 9/2012 | Caveney | G09F 3/205 428/40.1 |
| 8,881,438 | B2 * | 11/2014 | Shimizu | G09F 3/04 40/6 |
| 10,475,357 | B2 * | 11/2019 | Kimes | G09F 3/0288 |
| 2009/0028622 | A1 | 1/2009 | Kobayashi et al. | |
| 2011/0268897 | A1 * | 11/2011 | Klemann | B41M 5/52 428/32.19 |
| 2012/0198738 | A1 * | 8/2012 | Olivarez | G09F 3/0295 156/185 |
| 2013/0221081 | A1 * | 8/2013 | Conaghan | G09F 3/0288 40/6 |
| 2013/0305576 | A1 | 11/2013 | Takashima et al. | |
| 2014/0173951 | A1 | 6/2014 | Shimuzi et al. | |
| 2018/0015748 | A1 | 1/2018 | Kato et al. | |
| 2018/0015749 | A1 | 1/2018 | Inoue et al. | |
| 2018/0282583 | A1 | 10/2018 | Inoue et al. | |

FOREIGN PATENT DOCUMENTS

| | | | |
|---|---|---|---|
| CN | 106364175 | | 2/2017 |
| CN | 107709023 | A | 2/2018 |
| CN | 107851404 | | 3/2018 |
| JP | H11-024569 | A | 1/1999 |
| JP | 2004-045812 | | 2/2004 |
| JP | 2008-197214 | A | 8/2008 |
| JP | 2011-524154 | A | 8/2011 |
| JP | 2012-108444 | A | 6/2012 |
| JP | 2018-172606 | A | 11/2018 |
| JP | 2018-172608 | A | 11/2018 |
| WO | 2009/137756 | A1 | 11/2009 |
| WO | 2020/195951 | A1 | 10/2020 |

OTHER PUBLICATIONS

The extended European Search Report for the related European Patent Application No. 20778332.5 dated Oct. 24, 2022.

Chinese Office Action for the related Chinese Patent Application No. 202080024393.3 dated Oct. 11, 2022.

International Preliminary Report on Patentability and English language Written Opinion of the International Search Report for PCT/JP2020/011098 dated Sep. 28, 2021.

Chinese Office Action for the related Chinese Patent Application No. 202080024393.3 dated Apr. 17, 2023.

Japanese Office Action for the related Japanese Patent Application No. 2019-058169 dated Mar. 24, 2023.

* cited by examiner

USE AS ROTATING LABEL

USE AS ROTATING LABEL

USE AS ROTATING LABEL

USE AS ROTATING LABEL

USE AS ROTATING LABEL

USE AS ROTATING LABEL

USE AS ROTATING LABEL

USE AS ROTATING LABEL

USE AS FIXED LABEL

USE AS FIXED LABEL

USE AS FIXED LABEL

USE AS FIXED LABEL

USE AS FIXED LABEL

USE AS FIXED LABEL

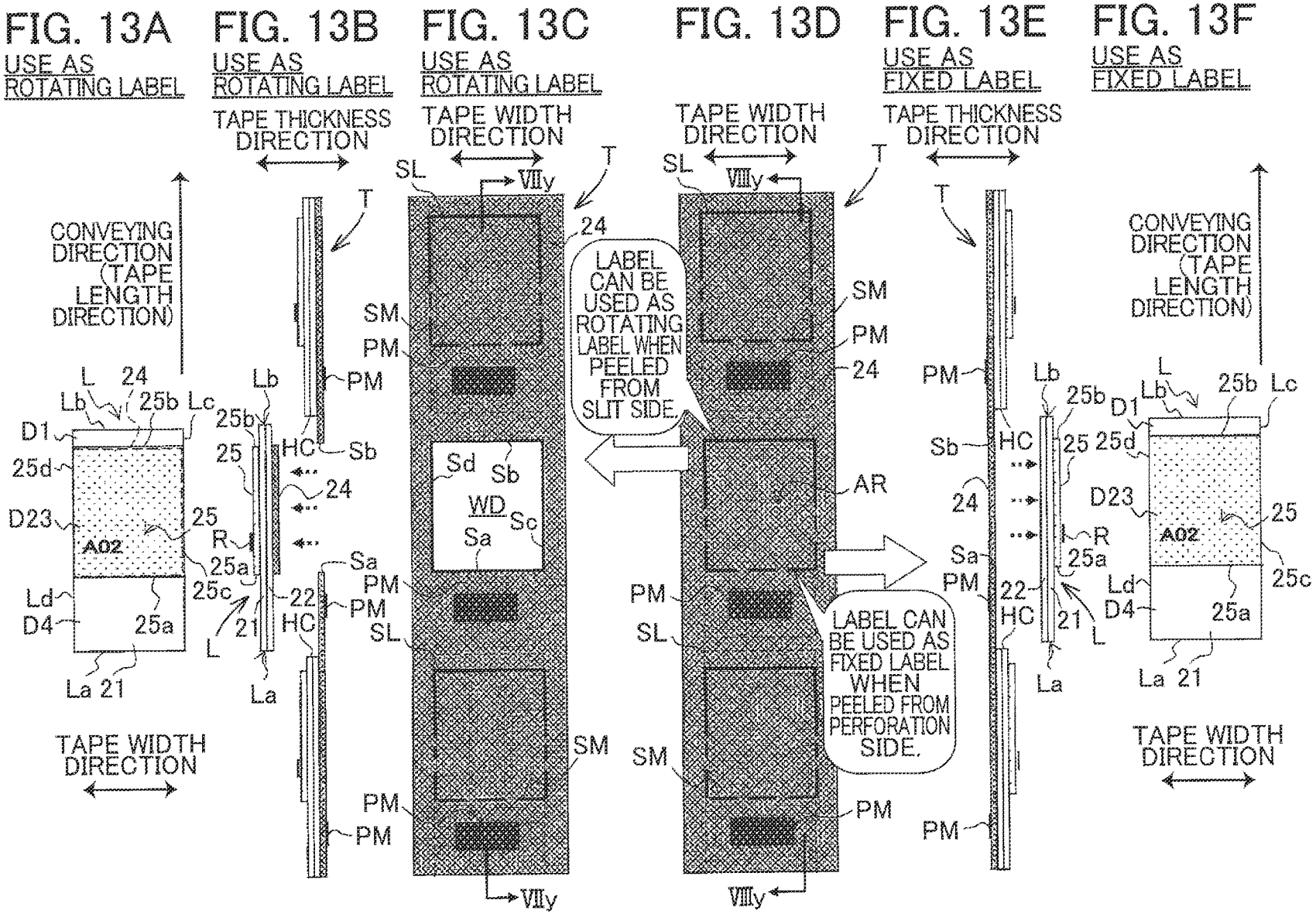
FIG. 13A
USE AS ROTATING LABEL
CONVEYING DIRECTION (TAPE LENGTH DIRECTION)
TAPE WIDTH DIRECTION
FIG. 13B
USE AS ROTATING LABEL
TAPE THICKNESS DIRECTION
FIG. 13C
USE AS ROTATING LABEL
TAPE WIDTH DIRECTION
LABEL CAN BE USED AS ROTATING LABEL WHEN PEELED FROM SLIT SIDE.
FIG. 13D
TAPE WIDTH DIRECTION
LABEL CAN BE USED AS FIXED LABEL WHEN PEELED FROM PERFORATION SIDE.
FIG. 13E
USE AS FIXED LABEL
TAPE THICKNESS DIRECTION
FIG. 13F
USE AS FIXED LABEL
CONVEYING DIRECTION (TAPE LENGTH DIRECTION)
TAPE WIDTH DIRECTION

USE AS ROTATING LABEL

USE AS FIXED LABEL

USE AS ROTATING LABEL

USE AS ROTATING LABEL

USE AS ROTATING LABEL

USE AS FIXED LABEL

USE AS FIXED LABEL

USE AS FIXED LABEL

USE AS FIXED LABEL

USE AS FIXED LABEL

CONVEYING DIRECTION (TAPE LENGTH DIRECTION)
TAPE THICKNESS DIRECTION
TAPE WIDTH DIRECTION
LABEL IS PEELED OFF RELEASE MATERIAL TOGETHER WITH CUT-OUT AREA.
LABEL CAN BE USED AS IS AS ROTATING LABEL WITHOUT PEELING OFF CUT-OUT AREA.
LABEL CAN BE USED AS FIXED LABEL BY PEELING OFF CUT-OUT AREA.
((BACK SURFACE))

MEDIUM INCLUDING RELEASE MATERIAL AND PRINTING LABEL AND METHOD OF WRAPPING PEELED-OFF LABEL

CROSS REFERENCE TO RELATED APPLICATIONS

This application is a by-pass continuation application of International Application No. PCT/JP2020/011098 filed Mar. 13, 2020 claiming priority from Japanese Patent Application No. 2019-058169 filed Mar. 26, 2019. The entire contents of the international application and the priority application are incorporated herein by reference.

TECHNICAL FIELD

The present disclosure relates to a medium and a method of wrapping a peeled-off label.

BACKGROUND

A medium known in the art is fitted around a cable or other cylindrical adherend for use as a label. The medium in this conventional technology has a layered structure that includes a base material layer, an adhesive layer, and a release material layer. The conventional medium is configured with a first adhesive area, a non-adhesive area arranged adjacent to the first adhesive area and including a print background layer, and a second adhesive area arranged adjacent to the non-adhesive area. A back surface side of the first adhesive area has an adhesive property after the release material layer is peeled off. The back surface side of the non-adhesive area has a non-adhesive property. A portion of the back surface side of the second adhesive area has an adhesive property.

SUMMARY

With the medium according to the conventional technology described above, first the back surface (inner surface) in the first adhesive area is fixed by adhesive to an outer circumferential part of the adherend. Next, the non-adhesive area adjacent to the first adhesive area is wrapped around the adherend to form a cylinder. Subsequently, the back surface (inner surface) in the second adhesive area is fixed by adhesive to the outer side of the non-adhesive area. Thereafter, the user separates the remaining combination of the non-adhesive area and second adhesive area from the first adhesive area adhered to the adherend by breaking a perforation previously provided between the first adhesive area and the non-adhesive area, thereby completing a rotating label (cylindrical medium) that can rotate relative to the adherend. On the other hand, there may be situations in which the medium of the conventional technology described above is to be used as a fixed label by fixing the medium to the adherend without breaking the perforation. However, even though the perforation is left intact to use the conventional medium as a fixed label, the perforation could break during use, turning the medium into a rotating label that rotates relative to the adherend.

It is an object of the present disclosure to provide a label that can be used stably as both a rotating label and a fixed label.

In order to provide the above and other objects, the present disclosure provides a medium configured to be mounted in and printed with a printer. The medium includes: a release material; and a printing label. The release material is provided with a cut-out area. The cut-out area is surrounded by a hole or a cut or a series of holes or a series of cuts and has at least a first side and a second side. The first side and the second side oppose each other. The printing label is affixed to the release material so as to extend across the first side and the second side of the cut-out area. The first side and the second side are configured to include different types of the holes or the cuts or the series of holes or the series of cuts from each other.

According to another aspect, the present disclosure also provides a medium configured to be mounted in and printed with a printer. The medium includes: a release material; and a printing label. The release material is provided with a cut-out area. The cut-out area is surrounded by a hole or a cut or a series of holes or a series of cuts and has at least a first side and a second side. The first side and the second side oppose each other. The printing label is affixed to the release material so as to extend across the first side and the second side of the cut-out area. A fixing force by which the cut-out area is fixed to an area of the release material outside the cut-out area is smaller than an adhesive force between the printing label and the cut-out area when a first force is applied to peel off the printing label from the first side toward the second side. The fixing force is greater than the adhesive force between the printing label and the cut-out area when a second force is applied to peel off the printing label from the second side toward the first side.

According to still another aspect, the present disclosure also provides a medium configured to be mounted in and printed with a printer. The medium includes: a release material; and a printing label. The release material is provided with a cut-out area. The cut-out area is surrounded by a hole or a cut or a series of holes or a series of cuts and has at least a first side and a second side. The first side and the second side oppose each other. The printing label is affixed to the release material so as to extend across the first side and the second side of the cut-out area. A fixing force by which the cut-out area is fixed to an area of the release material outside the cut-out area is greater than an adhesive force between the printing label and the cut-out area irrespective of whether a peeling force is applied to peel off the printing label from the first side toward the second side or from the second side toward the first side.

According to still another aspect, the present disclosure further provides a method of wrapping a peeled-off label. The method includes: (a) performing; (b) peeling; and (c) peeling. The (a) performing performs printing on a label affixed to a release material to create a printed label. The release material has a cut-out area surrounded by a hole or a cut or a series of holes or a series of cuts. The label is affixed to the release material so as to extend across at least a portion of the hole or the cut or the series of holes or the series of cuts. The (b) peeling peels the printed label off the release material to wrap the printed label around an object while placing an exposed adhesive area in contact with the object. The (b) peeling is performed after the (a) performing. The (c) peeling peels the printed label together with the cut-out area to wrap the printed label around an object while placing the cut-out area in contact with the object. The (c) peeling is performed after the (a) performing.

According to still another aspect, the present disclosure further provides a method of wrapping a peeled-off label. The method includes: (d) performing; (e) peeling; (f) peeling; and (g) wrapping. The (d) performing performs printing on a label affixed to a release material to create a printed label. The release material has a cut-out area surrounded by a hole or a cut or a series of holes or a series of cuts. The label is affixed to the release material so as to extend across at least a portion of the hole or the cut or the series of holes or the series of cuts. The (e) peeling peels the printed label off the release material together with the cut-out area. The (f) peeling peels the cut-out area off the printed label to wrap the printed label around an object while placing an exposed adhesive area in contact with the object. The (f) peeling is performed after the (e) peeling. The (g) wrapping wraps the printed label around an object while placing the cut-out area in contact with the object. The (g) wrapping is performed after the (e) peeling.

BRIEF DESCRIPTION OF THE DRAWINGS

The particular features and advantages of the disclosure as well as other objects will become apparent from the following description taken in connection with the accompanying drawings, in which:

FIGS. 2A through 2F show a printing tape according to a first embodiment of the present disclosure, in which: FIG. 2A is a plan view showing the printing tape in an unprinted state; FIG. 2B is a plan view showing the printing tape after printing; FIG. 2C is a cross-sectional view along the section IIy-IIy of the printed printing tape; FIG. 2D is a rear view of the printed printing tape; FIG. 2E is a cross-sectional view along the section Ix-Ix of the unprinted printing tape; and FIG. 2F is a cross-sectional view along the section IIx-IIx after printing;

FIGS. 3A and 3B show an attached state of a print label relative to a cable, in which: FIG. 3A is a schematic diagram showing the print label in an orientation in which a printed image is positioned on the front side; and FIG. 3B is a schematic diagram showing the print label in in orientation in which the printed image is positioned on the upper side;

FIGS. 5A and 5B show a usage pattern when the print label is used as a rotating label, in which: FIG. 5A is a plan view showing the printing tape when the print label is to be used as a rotating label; and FIG. 5B is a rear view showing the same printing tape;

FIGS. 6A and 6B show a usage pattern when the print label is used as a fixed label, in which: FIG. 6A is a plan view showing the printing tape when the print label is to be used as a fixed label; and FIG. 6B is a rear view showing the same printing tape;

FIGS. 7A through 7E show a usage pattern when the print label is used as a rotating label, in which: FIG. 7A is a plan view showing the printing tape when the print label is to be used as a rotating label; FIG. 7B is a rear view showing the same printing tape; FIG. 7C is a plan view showing the separated print label and printing tape; FIG. 7D is a rear view of the printing tape from which the print label is separated; and FIG. 7E is a cross-sectional view along the section IIIy-IIIy of the separated print label and printing tape;

FIGS. 8A and 8B show the print label when the print label is used as a rotating label, in which: FIG. 8A is a plan view of the print label; and FIG. 8B is a cross-sectional view along the section IVy-IVy;

FIGS. 9A through 9C show a procedure for attaching the print label to a cable when the print label is used as a rotating label, in which: FIG. 9A is a diagram explaining a state of the print label and the cable prior to attaching the print label to the cable; FIG. 9B is a diagram explaining a state of the print label and the cable when the print label is wrapped once around the cable; and FIG. 9C is a diagram explaining a state of the print label and the cable when the print label has been attached to the cable;

FIGS. 10A through 10D show a usage pattern when the print label is used as a fixed label, in which: FIG. 10A is a plan view showing the printing tape when the print label is to be used as a fixed label; FIG. 10B is a plan view showing the separated print label and printing tape; FIG. 10C is a rear view of the printing tape from which the print label is separated; and FIG. 10D is a cross-sectional view along the section Vy-Vy of the separated print label and printing tape;

FIGS. 11A and 11B show the print label when the print label is used as a fixed label, in which: FIG. 11A is a plan view of the print label; and FIG. 11B is a cross-sectional view along the section VIy-VIy;

FIGS. 12A through 12C shows a procedure for attaching the print label to a cable when the print label is used as a fixed label, in which: FIG. 12A is a diagram explaining a state of the print label and the cable prior to attaching the print label to the cable; FIG. 12B is a diagram explaining a state of the print label and the cable when the print label is wrapped once around the cable; and FIG. 12C is a diagram explaining a state of the print label and the cable when the print label has been attached to the cable;

FIGS. 13A through 13F are schematic diagrams showing a printing tape according to a first variation of the first embodiment of the present disclosure, in which: FIG. 13A schematically shows a plan view of a print label after the print label has been separated from the printing tape; FIG. 13B is a cross-sectional view along the section VIIy-VIIy of the printing tape and the print label after the print label has been separated from the printing tape; FIG. 13C is a rear view of the printing tape when the print label has been peeled off as a rotating label; FIG. 13D is a rear view of the printing tape before separation of the print label; FIG. 13E is a cross-sectional view along the section VIIIy-VIIIy of the printing tape and the print label after the print label has been separated from the printing tape; and FIG. 13F schematically shows a plan view of the print label after the print label has been separated from the printing tape;

FIGS. 16A through 16C are schematic diagrams showing a printing tape according to a fourth variation of the first embodiment of the present disclosure, in which: FIG. 16A is a plan view showing a print label peeled off as a rotating label; FIG. 16B is a plan view showing the printing tape from after the print label has been peeled off as a rotating label; and FIG. 16C is a plan view showing the print label peeled off as a fixed label;

FIGS. 17A through 17F show a printing tape according to a second embodiment of the present disclosure, in which: FIG. 17A is a plan view showing the printing tape in an unprinted state; FIG. 17B is a plan view showing the printing tape after printing; FIG. 17C is a cross-sectional view along the section Xy-Xy of the printed printing tape; FIG. 17D is a rear view of the printed printing tape; FIG. 17E is a cross-sectional view along the section IXx-IXx of the unprinted printing tape; and FIG. 17F is a cross-sectional view along the section Xx-Xx after printing;

FIGS. 18A through 18C show a usage pattern when the print label is used as a rotating label, in which: FIG. 18A is a plan view showing the separated print label and printing tape; FIG. 18B is a rear view showing the printing tape from which the print label is separated; and FIG. 18C is a cross-sectional view along the section XIy-XIy of the separated print label and printing tape;

FIGS. 19A through 19E show a usage pattern when the print label is used as a fixed label, in which: FIG. 19A and FIG. 19B are plan views showing the printing tape when the print label is to be used as a fixed label; FIG. 19C is a plan view showing the separated print label and printing tape; FIG. 19D is a rear view of the printing tape from which the print label is separated; and FIG. 19E is a cross-sectional view along the section XIIy-XIIy of the separated print label and printing tape; and FIGS. 20A through 20G are schematic diagrams showing a printing tape according to a third embodiment of the present disclosure, in which: FIG. 20A is a cross-sectional view along the section XIIIy-XIIIy of the printing tape prior to the print label being peeled off; FIG. 20B is a plan view of the printing tape when peeling off the print label; FIG. 20C is a plan view of the print label that has been peeled off the printing tape; FIG. 20D is a rear view of the print label that has been separated from the printing tape; FIG. 20E is a schematic view of the print label to be used as a fixed label; FIG. 20F is a plan view of the print label to be used as a fixed label; and FIG. 20G is a schematic view of the print label to be sued as a rotating label.

DETAILED DESCRIPTION

Figure 1:
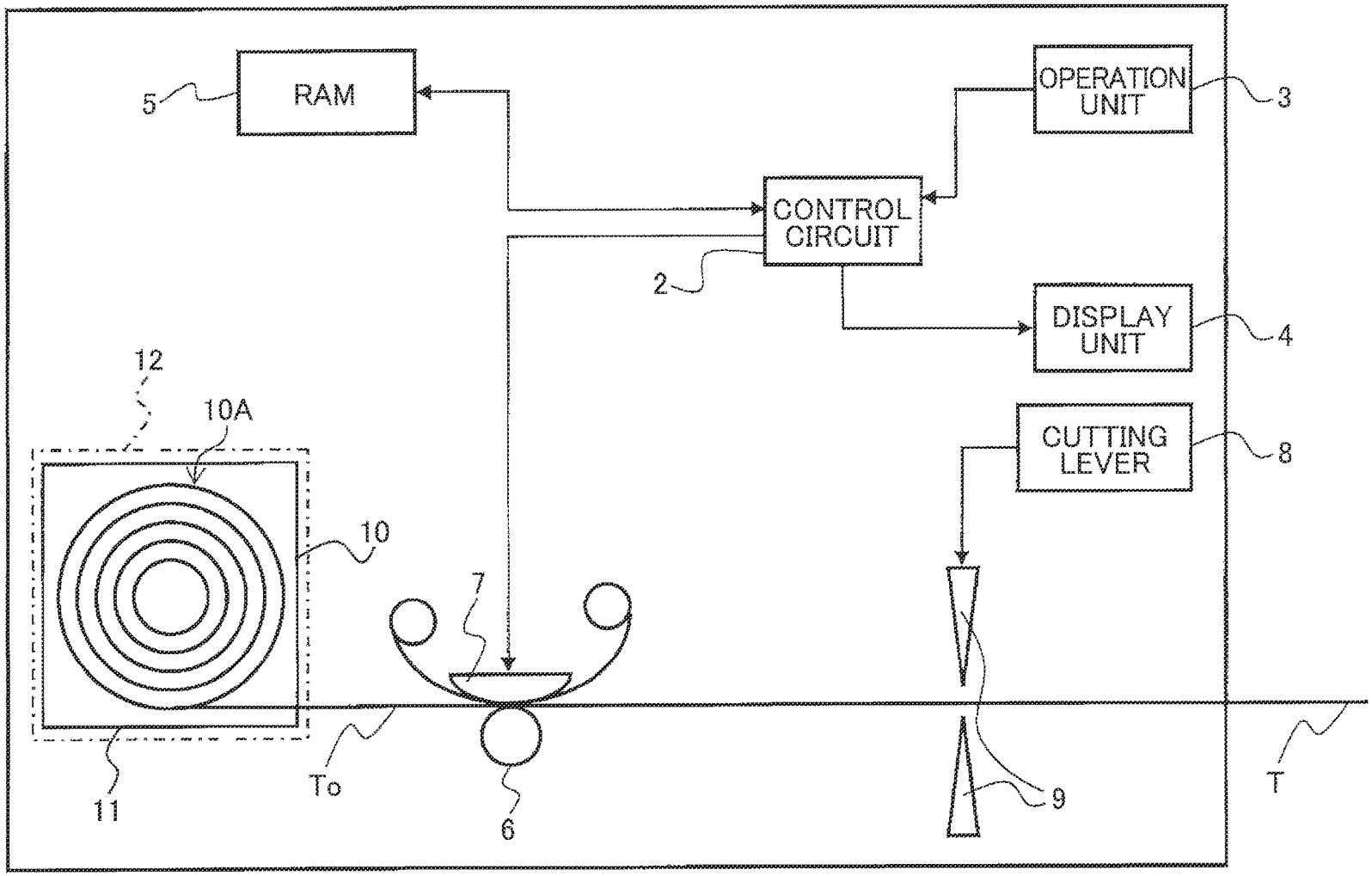
FIG. 1 is an explanatory diagram showing a schematic configuration of a label-creating device according to each of embodiments of the present disclosure.

Below, embodiments of the present disclosure will be described in detail while referring to the accompanying drawings. In general, components having essentially the same functions are designated with the same reference numerals in the following specification and the drawings. Duplicate descriptions of such components are omitted accordingly.

<Label-Creating Device>

First, the functional configuration of a label-creating device according to each embodiment of the present disclosure will be described with reference to FIG. 1.

In FIG. 1, a label-creating device 1 (corresponding to a printer) has a control circuit 2, an operation unit 3 on which a user (an operator) can perform desired operations, a display unit 4 for displaying prescribed information, a RAM 5 for storing various types of information, a conveying roller 6, a print head 7, a cutting lever 8, and a cutter 9.

A cartridge holder 12 is provided in the label-creating device 1. A tape cartridge 10 (corresponding to a cassette) is detachably mounted in the cartridge holder 12. The tape cartridge 10 has a housing 11 that accommodates a tape roll 10A (depicted as concentric circles for simplification, but actually wound into a roll). A printing tape To is wound into the tape roll 10A in a roll shape.

Here, the tape cartridge 10 may be a die-cut label type or a continuous length type. In the die-cut label type, a printing tape To having cuts HC (described later with reference to FIG. 2) formed by half-cutting the printing tape To is wound about the tape roll A. In the continuous length type (described later with reference to FIGS. 11A and 11B), a printing tape To having no cuts HC is wound about the tape roll A. Either type of tape cartridge 10 can be used in the label-creating device 1. Unless otherwise stated, the following example describes a case of using the die-cut label type tape cartridge 10. Note that the cuts HC described above is configured of so-called perforations, for example. The "perforation" in the present specification refers to a plurality of fine line holes that are intermittent in the plane direction in a target layer, and each perforation penetrates the target layer in the thickness direction (hereinafter the same).

The control circuit 2 is provided with a CPU and a ROM not shown in the drawings. The control circuit 2 executes various programs pre-stored in the ROM while utilizing the temporary storage function of the RAM 5 in order to perform overall control of the label-creating device 1.

The conveying roller 6 is disposed in opposition to the print head 7. The printing tape To paid out from the tape roll 10A is interposed between the conveying roller 6 and print head 7. By rotating, the conveying roller 6 conveys the printing tape To while pulling the printing tape To from the tape roll 10A.

The print head 7 prints desired print objects (see printed images R described later) on individual main label part Lo (described later in greater detail) of the printing tape To conveyed by the conveying roller 6. The print objects are user-specified characters, icons, and the like.

When actuated through a user operation on the cutting lever 8, the cutter 9 cuts off a printed section of a printing tape T (described later in greater detail) having a plurality of labels L formed along the conveying direction. The printing tapes To and T correspond to the medium described in each claim.

First Embodiment

Below, a first embodiment of the present disclosure will be described while referring to FIGS. 2A through 12C.

<Printing Tape>

Figure 2A:
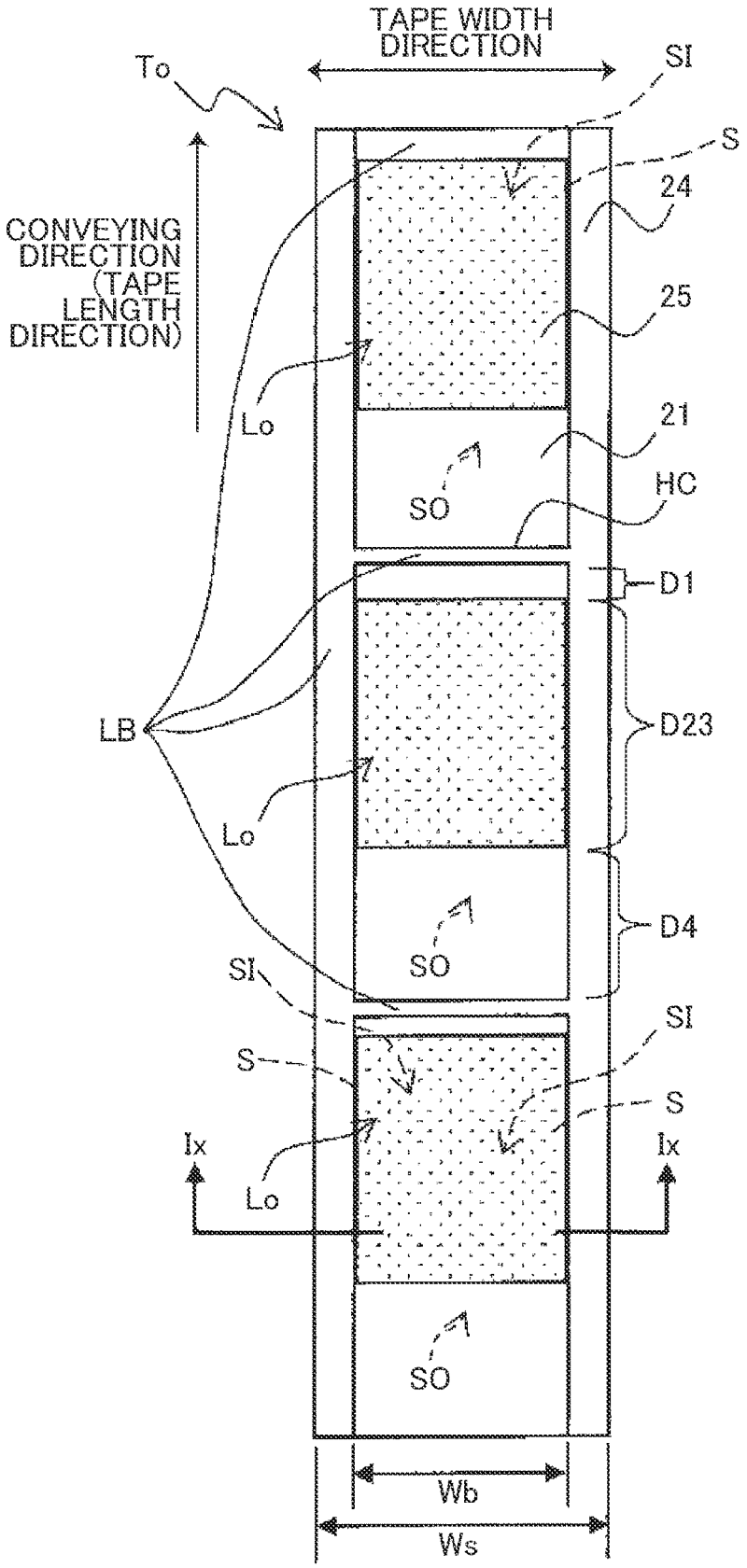
Figure 2B:
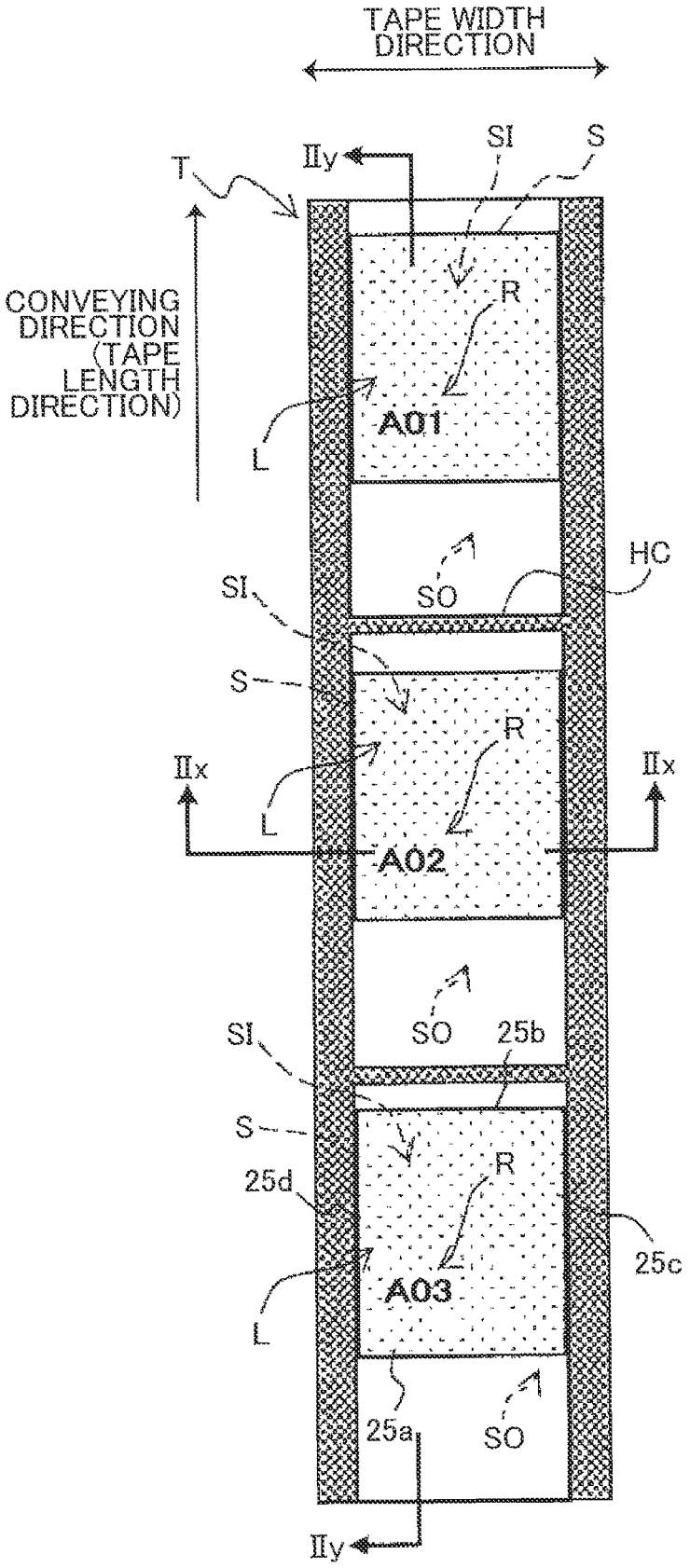
Figure 2C:
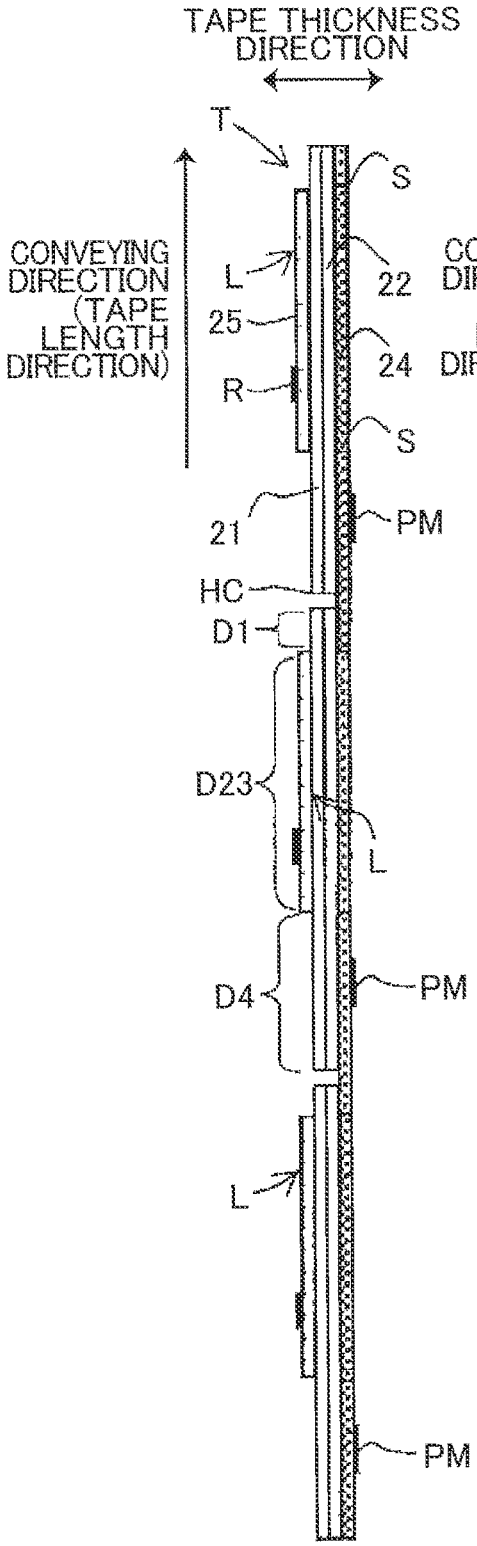
Figure 2D:
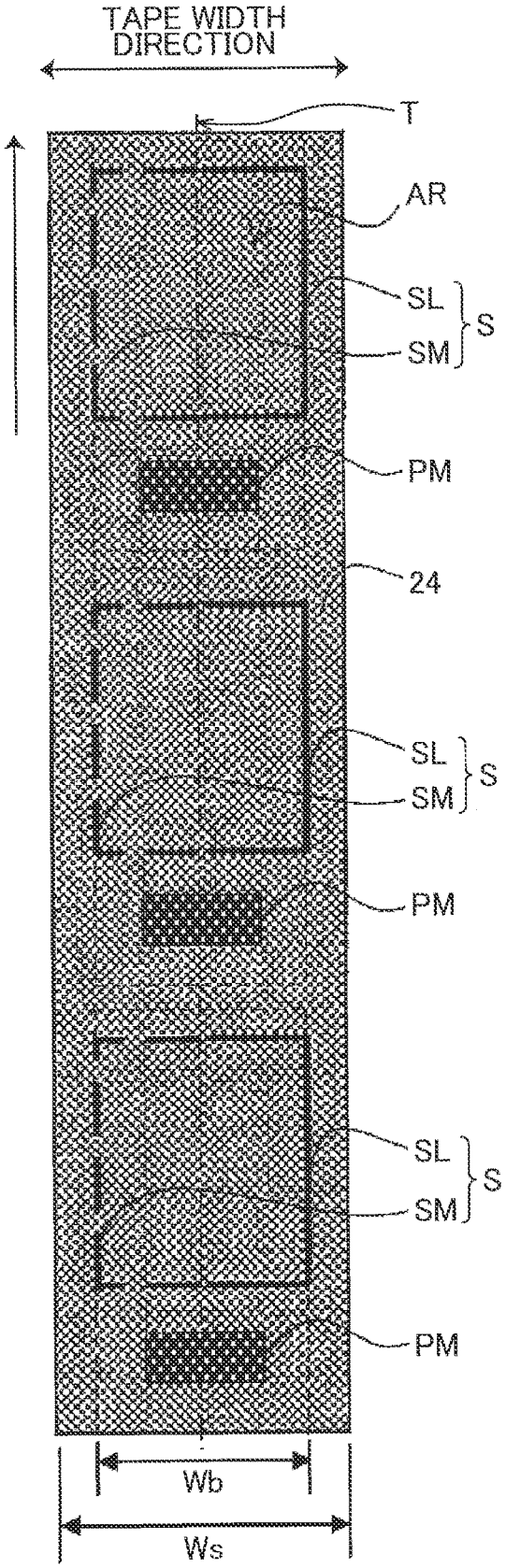
Figure 2E:
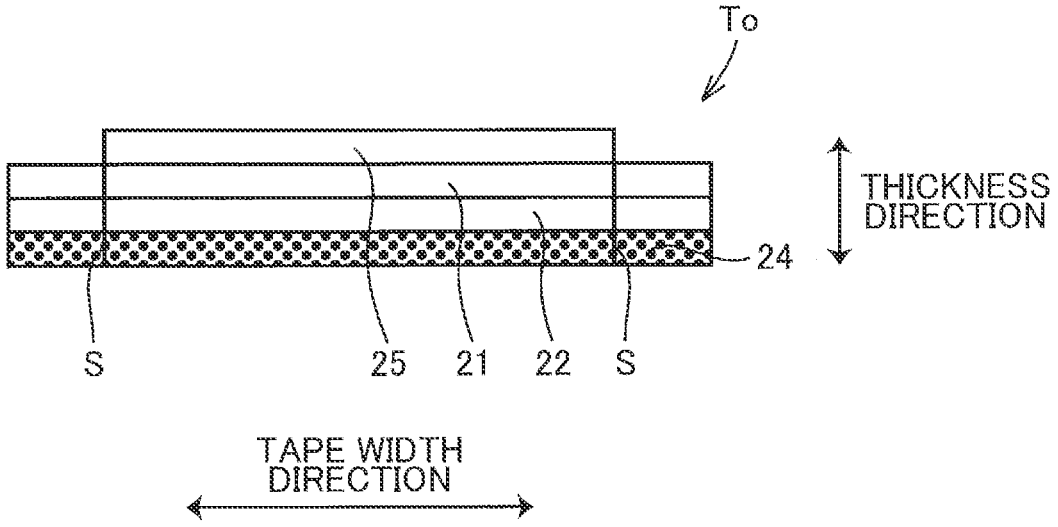
Figure 2F:
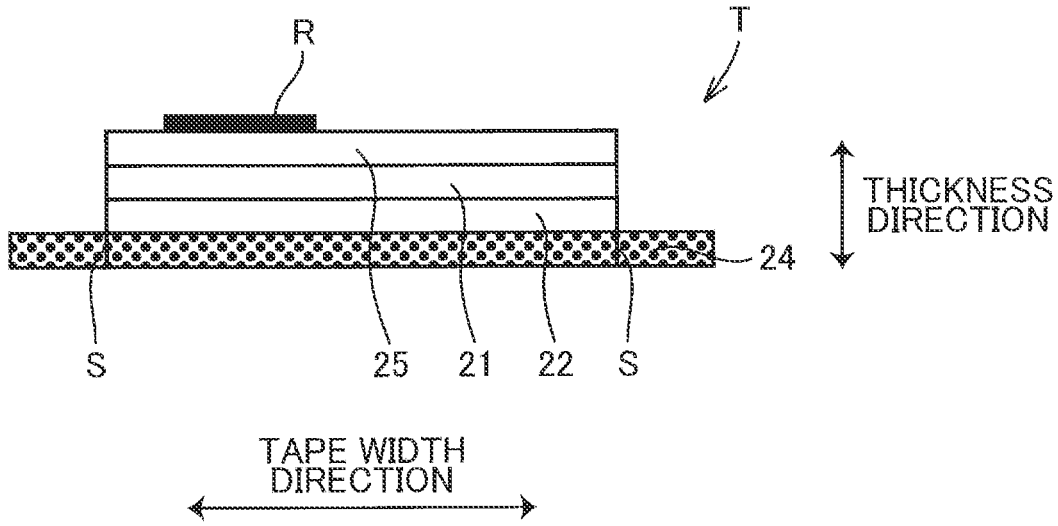

FIGS. 2A through 2F show a detailed structure of the printing tapes To and T according to the present embodiment. FIG. 2A is a plan view showing the printing tape To in an unprinted state, and FIG. 2B is a plan view of the printing tape T after a printed image R has been printed and an excess label portion LB has been peeled off. In FIGS. 2A and 2B, the up-down direction corresponds to the conveying direction (the tape length direction), the left-right direction in the drawings corresponds to the tape width direction, and the near-far direction in the drawings corresponds to the tape thickness direction (also called "thickness direction"). FIG. 2C is a cross-sectional view along the section IIy-IIy of the printed printing tape T, and FIG. 2D is a rear view of the printed printing tape T. FIG. 2E is a cross-sectional view along the section Ix-Ix of the unprinted printing tape To, and FIG. 2F is a cross-sectional view along the section IIx-IIx of the printed printing tape T.

As shown in FIGS. 2A through 2F, the printing tape To includes a transparent release material layer 24, a transparent adhesive layer 22 (corresponding to the adhesive layer), and a transparent base material layer 21 having compositions that include film and the like, for example. The release material layer 24, adhesive layer 22, and base material layer 21 are layered in sequence along the thickness direction from a first side of the thickness direction (the bottom side in FIG. 2E) toward a second side of the thickness direction (the top side in FIG. 2E). Note that the adhesive layer 22 may be provided over part of, rather than the entire, back side (the bottom side in FIG. 2E) of the base material layer 21, i.e., between the base material layer 21 and release material layer 24.

In the following description, the "top side" refers to the upper side in the up-down direction on the drawing, and the "bottom side" refers to the lower side in the up-down direction on the drawing. Further, the "left side" refers to the left side in the left-right direction on the drawing, and the "right side" refers to the right side in the left-right direction on the drawing.

In the printing tapes To and T having this layered structure, a plurality of main label parts Lo (or print labels L configured of printed images R formed on the main label parts Lo) is arranged successively in the tape length direction while interposed by the excess label portion LB (see FIG. 2A). In other words, the main label parts Lo (or the print labels L) are arranged discretely along the tape length direction. These main label parts Lo (or print labels L) are all arranged with their longitudinal directions oriented in the tape length direction. Here, the base material layer 21 is divided by cuts HC (perforations) into the main label parts Lo and the remaining excess label portion LB and is fixed via the adhesive layer 22 to the surface of the release material layer 24 on the second side of the thickness direction. The main label parts Lo correspond to the printing labels, and the excess label portion LB corresponds to the label. In the present embodiment, each label L is formed in a rectangular shape having a side La, a side Lb, a side Lc, and a side Ld (see FIG. 7C, for example).

At this time, a print background layer 25 (corresponding to the print part) is partially provided on the front-side (the top side in FIG. 2D) surface of the base material layer 21 at a position within the main label part Lo. The print background layer 25 has a suitable non-transparent color. The print head 7 forms the printed image R on the print background layer 25.

Owing to this layered structure, each main label part Lo (or print label L) has three areas, as shown in FIG. 2A and the like: an adhesive area D1 constituting the end on the first side of the tape length direction, an adhesive-variable area D23 provided adjacent to the adhesive area D1 and corresponding to the print background layer 25, and an adhesive area D4 provided adjacent to the adhesive-variable area D23. Here, a width Ws of the printing tapes To and T in the tape width direction is greater than a width Wb of the main label parts Lo in the tape width direction.

As shown in FIG. 2D, the release material layer 24 is provided with cut-out areas AR surrounded by break lines S. Each break line S is configured of a slit SL and a perforation SM and has a rectangular shape (a square shape). In a plan view, the cut-out area AR surrounded by the break line S is formed so that the adhesive area D1 and adhesive area D4 are positioned in a break line outer area SO outside the cut-out area AR, while the adhesive-variable area D23 is positioned in a break line inner area SI inside the cut-out area AR.

The print background layer 25 is arranged with at least a portion overlapping at least a portion of the break line inner area SI enclosed by the break line S. In this example, the print background layer 25 has the same dimension in the tape width direction and tape length direction as the break line S, and the entirety of the print background layer 25 overlaps the cut-out area AR within the break line S. In other words, the break line S overlaps the print background layer 25 in a plan view. Each print background layer 25 is formed in a square shape having a side 25*a*, a side 25*b*, a side 25*c*, and a side 25*d*.

As shown in FIG. 2D, marks PM are provided on the release material layer 24 in intermediate parts between neighboring break lines S for positioning control when the conveying roller 6 conveys the printing tape To. That is, the label-creating device 1 is provided with a well-known reflective optical sensor (not shown) having a light-emitting unit and a light-receiving unit. During positioning control, the optical sensor emits light from the light-emitting unit while the light-receiving unit receives light reflected off the release material layer 24. The marks PM on the release material layer 24 are detected based on the difference in the amount of light received between portions of the release material layer 24 on which the marks PM are provided and all other portions at this time, and the printing tape To is positioned based on these detections.

According to this structure of the release material layer 24, the rectangular break lines S are juxtaposed on the printing tapes To and T along the tape length direction, which is the conveying direction, and the print background layers 25 are positioned within the cut-out areas AR enclosed by these break lines S. A printed image R is formed on the print background layer 25 of each print label L. In this example, the printed images R are print objects configured of the text "A01," "A02," "A03," . . . .

<Sample Application of the Print Label>

With the printing tape To shown in FIGS. 2A and 2E described here, first the excess label portion LB is separated from the main label part Lo and the release material layer 24, as shown in FIGS. 2B through 2D and FIG. 2F, by peeling the excess label portion LB off the top surface of the release material layer 24. Note that a printing tape To may be initially prepared with a configuration that omits the excess label portion LB (i.e., the configuration shown in FIG. 2B without the printed images R). Next, a printed image R is formed on the print background layer 25 of each print label L while the print labels L are part of the printing tape T. The printed images R may also be formed prior to separating the excess label portion LB. Subsequently, each print label L included in the printing tape T and having a printed image R formed thereon is peeled off the release material layer 24 to produce individual print labels L. The separated print labels L are used by wrapping the print labels L around respective cables 302.

Figure 3A:
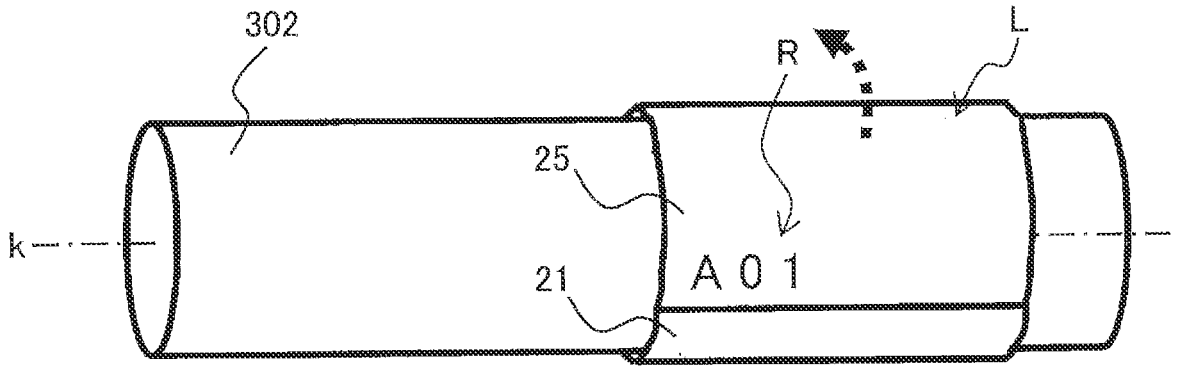
Figure 3B:
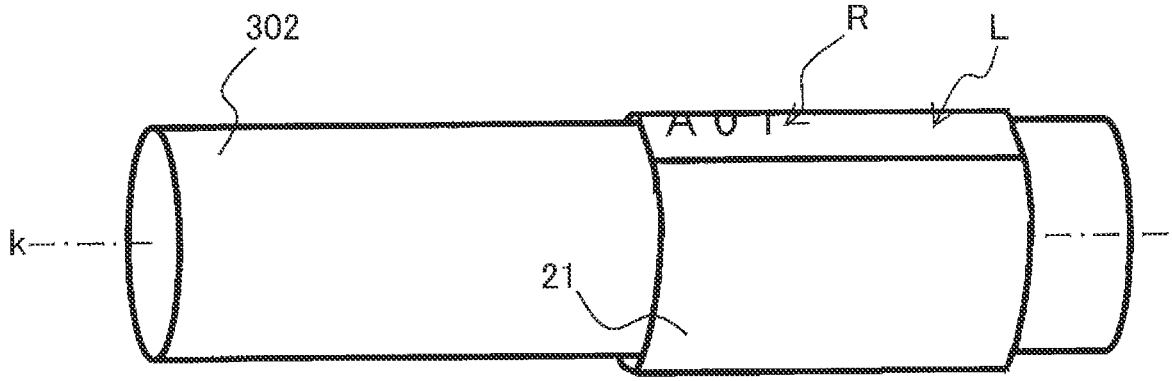
Figure 4:
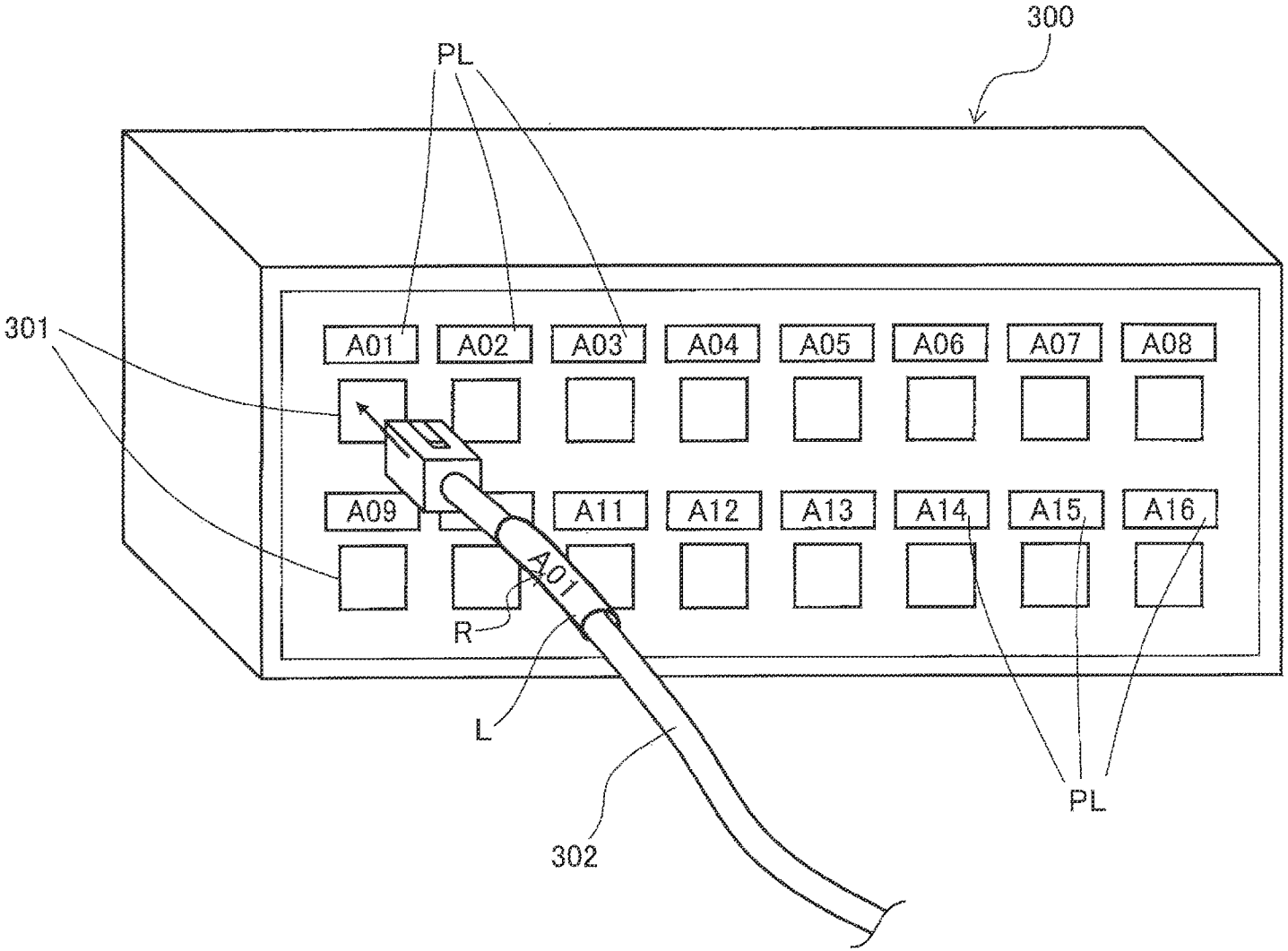
FIG. 4 is a schematic diagram showing a sample usage of the print label attached to a cable.

FIGS. 3A, 3B and 4 show a sample application for the print labels L. FIGS. 3A and 3B schematically show the attached state of the print label L relative to the cable 302. An axial center k of the cable 302 is also indicated in the drawing. The print label L is attached to the cable 302 constituting the adherend.

The print label L according to the present embodiment can be used as both a fixed label and a rotating label. In the sample state shown in FIG. 3A, the print label L is arranged such that the print background layer 25 provided with the "A01" printed image R is positioned on the near side in the drawing. Although the transparent adhesive area D4 is actually covering the outer circumferential side of the printed image R, the adhesive area D4 has been omitted from the drawings in FIGS. 3A and 3B in order to avoid complicating the drawings and to facilitate understanding. When using the print label L as a fixed label, the print label L can be maintained in the orientation shown in FIG. 3A relative to the cable 302. On the other hand, when using the print label L as a rotating label, the print label L can be rotated from the orientation shown in FIG. 3A to the orientation shown in FIG. 3B relative to the cable 302. Further, if the printed image R is not easily readable when the print label L is fixed to the cable 302 in the position shown in FIG. 3B, the printed image R becomes readable when the print label L is rotated in the direction opposite that described above to the position shown in FIG. 3A.

In this example, a cable for use with a switching hub that relays information over a network, such as a wired LAN, is applied as the cable 302. A switching hub 300 in FIG. 4 has eight slots 301 in each of a top row and a bottom row (a total of sixteen slots). In the example depicted in the drawing, plates PL indicating identification names "A01" through "A08" are provided in sequence from the left to correspond to the eight slots 301 in the top row, and plates PL indicating the identification names "A09" through "A16" are provided in sequence from the left to correspond to the eight slots 301 in the bottom row. The cable 302 must be appropriately connected to the corresponding slot 301. To facilitate connections, a print label L is mounted on the end of each cable 302 that is to be inserted into one of the slots 301, and the printed image R formed on each print label L has the same content as the identification name for the slot 301 to which the cable 302 is to be connected. In other words, a print label L printed with the same text as the identification name on the plate PL of the slot 301 to which the cable 302 is to be connected is attached to the cable 302. This configuration clarifies correlations between the slots 301 and cables 302 that are to be connected to the slots 301, thereby preventing incorrect wiring.

<Usage as a Rotating Label and a Fixed Label>

Figure 5A:
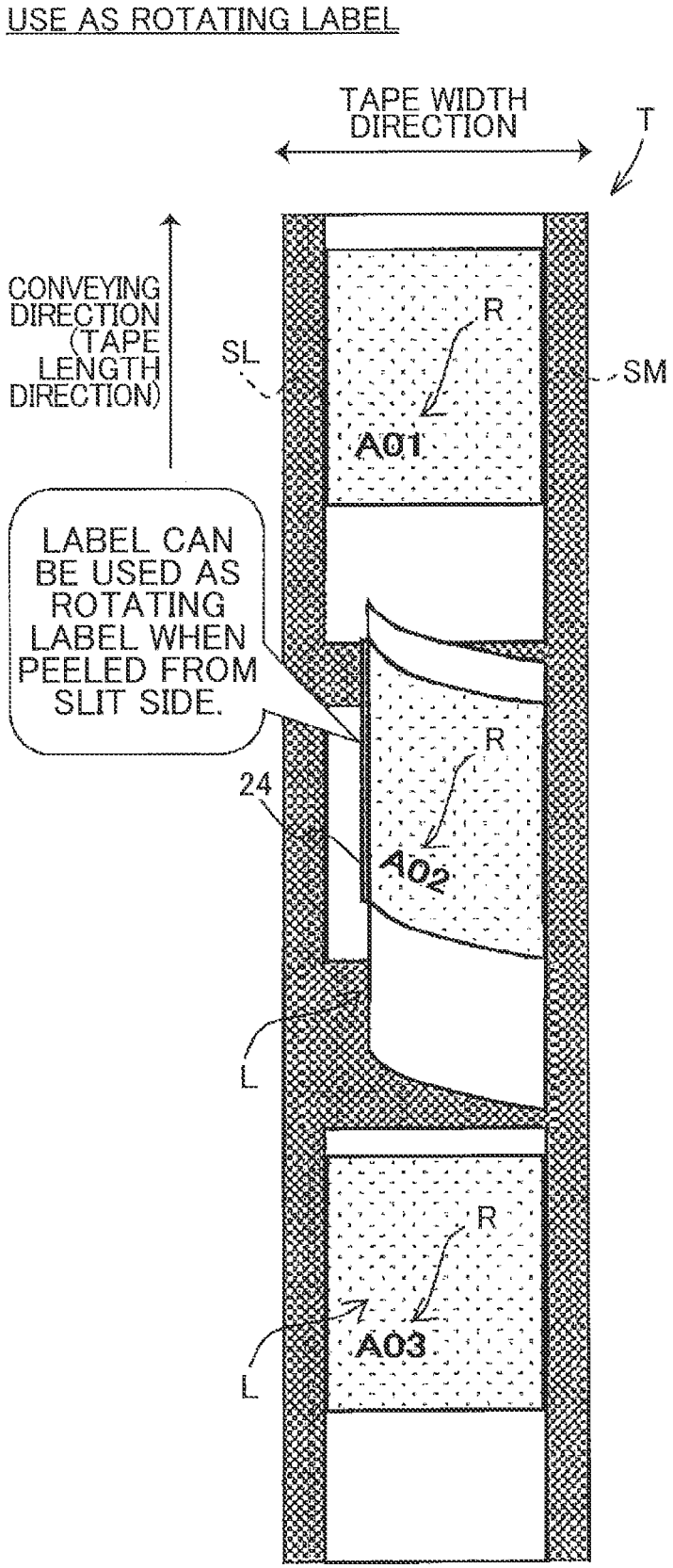
Figure 5B:
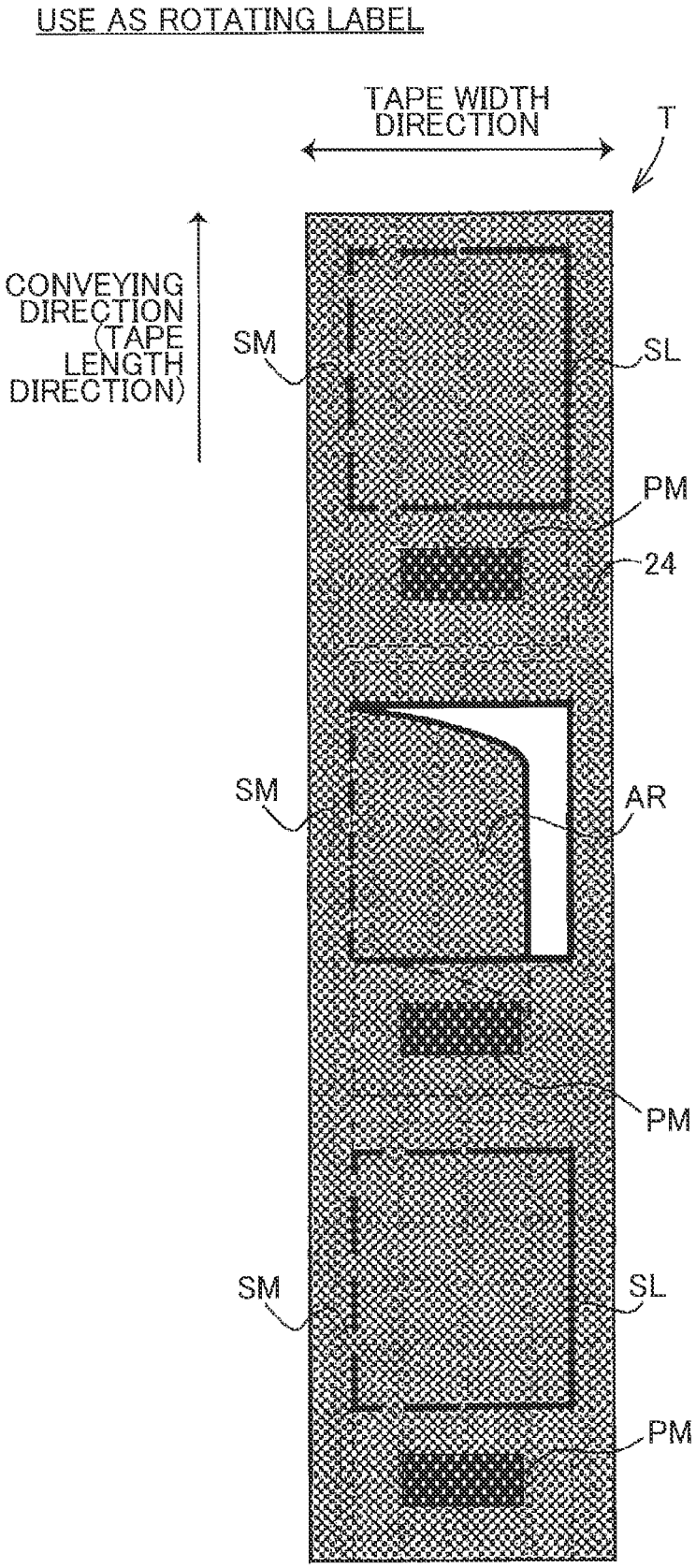
Figure 6A:
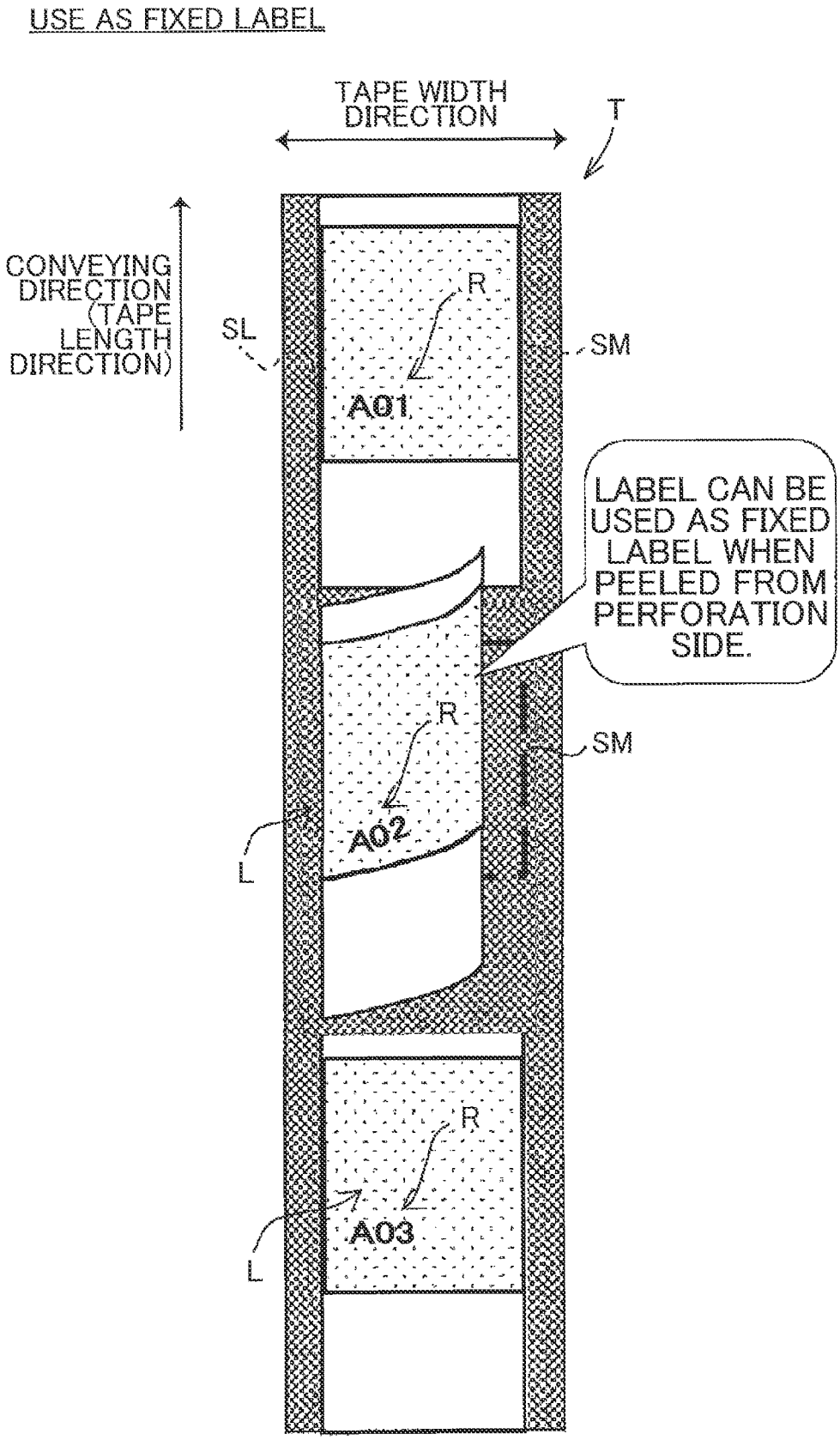
Figure 6B:
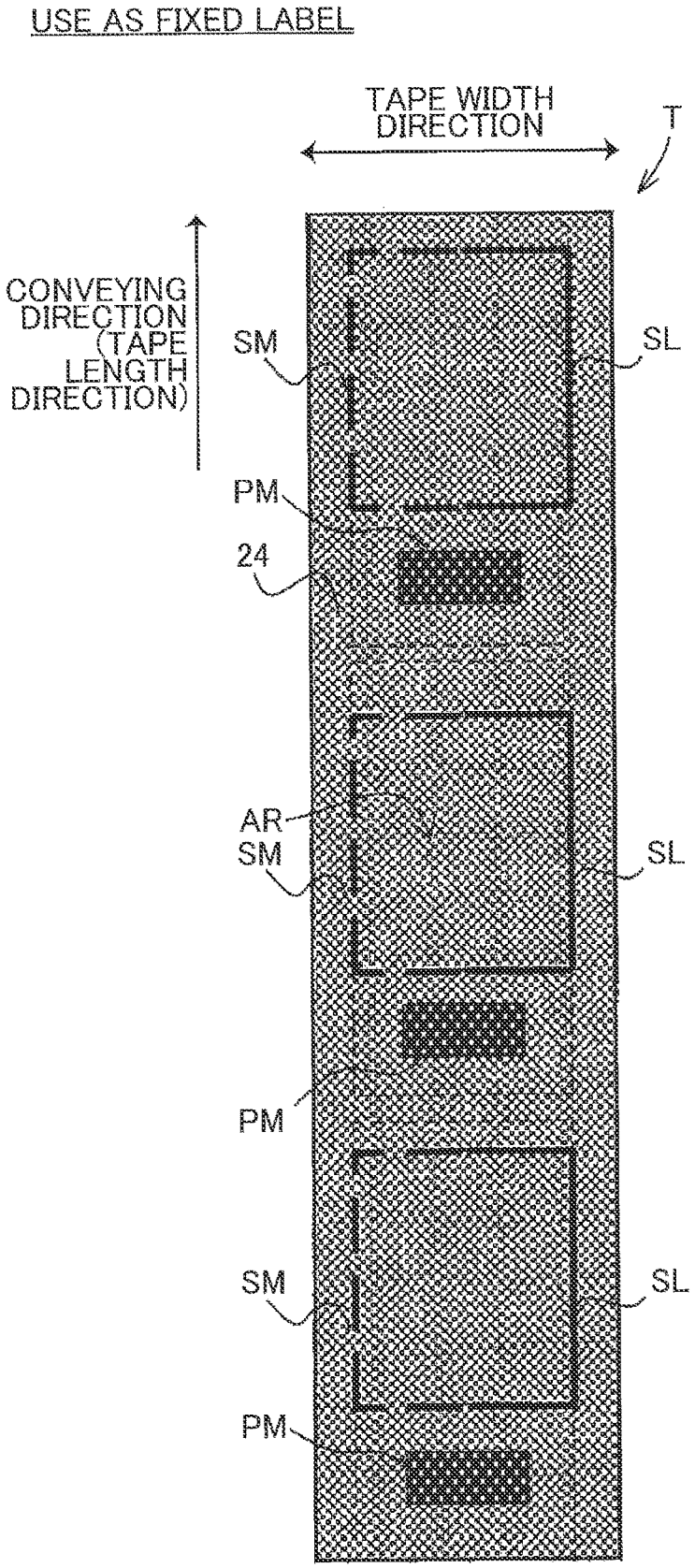

With the printing tapes To and T according to the present embodiment, the release material layer 24 has a break line S that includes a slit SL and a perforation SM. Depending on the manner in which the print label L is peeled off the release material layer 24, the print label L can be used either as a rotating label, as shown in FIGS. 5A and 5B, or a fixed label, as shown in FIGS. 6A and 6B. That is, if the print label L is peeled off from the left side in the drawing (the slit SL side), as shown in FIG. 5A, the release material layer 24 in the cut-out area AR remains stuck to the back surface of the print label L, as shown in FIG. 5B, enabling the print label L to be used as a rotating label. On the other hand, if the print label L is peeled off from the right side in the drawing (the perforation SM side), as illustrated in FIG. 6A, the print label L becomes separated from the release material layer 24 included in the cut-out area AR, as shown in FIG. 6B, enabling the print label L to be used as a fixed label. These different uses are made possible through the configuration of the break line S and the like. Therefore, this break line S will be described next in detail.

<Detailed Description of the Break Line S>

Referring once again to FIG. 2D, the break line S is configured of the slit SL and the perforation SM, as described above. The break line S has a first side positioned on the right side of the tape width direction in FIG. 2D (the left side of the tape width direction in FIG. 2B) and formed along the tape length direction; a second side positioned on the left side of the tape width direction in FIG. 2D (the right side of the tape width direction in FIG. 2B) and formed along the tape length direction; a third side positioned on the top side of the tape length direction in FIG. 2D and formed along the tape width direction; and a fourth side positioned on the bottom side of the tape length direction in FIG. 2D and formed along the tape width direction. Hence, the first and second sides oppose each other in the tape width direction, while the third and fourth sides oppose each other in the tape length direction. Further, the break line S on the first side and the break line S on the second side are of different types. The first side is configured of the slit SL, and the second side is configured of the perforation SM. Thus, the slit SL on the first side and the perforation SM on the second side oppose each other in the tape width direction.

The slit SL is configured of a hole or a cut, while the perforation SM is configured of a series of holes or a series of cuts. In the present embodiment, the slit SL and perforation SM denote something that penetrates the target layer in the thickness direction, but the slit SL and perforation SM may be configured to partially cut into the target layer in the thickness direction (a cut formed a fixed amount in the thickness direction). Since the first side is configured of a slit SL and the second side is configured of a perforation SM as described above, the total length of the hole or cut or series of holes or series of cuts in the first side, i.e., the total length of the region penetrated in the thickness direction is greater than the total length in the second side.

The third side and fourth side, on the other hand, are each configured of a slit on the first side of a centerline passing through their tape width directions, and a perforation on the second side of the centerline. Here, the main label part Lo (or print label L) is fixed to the release material layer 24 so as to extend across the first and second sides of the cut-out area AR, as well as to extend across the third and fourth sides of the cut-out area AR. By setting the adhesive strength between the print label L and cut-out area AR to at least 0.01 N/20 mm and no greater than 2 N/20 mm so that the bonded state of the cut-out area AR to the print label L can be adjusted, the print label L can be used as both a rotating label and a fixed label.

<Use as a Rotating Label>

First, a case for using the print label L as a rotating label will be described with reference to FIGS. 7A through 9C. Irrespective of whether the label will be a rotating label or a fixed label, first the label-creating device 1 forms a printed image R on the main label part Lo affixed to the release material layer 24 of the printing tape To, creating a printed print label L (Step 1). Subsequently, the print label L is peeled off the printing tape T together with the cut-out area AR, as shown in FIGS. 7A through 8B. As shown in FIGS. 9A through 9C, the print label L can be used as a rotating label by placing the cut-out area AR in contact with the cable 302 constituting the object and wrapping the print label L around the cable 302 (Step 2B). Note that the excess label portion LB is preferably peeled off the printing tape T prior to the print label L being peeled off the printing tape T.

(1) Method of Peeling Off a Print Label to Be Used as a Rotating Label

Figure 7A:
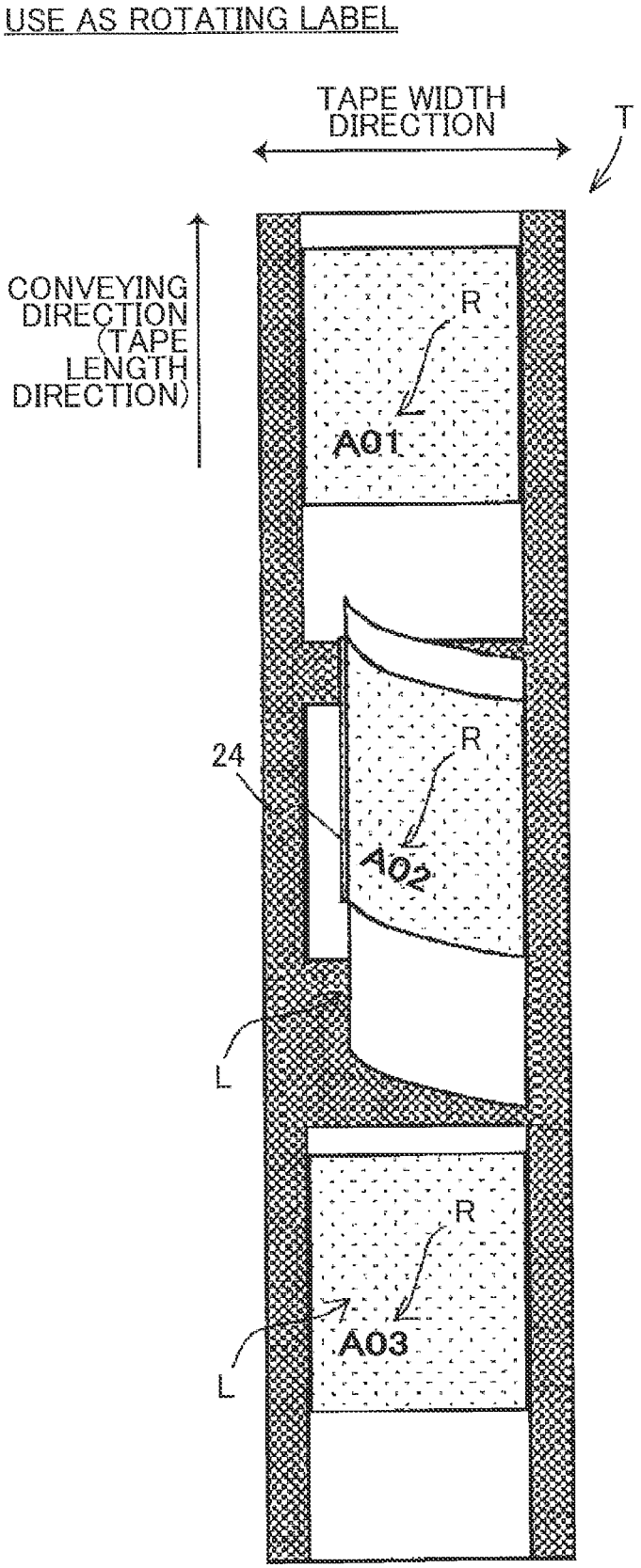
Figure 7B:
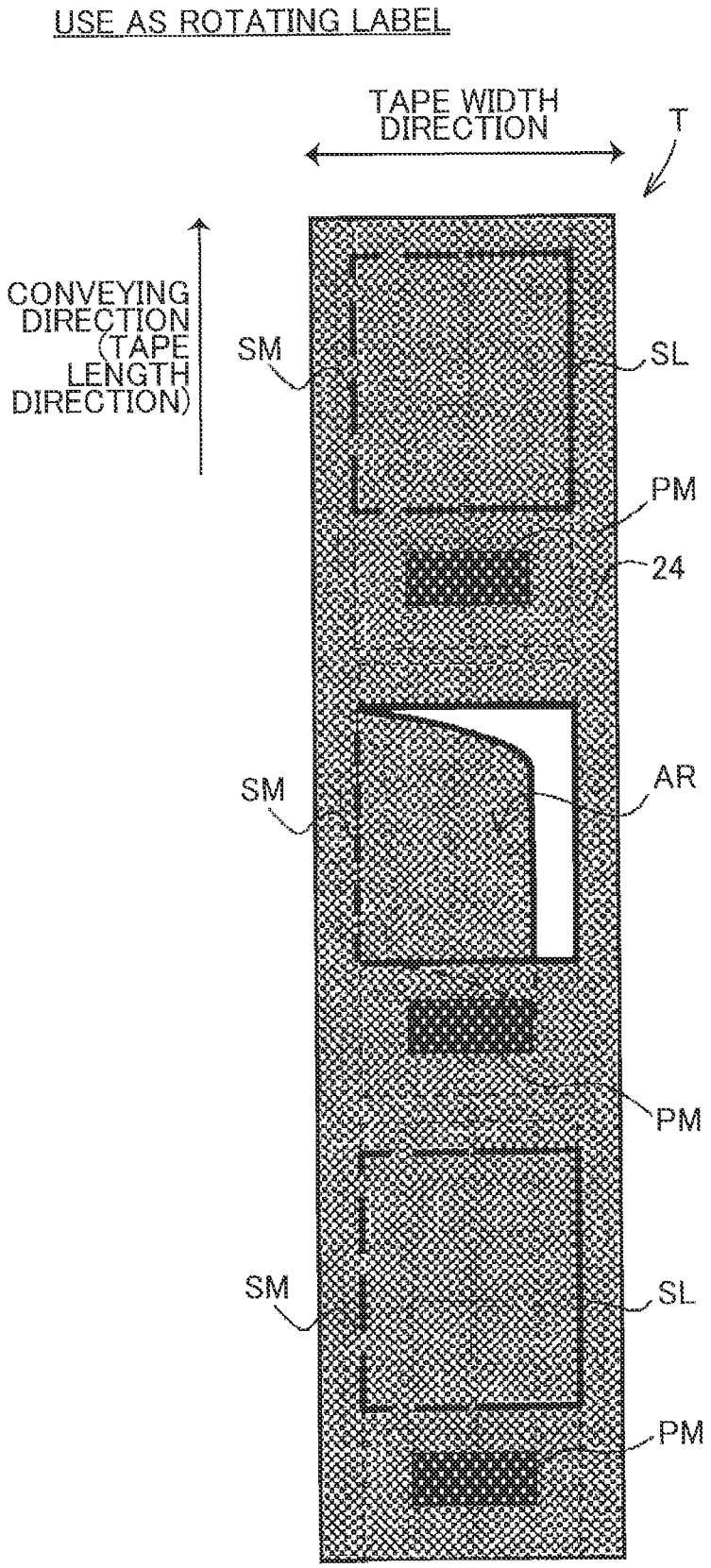
Figure 7C:
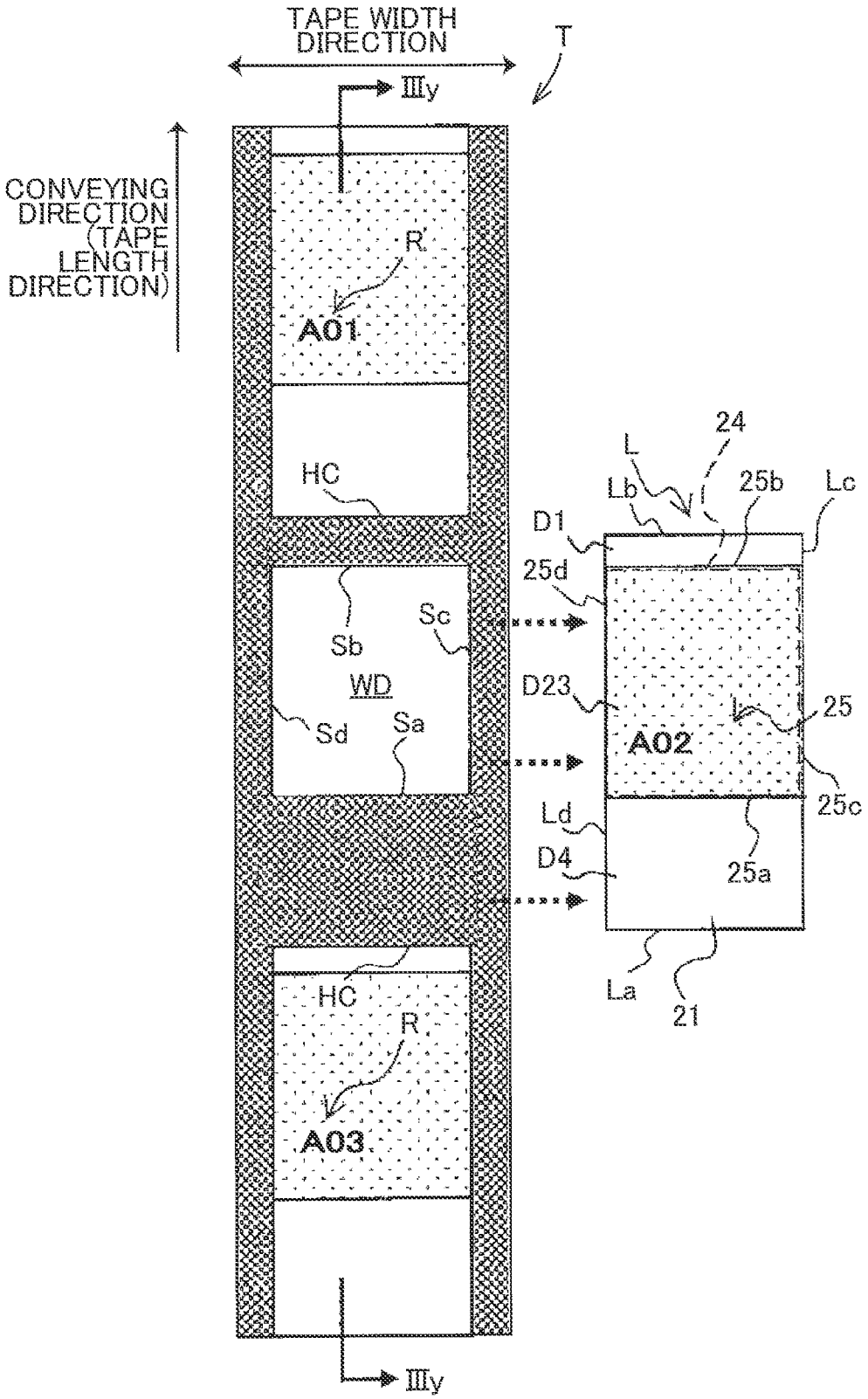
Figure 7D:
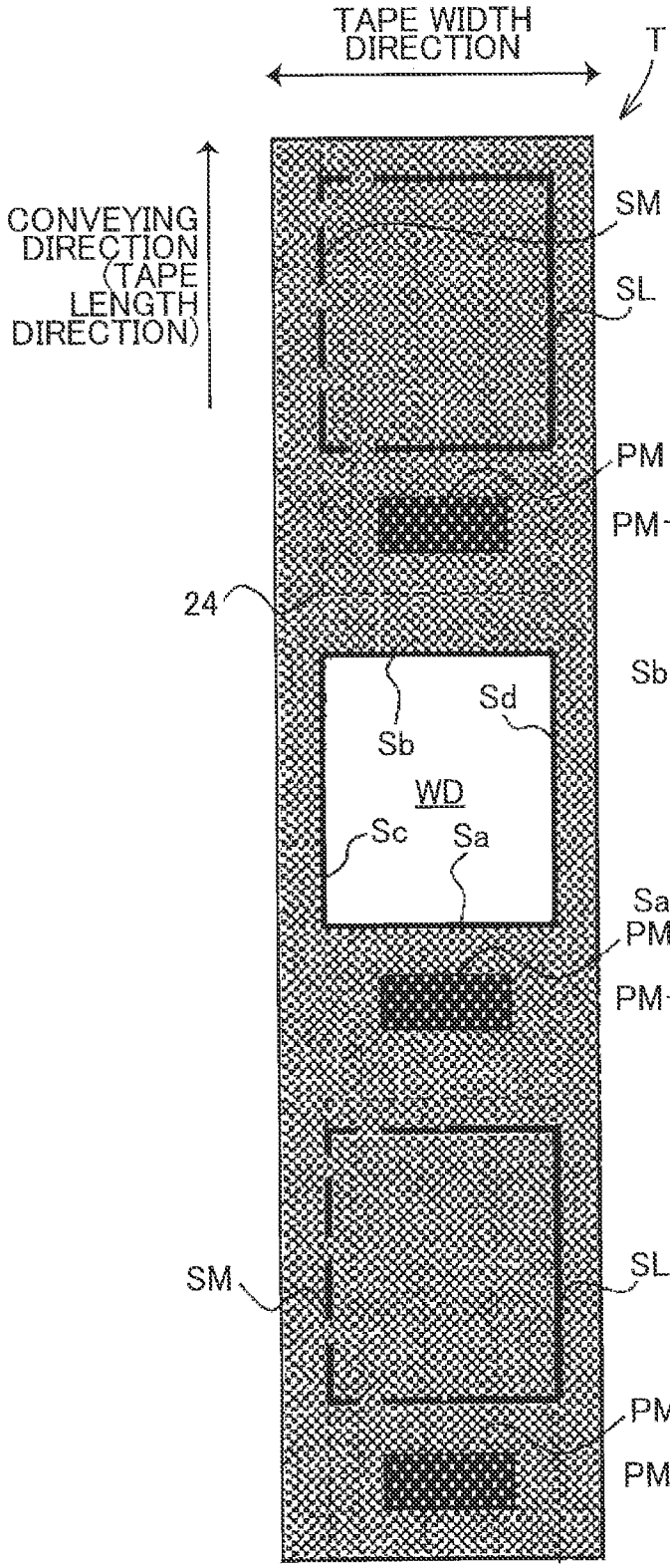
Figure 7E:
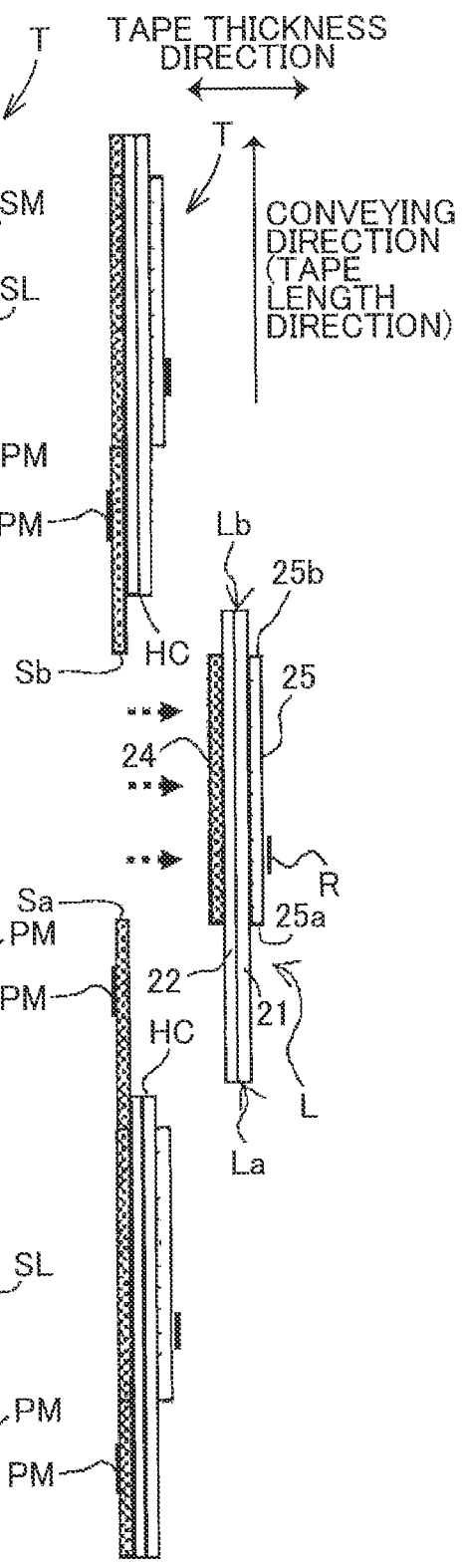

The method of peeling off a print label L that is to be used as a rotating label will be described with more specifics. When the print label L is to be used as a rotating label, the user peels off the print label L from the left side in the drawing (the slit SL side; the first side), as shown in FIG. 7A. When the print label L is peeled from the slit SL side in this way, the release material layer 24 in the cut-out area AR remains stuck to the back surface of the print label L, as illustrated in FIG. 7B. As described above, the first side of the break line S is configured of a slit SL and the second side of the break line S is configured of a perforation SM. Hence, when the print label L is peeled away from the first side, the cut-out area AR remains stuck to the print label L and separates from the surrounding release material layer 24 owing to the slit SL while the print label L corresponding to the area of the slit SL is being peeled away. When the print label L corresponding to the perforation SM is peeled away, the perforation SM applies a force for pulling the cut-out area AR toward the surrounding the release material layer 24 in addition to the force with which the cut-out area AR is bonded to the print label L. However, since the portion of the cut-out area AR corresponding to the slit SL is already stuck to the print label L at this stage, the force by which the cut-out area AR is fixed to the area of the release material layer 24 outside the cut-out area AR is smaller than the adhesive strength between the print label L and the cut-out area AR when a force for peeling off the print label L from the first side toward the second side is applied. Accordingly, as the print label L is separated from the printing tape T, as shown in FIG. 7C, the perforation SM is broken. As shown in FIGS. 7D and 7E, a rectangular hole WD enclosed by sides Sa, Sb, Sc, and Sd is created in the region of the release material layer 24 corresponding to the cut-out area AR, while the cut-out area AR of the release material layer 24 remains stuck to the adhesive layer 22 of the print label L at a position in the adhesive-variable area D23.

(2) Structure of a Print Label to Be Used as a Rotating Label

Next, the structure of the print label L generated according to the above method will be described with reference to FIGS. 8A and 8B. FIG. 8A shows a plan view of a single print label L produced according to the above method of separation, and FIG. 8B shows a cross-sectional view taken along the section IVy-IVy in FIG. 8A.

As with the printing tape T described previously, the print label L in FIGS. 8A and 8B has the transparent base material layer 21, adhesive layer 22, and release material layer 24 that are layered in this order along the thickness direction (the depth direction in FIG. 8A and the left-right direction in FIG. 8B) from the left side to the right side in FIG. 8B. The print background layer 25 having the printed image R is partially provided on the second-side surface of the base material layer 21 relative to the thickness direction. The print label L is provided with the adhesive area D1, the adhesive-variable area D23, and the adhesive area D4 from the second side (top side in the drawing) toward the first side (bottom side in the drawing) of the tape length direction (up-down direction in the drawing).

Figure 8B:
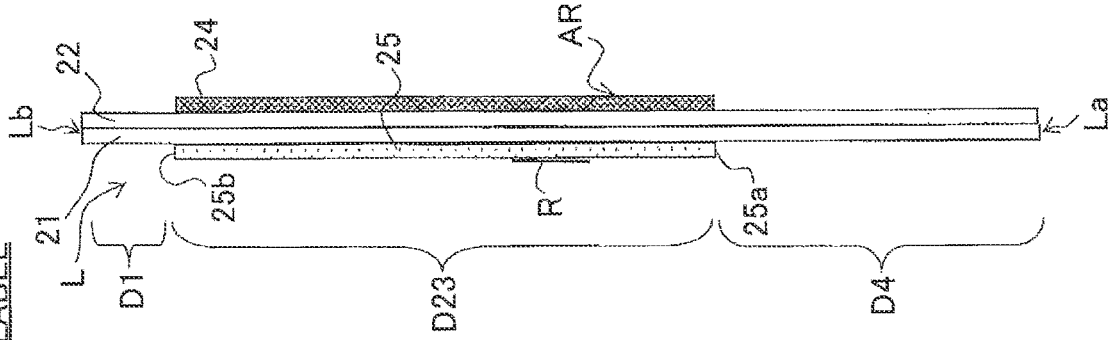
Figure 8A:
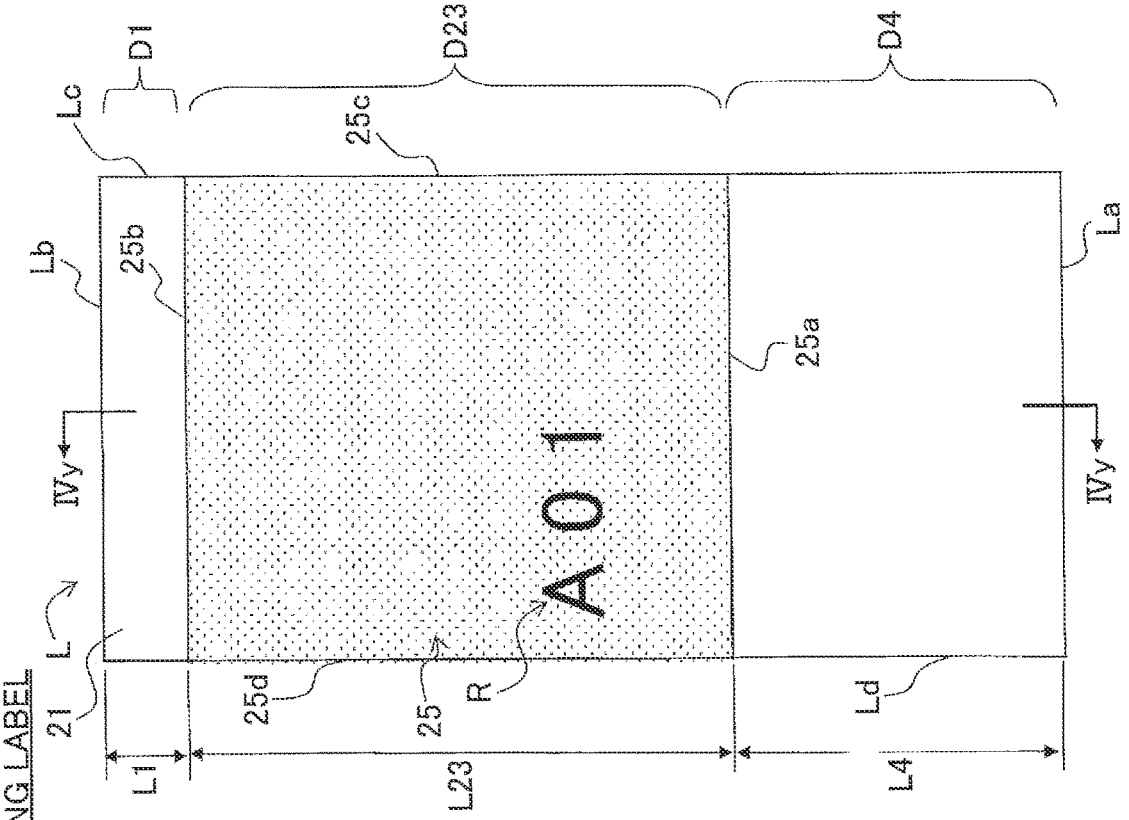
Figure 9A:
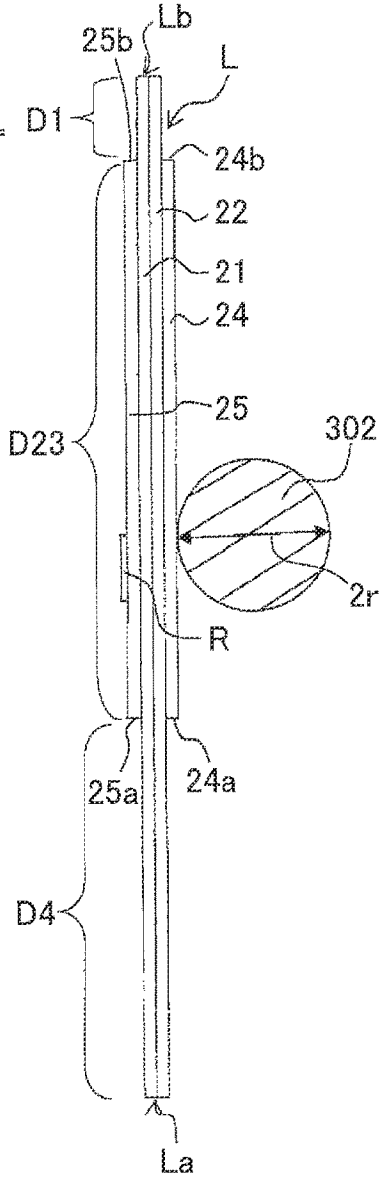
Figure 9B:
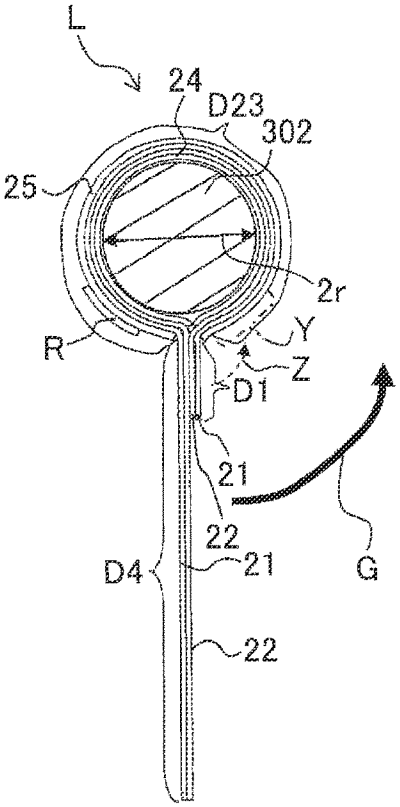
Figure 9C:
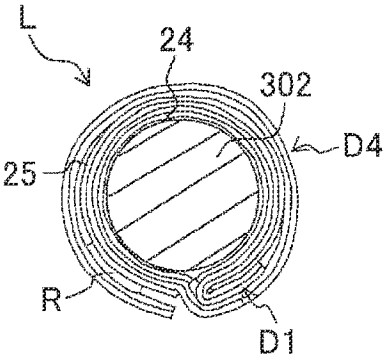

In the adhesive area D1, the base material layer 21 and adhesive layer 22 are layered in order from the second side toward the first side of the thickness direction (from the left side toward the right side in FIG. 8B). Thus, the entire region of the adhesive area D1 is provided with an adhesive property owing to the adhesive layer 22. Note that the adhesive area D1 is provided with a length L1 in the tape width direction.

In the adhesive-variable area D23, the print background layer 25 provided with the printed image R, the base material layer 21, the adhesive layer 22, and the release material layer 24 (the cut-out area AR) are layered in order from the second side toward the first side of the thickness direction. Thus, the entirety of the adhesive-variable area D23 is non-adhesive, as the adhesive property of the adhesive layer 22 is inhibited by the release material layer 24. In this example, the print background layer 25 is formed by applying ink (an ink coating layer) of a suitable color (a light transmissive color in this example, including transparent colors) on the base material layer 21 in advance, and the print head 7 forms the printed image R configured of the text "A01." The adhesive-variable area D23 has a length L23 in the tape width direction.

In the adhesive area D4, the base material layer 21 and adhesive layer 22 are layered in order from the second side toward the first side of the thickness direction. Thus, the entirety of the adhesive area D4 is provided with an adhesive property through the adhesive layer 22. The adhesive area D4 has a length L4 in the tape width direction.

(3) Procedure for Attaching a Print Label to Be Used as a Rotating Label to an Object FIGS. 9A through 9C show a sample procedure for attaching the print label L described above to an object. In the example of FIGS. 9A through 9C, the print label L is attached by wrapping the print label L around a cable-like (i.e., cylindrically shaped) object (also called an adherend; hereinafter simply called the "cable 302" for convenience) having a diameter 2r.

As shown in FIG. 9A, the print label L has areas extending continuously in the order: adhesive area D1→adhesive-variable area D23 covered by the separated release material layer 24→adhesive area D4. (In other words, the adhesive layer 22 is exposed in the adhesive areas D1 and D4, which are not covered by the release material layer 24.) First, the adhesive area D1 and adhesive-variable area D23 of the print label L are bent into a concave shape (not shown) so that the release material layer 24 side (the right side in FIG. 9A) is on the inside.

Next, the cable 302 is placed on the inside of the concave-shaped print label L, and the print label L is wrapped once around the cable 302 to form a cylinder encircling the cable 302 in a loop shape, as shown in FIG. 9B. Subsequently, the adhesive layer 22 in the adhesive area D1 positioned on the distal end and the adhesive layer 22 in the adhesive area D4 are bonded together while aligning the positions of the two adhesive layers 22 in the tape width direction (also known as butt-sealing). At this time, the length of the release material layer 24 in the tape length direction is at least the circumference 2πr of the cable 302. As a result, the print label L is rotatably attached to the cable 302 by wrapping the release material layer 24 in the adhesive-variable area D23 (i.e., the cut-out area AR) once around the cable 302 so that the print label is in a non-adhering state, while bonding the two adhesive layers 22 together to fix the shape of the print label L itself. Hence, by leaving a portion of the release material layer 24, i.e., the cut-out area AR, on the main label part Lo side when the release material layer 24 is peeled off as described above, the adhesive layer 22 of the print label L can be suppressed from bonding to the cable 302.

Thereafter, the remaining portion of the adhesive area D4 that has not been used in the structure encircling the cable 302 is wrapped in the direction of the arrow G indicated in FIG. 9B so that the bonded portion of the adhesive area D1 and adhesive area D4 are on the inside (for example, the adhesive area D1 is folded back as indicated by an arrow Z and comes in contact with a region Y). At this time, the print label L in the adhesive area D4 is wrapped around the outer circumferential portion of the adhesive-variable area D23 while covering the adhesive-variable area D23 constituting the cylinder (see FIG. 9C). Thus, by using the adhesive property of the adhesive layer 22 to fix the adhesive area D4 to the outer circumferential portion of the adhesive-variable area D23, the procedure for attaching the print label L to the cable 302 is complete.

<Use as a Fixed Label>

Next, a case for using the print label L as a fixed label will be described with reference to FIGS. 10A through 12C. Irrespective of whether the label will be a rotating label or a fixed label, first the label-creating device 1 Bonus a printed image R on the main label part Lo affixed to the release material layer 24 of the printing tape To, creating a printed print label L (Step 1). Subsequently, the print label L is peeled off the printing tape T while peeling away from the release material layer 24 that includes the cut-out area AR, as shown in FIGS. 10A through 11B. As shown in FIGS. 9A through 9C, the print label L can be used as a fixed label by wrapping the print label L around the cable 302 with the adhesive area of the exposed adhesive layer 22 in contact with the cable 302 constituting the object (Step 2A). Note that the excess label portion LB is preferably peeled off the printing tape T prior to the print label L being peeled off the printing tape T.

(1) Method of Peeling Off a Print Label to Be Used as a Fixed Label

Figure 10A:
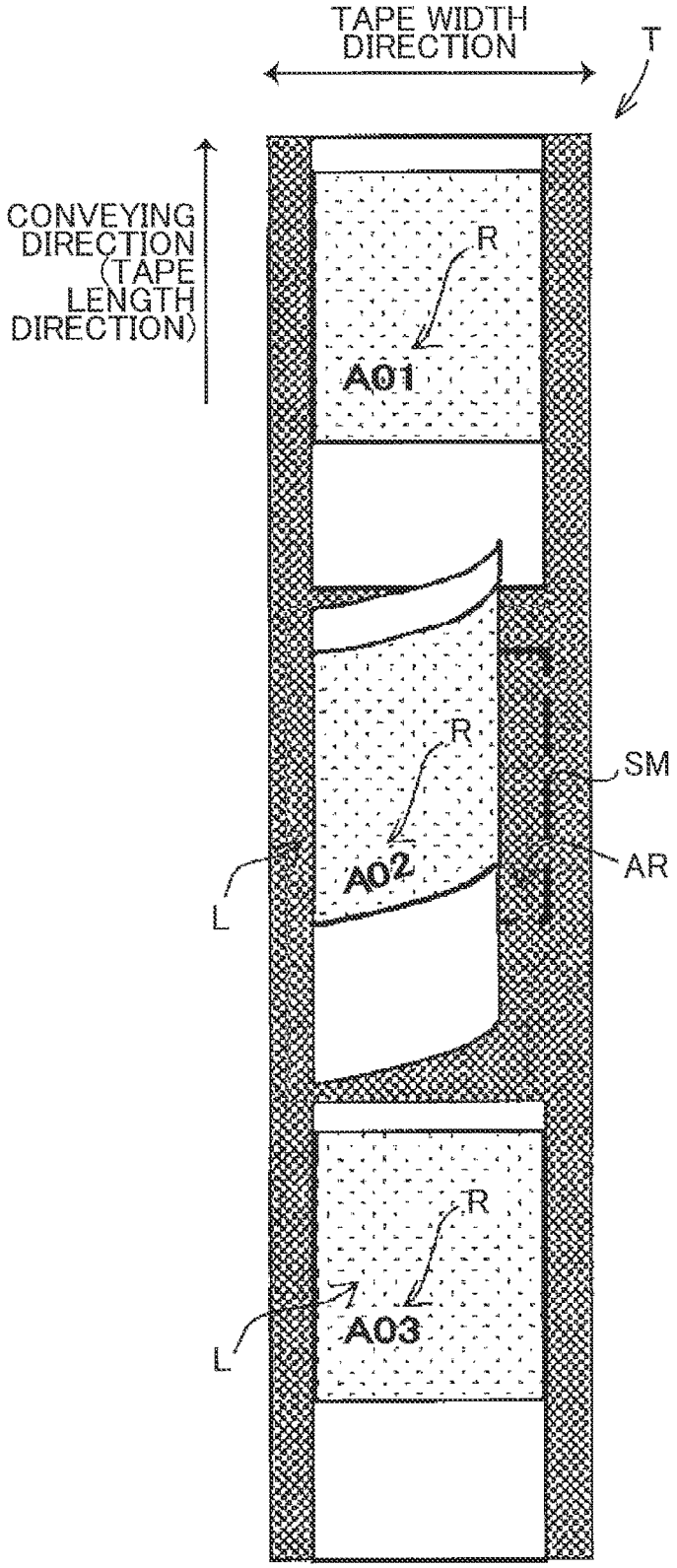
Figure 10B:
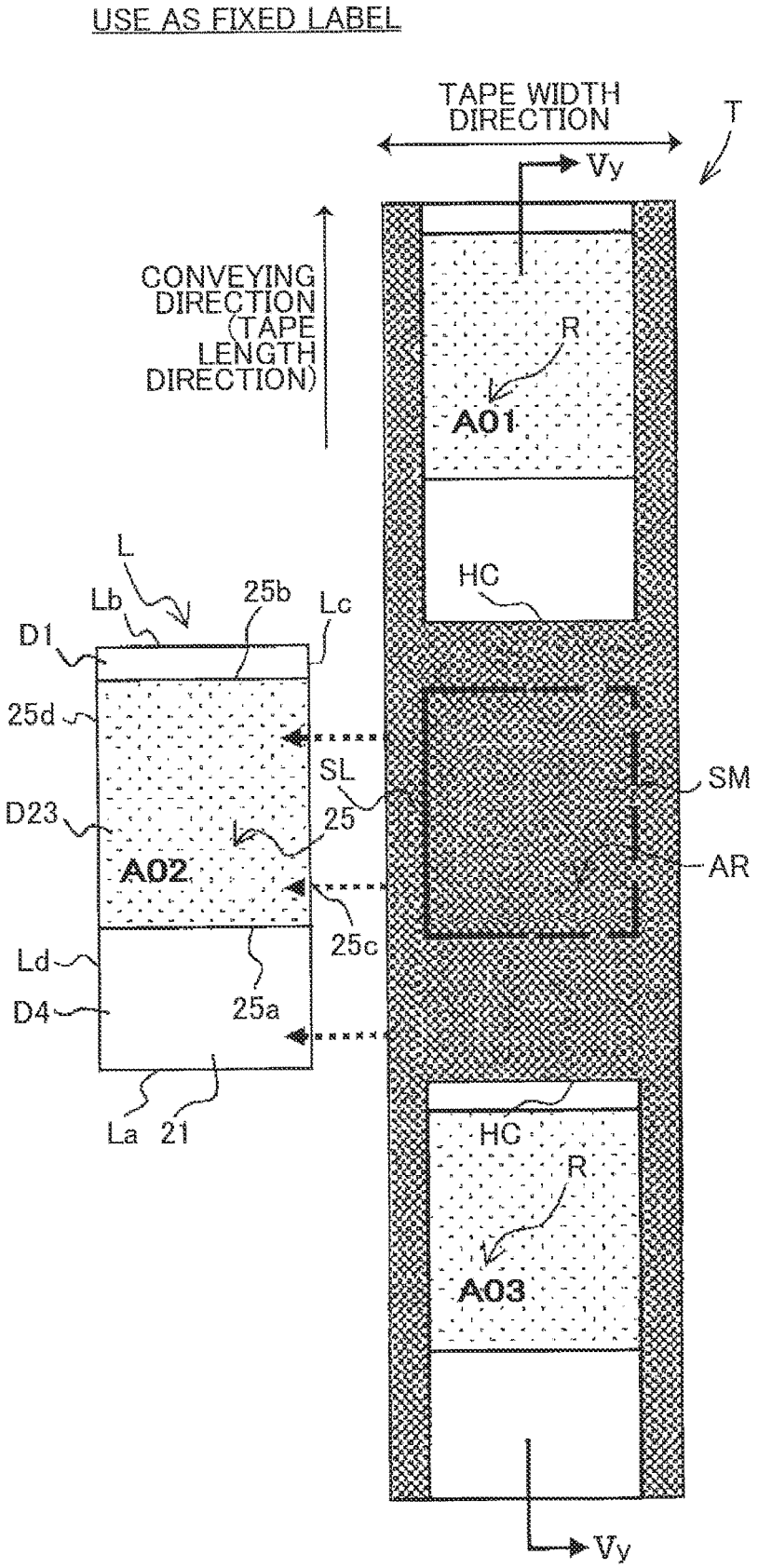
Figure 10C:
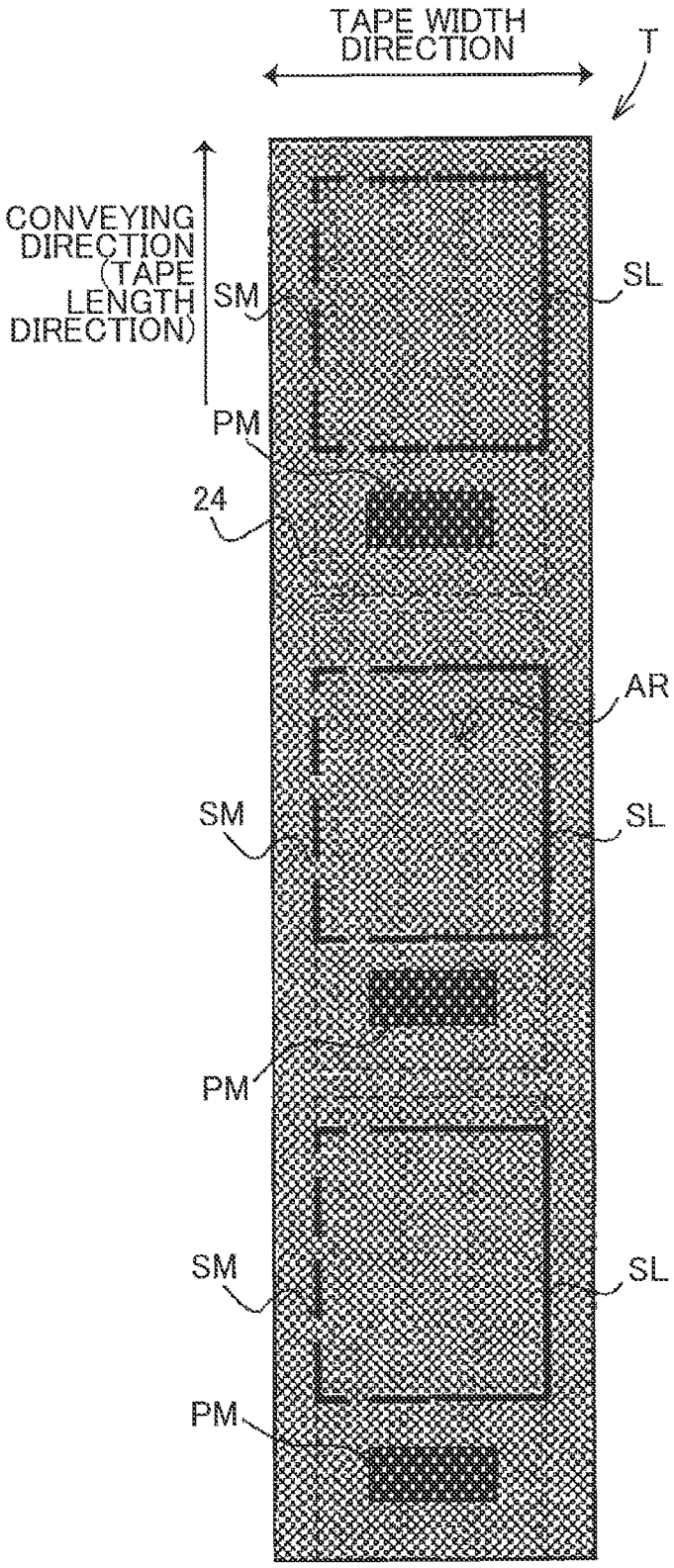
Figure 10D:
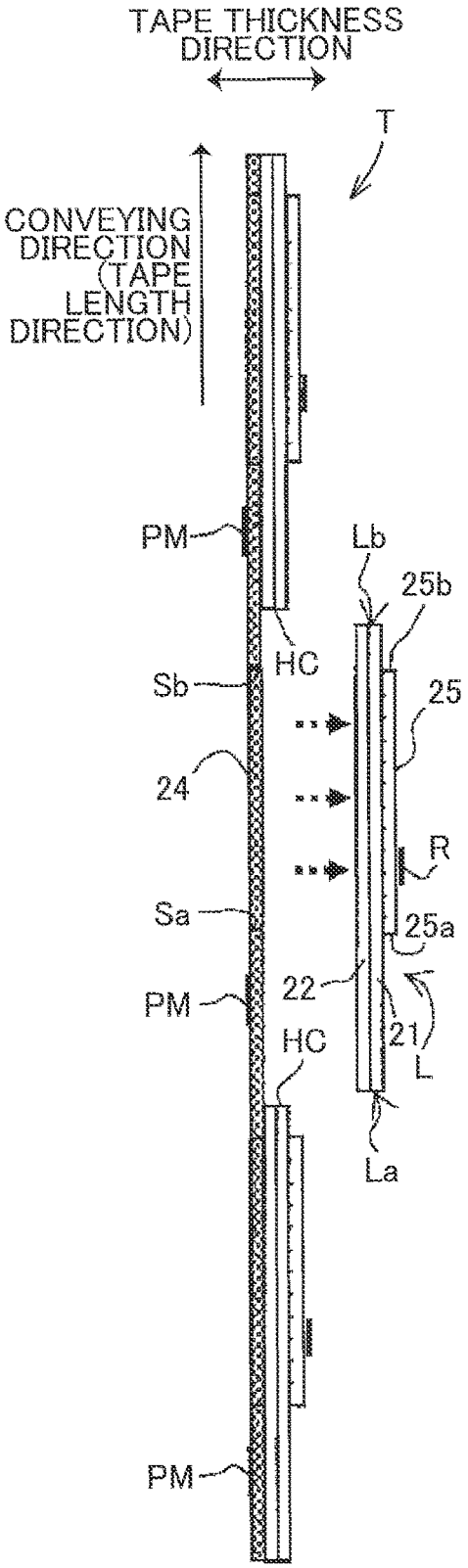

The method of peeling off a print label L that is to be used as a fixed label will be described with more specifics. When the print label L is to be used as a fixed label, the user peels off the print label L from the right side in the drawing (the perforation SM side; the second side), as shown in FIG. 10A. When the print label L is peeled from the perforation SM side in this way, the cut-out area AR does not separate from but remains with the surrounding release material layer 24, as illustrated in FIGS. 10A and 10B. As described above, the first side of the break line S is configured of a slit SL and the second side of the break line S is configured of a perforation SM. Hence, when the print label L is peeled away from the second side, the cut-out area AR is maintained in a state fixed to the surrounding release material layer 24 owing to the perforation SM as the print label L begins peeling away from the printing tape T. That is, as a force is applied to the print label L for peeling the print label L from the second side toward the first side, the force for fixing the cut-out area AR to the area of the release material layer 24 outside the cut-out area AR is greater than the adhesive force between the print label L and cut-out area AR. Accordingly, as the print label L is separated from the printing tape T as shown in FIG. 10B, the perforation SM does not break and the print label L separates from the cut-out area AR, as shown in FIGS. 10C and 10D. In this state, the print label L has an adhesive property in the adhesive-variable area D23 owing to the adhesive layer 22.

(2) Structure of a Print Label to Be Used as a Fixed Label

Next, the structure of the print label L generated according to the above method will be described with reference to FIGS. 11A and 11B. FIG. 11A shows a plan view of a single print label L produced according to the above method of separation, and FIG. 11B shows a cross-sectional view taken along the section VIy-VIy in FIG. 11A.

As with the printing tape T described previously, the print label L in FIGS. 11A and 11B has the transparent base material layer 21, adhesive layer 22, and release material layer 24 that are layered in this order along the thickness direction (the depth direction in FIG. 11A and the left-right direction in FIG. 11B) from the left side to the right side in FIG. 11B. The print background layer 25 having the printed image R is partially provided on the second-side surface of the base material layer 21 relative to the thickness direction. The print label L is provided with the adhesive area D1, the adhesive-variable area D23, and the adhesive area D4 from the second side (top side in the drawing) toward the first side (bottom side in the drawing) of the tape length direction (up-down direction in the drawing).

Figure 11B:
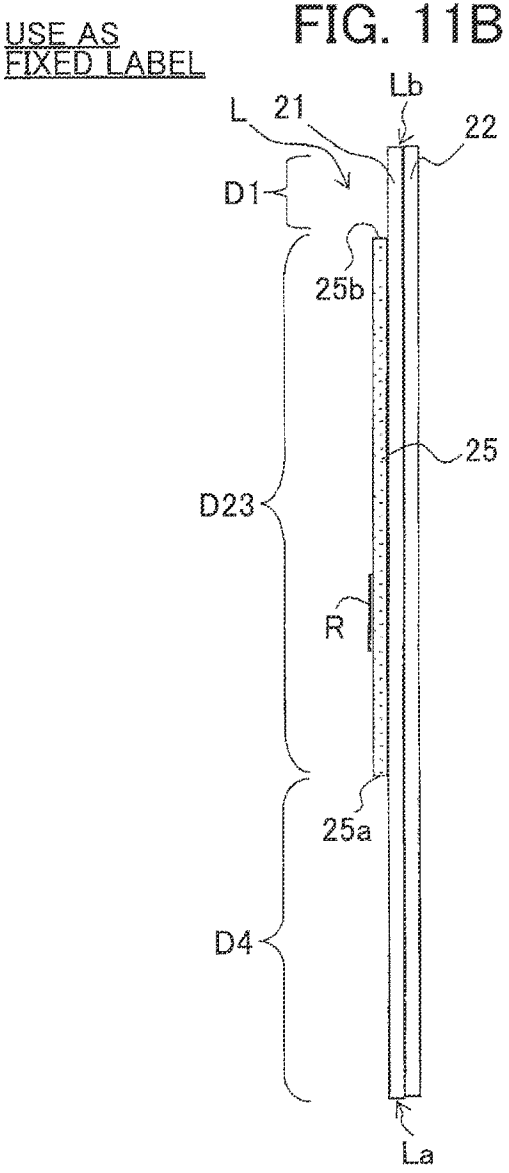
Figure 11A:
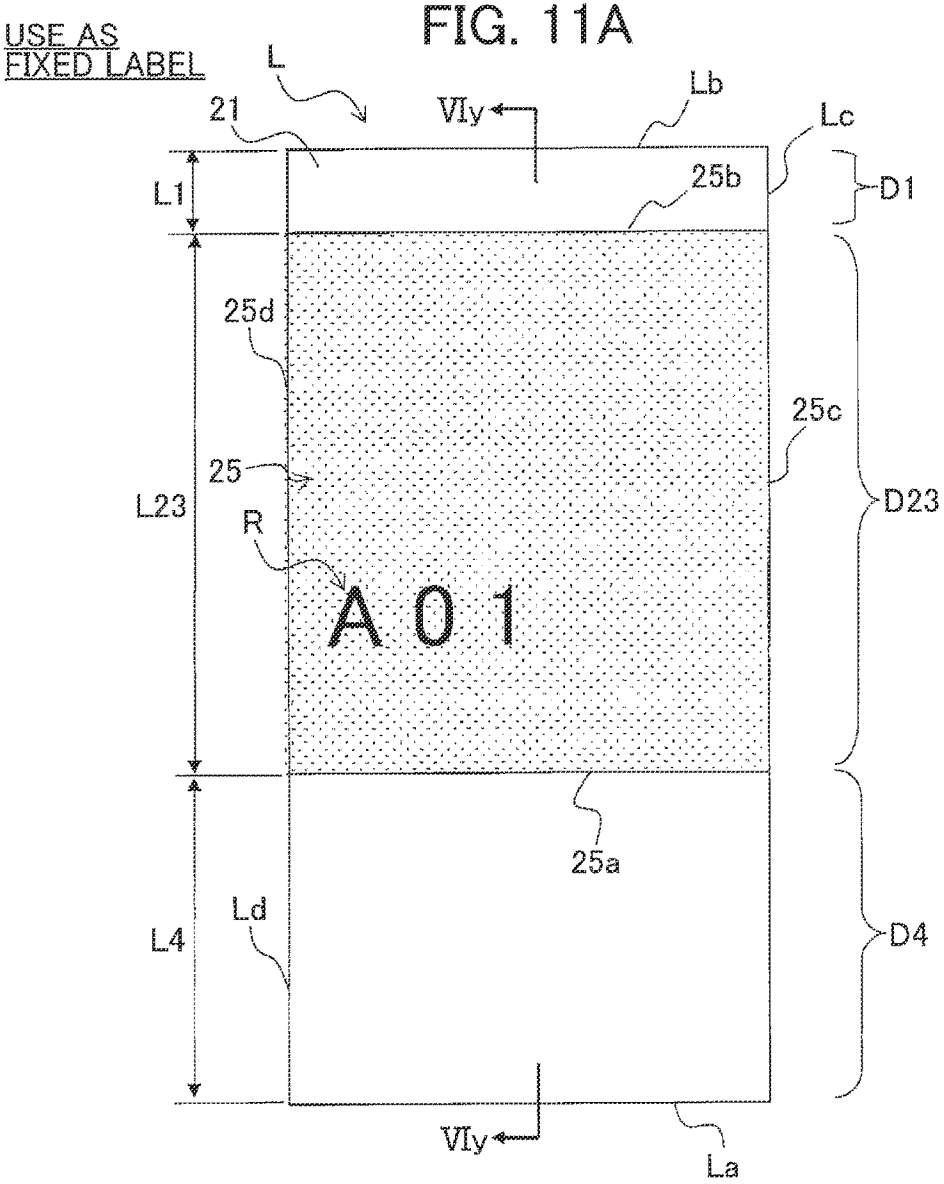

As described above, the release material layer 24 corresponding to the cut-out area AR is no longer stuck to the back surface (the right side in FIG. 11(*b*)) of the adhesive-variable area D23, unlike when the print label L is to be used as a rotating label, leaving the adhesive layer 22 exposed. Therefore, only the base material layer 21 and adhesive layer 22 are layered in order from the second side toward the first side of the thickness direction (from the left side toward the right side in FIG. 11B) in the adhesive area D1, adhesive-variable area D23, and adhesive area D4, except that the print background layer 25 is also layered in the adhesive-variable area D23. Thus, the entirety of the adhesive area D1, adhesive-variable area D23, and adhesive area D4 are provided with an adhesive property owing to the adhesive layer 22. Note that the adhesive area D1, adhesive-variable area D23, and adhesive area D4 are respectively provided with lengths L1, L23, and L4 in the tape width direction.

Figure 12A:
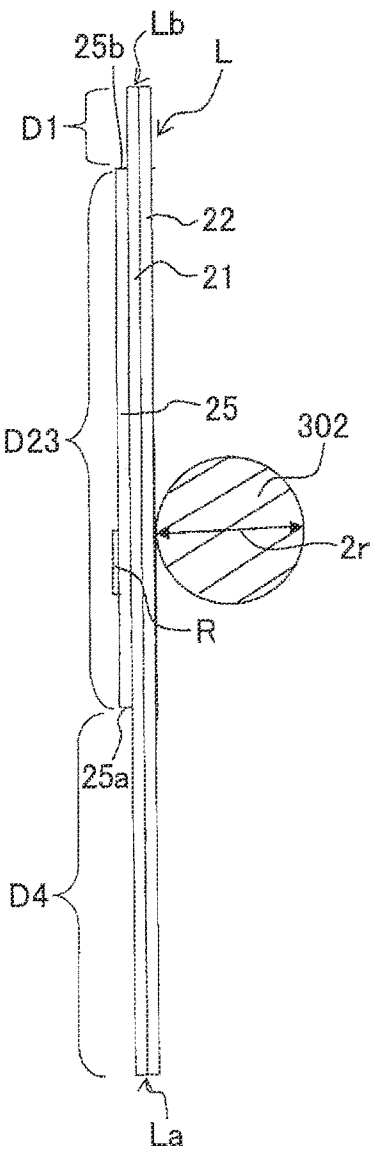
Figure 12B:
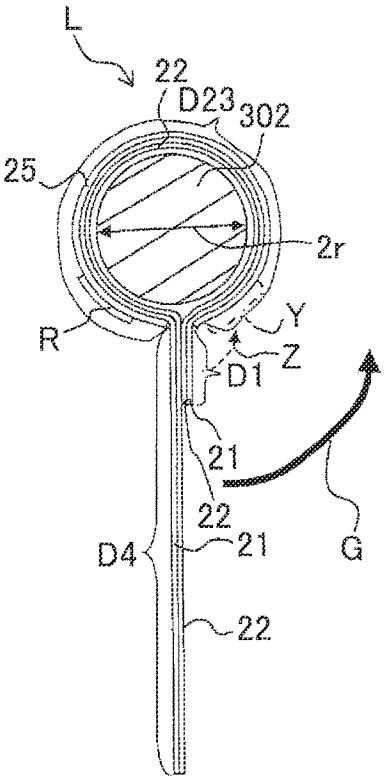
Figure 12C:
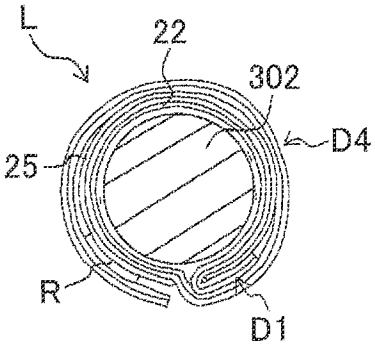

(3) Procedure for Attaching a Print Label to Be Used as a Fixed Label to an Object FIGS. 12A through 12C show a sample procedure for attaching the print label L described above to an object. As with FIGS. 9A through 9C, FIGS. 12A through 12C also show an example of attaching the print label L by wrapping the print label L around the cable 302.

As shown in FIG. 12A, the print label L has areas extending continuously in the order: adhesive area D1→adhesive-variable area D23→adhesive area D4. (In other words, the entire adhesive layer 22 in the print label L is exposed since the adhesive layer 22 is not covered by the release material layer 24.) First, the adhesive area D1 and adhesive-variable area D23 of the print label L are bent into a concave shape (not shown) so that the release material layer 24 side (the right side in FIG. 12A) is on the inside.

Next, the cable 302 is placed on the inside of the concave-shaped print label L, and the print label L is wrapped once around the cable 302 to form a cylinder encircling the cable 302 in a loop shape, as shown in FIG. 12B. Subsequently, the adhesive layer 22 in the adhesive area D1 positioned on the distal end and the adhesive layer 22 in the adhesive area D4 are bonded together while aligning the positions of the two adhesive layers 22 in the tape width direction (also known as butt-sealing). As a result, the print label L is fixedly attached to the cable 302 by wrapping the adhesive layer 22 in the adhesive-variable area D23 once around the cable 302 so that the print label L is in an adhering state, while bonding the two adhesive layers 22 together to fix the shape of the print label L itself.

Thereafter, the remaining portion of the adhesive area D4 that has not been used in the structure encircling the cable 302 is wrapped in the direction of the arrow G indicated in FIG. 12B so that the bonded portion of the adhesive area D1 and adhesive area D4 are on the inside (for example, the adhesive area D1 is folded back as indicated by an arrow Z and comes in contact with a region Y). At this time, the print label L in the adhesive area D4 is wrapped around the outer circumferential portion of the adhesive-variable area D23 while covering the adhesive$_{\tau}$ variable area D23 constituting the cylinder (see FIG. 12C). Thus, by using the adhesive property of the adhesive layer 22 to fix the print label L in the adhesive area D4 to the outer circumferential portion of the adhesive-variable area D23, the procedure for attaching the print label L to the cable 302 is complete.

<Sample Effects of the First Embodiment>

As described above in the present embodiment, the cut-out area AR is provided in the release material layer 24, and the printing label, i.e., the main label part Lo or the print label L on which the printed image R is formed, is fixed to the release material layer 24 so as to extend across the first and second sides of the corresponding cut-out area AR, as illustrated in FIGS. 2A through 2F. The cut-out area AR is enclosed by a slit SL and perforation SM.

If a continuous break line is formed owing to the slit SL when the printing label is peeled off the release material layer 24, the cut-out area AR is peeled off the release material layer 24 together with the printing label. If a continuous break line is not formed due to the perforation SM when the printing label is peeled off the release material layer 24, the cut-out area AR remains on the release material layer 24 side while only the printing label is peeled away from the release material layer 24. Since the first side and second side differ in the type of slit SL and perforation SM, the behavior or aspects of the first side and second side related to the formation of a continuous break line differ even if the same force is applied.

When the printing label is peeled from a side on which a continuous break line is easy to form or is already formed (hereinafter called the "easy-to-break side") toward a side in which a continuous break line is difficult to form (hereinafter called the "hard-to-break side"), i.e., when the printing label is peeled from the first side toward the second side, a continuous break line is formed on the easy-to-break side during the initial stage of peeling. Consequently, the cut-out area AR continues to be torn out from that point and a continuous break line is formed on the hard-to-break side in the final stage of peeling, ultimately enabling the printing label and cut-out area AR to be peeled together from the release material layer 24. Accordingly, when a printing label with these integrated layers is wrapped around an object, the cut-out area AR contacts the object, enabling the label to be used as a rotating label that is rotatable relative to the object.

On the other hand, if the printing label is peeled off from the hard-to-break side toward the easy-to-break side, i.e., when the printing label is peeled from the second side toward the first side, a continuous break line is not formed on the hard-to-break side during the initial stage of peeling. Hence, since peeling advances without the cut-out area AR beginning to tear, ultimately, unlike the case described above, only the printing label is peeled off the release material layer 24 while the cut-out area AR remains on the release material layer 24 side. Accordingly, when the printing label is wrapped around an object, an adhesive surface exposed by the peeling contacts the object, enabling the label to be used as a fixed label that does not rotate relative to the object.

Alternatively, when looking at forces that are applied to the printing label, the effects of the present embodiment can be rephrased as follows. That is, when peeling a printing label from the first side toward the second side, a force fixing the cut-out area AR to the surrounding region and acting to keep the cut-out area AR on the release material layer 24 side is smaller than the adhesive force applied by the printing label to the cut-out area AR. Accordingly, a continuous break line is formed on the first side in the initial stage of peeling, and the cut-out area AR begins to tear from there, with the cut-out area AR ultimately being peeled off the release material layer 24 together with the printing label. Hence, as described above, by wrapping the printing label around an object with the cut-out area AR contacting the object, the label can be used as a rotating label that is rotatable relative to the object.

On the other hand, when the printing label is peeled from the second side toward the first side, the force fixing the cut-out area AR to the surrounding region and acting to keep the cut-out area AR on the release material layer 24 side is greater than the adhesive force that the printing label applies to the cut-out area AR. Accordingly, a continuous break line is not formed on the second side in the initial stage of peeling and peeling progresses without the cut-out area AR beginning to tear. Thus, the printing label alone is ultimately peeled off the release material layer 24 while the cut-out area AR remains on the release material layer 24 side. Therefore, as described above, by wrapping the printing label around an object with the exposed adhesive surface contacting the object, the label can be used as a fixed label that does not rotate relative to the object.

Through the above configuration, the user can use a printing label as either a rotating label or a fixed label simply by deciding whether to peel the label from the first side or the second side.

Since the first side of the cut-out area AR is formed by a slit SL and the second side of the cut-out area AR is formed by a perforation SM in the present embodiment, the total length of the cuts or holes is greater in the first side than in the second side. Therefore, the first side is easier to break than the second side, and the second side is harder to break than the first side.

In the present embodiment, the adhesive area D1 and adhesive area D4 in the printing label are transparent. The adhesive area D1 and adhesive area D4 may also be semitransparent. Therefore, when the printing label is wrapped around the object as a fixed label with a portion of the printing label other than the portion in which the printed image R is printed being wrapped around the outer circumference of the portion in which the printed image R is printed, the printed image R can be seen through the transparent or semitransparent portion.

In the present embodiment, the adhesive force between the printing label and the cut-out area AR is between 0.01 N/20 mm and 2 N/20 mm With this configuration, a printing label can be used as either a rotating label or a fixed label simply by deciding whether to peel the printing label from the first side or the second side while peeling the printing label at an angle of 180 degrees, for example.

First Variation of the First Embodiment

In the first embodiment described above, the break line S is configured of a slit SL (the first side) positioned on a first side of the tape width direction (the right side of the tape width direction in FIG. 2D) and formed along the tape length direction, and a perforation SM (the second side) positioned on a second side of the tape width direction (the left side of the tape width direction in FIG. 2D) and formed along the tape length direction. With this configuration, the print label L can be used as a rotating label when the print label L is peeled from the first side of the tape width direction and can be used as a fixed label when the print label L is peeled from the second side of the tape width direction. However, the positional relationship of these slit SL and perforation SM is not limited to this example.

FIGS. 13A through 13F show a first variation that modifies the positional relationship of the slit SL and perforation SM in the break line S. Content in this variation that is identical or similar to that in the first embodiment will be omitted from the following description and primarily points of difference will be described.

FIG. 13D is a rear view of the printing tape T showing the break line S according to this variation and is equivalent to FIG. 2D. As shown in FIG. 13D, the break line S according to this variation is configured of a slit SL and a perforation SM that oppose each other in the tape length direction rather than the tape width direction. In other words, the slit SL of the break line S is positioned on the top side of the tape length direction in FIG. 13D and is formed along the tape width direction, while the perforation SM is positioned on the bottom side of the tape length direction in FIG. 13D and is formed along the tape width direction. In this variation, the side formed along the tape width direction and positioned on the top side of the tape length direction, i.e., the side configured by the slit SL, will be the first side, while the side formed along the tape width direction and positioned on the bottom side of the tape length direction, i.e., the side configured by the perforation SM will be the second side.

FIG. 13C is a rear view of the printing tape T when the print label L has been peeled off as a rotating label. FIG. 13B is a cross-sectional view taken along the section VIIy-VIIy in FIG. 13C after the print label L has been separated from the same printing tape T. FIG. 13A schematically shows a plan view of the print label L after separation. With the break line S according to the present variation, if the print label L is peeled off the printing tape T from the slit SL side, i.e., from the top side toward the bottom side of the tape length direction in FIG. 13D, then just like in the first embodiment the print label L separates from the printing tape T with the release material layer 24 of the cut-out area AR stuck to the adhesive layer 22, as illustrated in FIGS. 13A through 13C. Thus, the print label L can be used as a rotating label.

The rear view of a printing tape T when the print label L has been separated as a fixed label is identical to FIG. 13D. FIG. 13E is a cross-sectional view of the same printing tape T and the print label L after separation taken along the section VIIIy-VIIIy in FIG. 13D, and FIG. 13F schematically shows a plan view of the print label L after separation. With the break line S according to this variation, if the print label L is peeled from the perforation SM side, i.e., from the bottom side toward the top side in the tape length direction in FIG. 13D, just as in the first embodiment the print label L separates from the printing tape T while the release material layer 24 included in the cut-out area AR remains on the printing tape T, leaving the entire back surface of the adhesive layer 22 exposed, as shown in FIGS. 13D through 13F. Thus, the print label L can be used as a fixed label.

It should be obvious in the first embodiment and the first variation that the positions of the slit SL and perforation SM indicated in FIG. 2D or FIG. 13D may be reversed. However, in this case the left side of the tape width direction in FIG. 2D constituting the slit SL becomes the first side, and the right side of the tape width direction in FIG. 2D constituting the perforation SM becomes the second side.

Second Variation of the First Embodiment

The first embodiment and the first variation describe the structure of the break line S as being provided with the slit SL and perforation SM on corresponding first and second sides that oppose each other. However, the first and second sides that oppose each other are not limited to the above examples. Various structures are possible provided that the holes or cuts or series of holes or series of cuts in the first side have a total length greater than the total length of the holes or cuts or series of holes or series of cuts in the second side in order that the first side can function as the easy-to-break side and the second side can function as the hard-to-break side.

Figure 14:
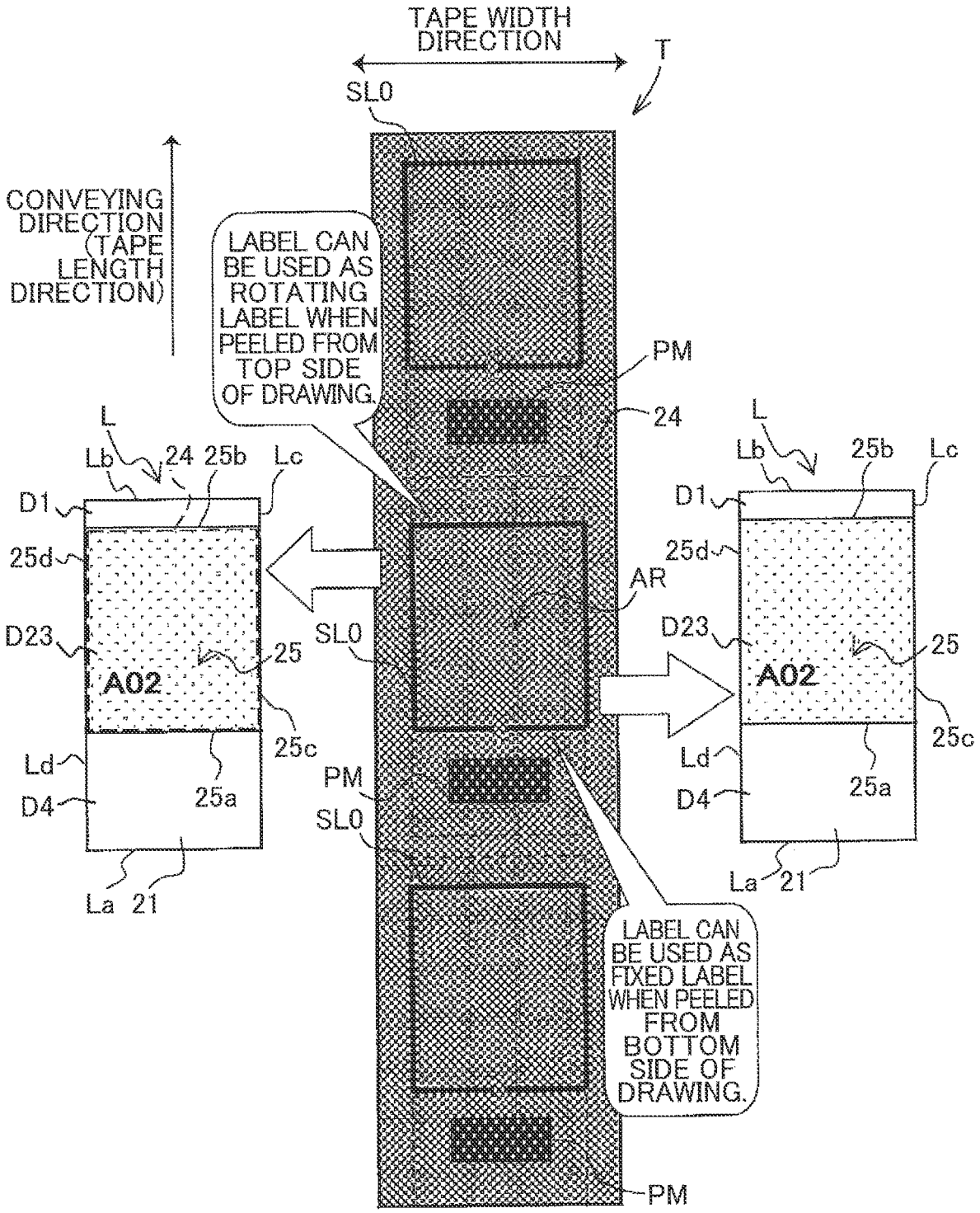
FIG. 14 is a schematic diagram showing a printing tape according to a second variation of the first embodiment of the present disclosure.

FIG. 14 shows a second variation in which the break line S is formed with a different structure. Content in this variation that is identical or similar to that in the first embodiment or first variation will be omitted from the following description and primarily points of difference will be described.

A rear view of the printing tape T according to the present variation is schematically shown in the left-right center of FIG. 14. Rather than a combination of the slit SL and perforation SM, the break line S according to this variation is configured of a slit SL0 formed by a notch in a part of one side. In this variation, the top side in the tape length direction of the break line S shown in FIG. 14 will be the first side, the bottom side in the tape length direction of the break line S shown in FIG. 14 will be the second side, the left side in the tape width direction of the break line S shown in FIG. 14 will be the third side, and the right side in the tape width direction of the break line S shown in FIG. 14 will be the fourth side. The slit SL0 constituting the break line S is formed of a single rectangular slit through the entire first side, the entire third side, the entire fourth side, and the second side excluding a connecting part in the center region of the tape width direction. Consequently, the slit length in the first side is greater than the slit length in the second side by the width of the connecting part.

With the break line S according to the present variation, the print label L can be used as a rotating label when the print label L is peeled off from the top side toward the bottom side of the tape length direction, as illustrated in the left side of FIG. 14. As in the first embodiment, the print label L is separated from the printing tape T while the release material layer 24 in the cut-out area AR remains stuck to the adhesive layer 22. On the other hand, the print label L can be used as a fixed label when the print label L is peeled off from the bottom side toward the top side of the tape length direction, as shown in the right side of FIG. 14. The connecting part on the second side acts to prevent the cut-out area AR from separating from the surrounding release material layer 24, and the print label L separates from the printing tape T while the release material layer 24 including that in the cut-out area AR remains on the printing tape T, leaving the entire back surface of the adhesive layer 22 exposed, as in the first embodiment. Naturally, the connecting part formed between the ends of the slit SL0 may be formed in the top side rather than in the bottom side of the tape length direction or may be formed in one of the left side or right side of the tape width direction. In such cases, the side in which the connecting part is formed constitutes the second side while the opposing side constitutes the first side.

Third Variation of the First Embodiment

The first embodiment, first variation, and second variation describe cases in which the break line S is configured of the slits SL, SL0, or the perforation SM that penetrate the release material layer 24. However, the holes or cuts or series of holes or series of cuts constituting the break line S are not limited to this example. For example, cuts may be formed in the release material layer 24 so as not to penetrate the release material layer 24. When the holes or cuts or series of holes or series of cuts are configured of such cuts, various configurations are possible, provided that the depth of the holes or cuts or series of holes or series of cuts in the first side is greater than the depth of holes or cuts or series of holes or series of cuts in the second side so that the first side functions as the easy-to-break side and the second side functions as the hard-to-break side.

Figure 15:
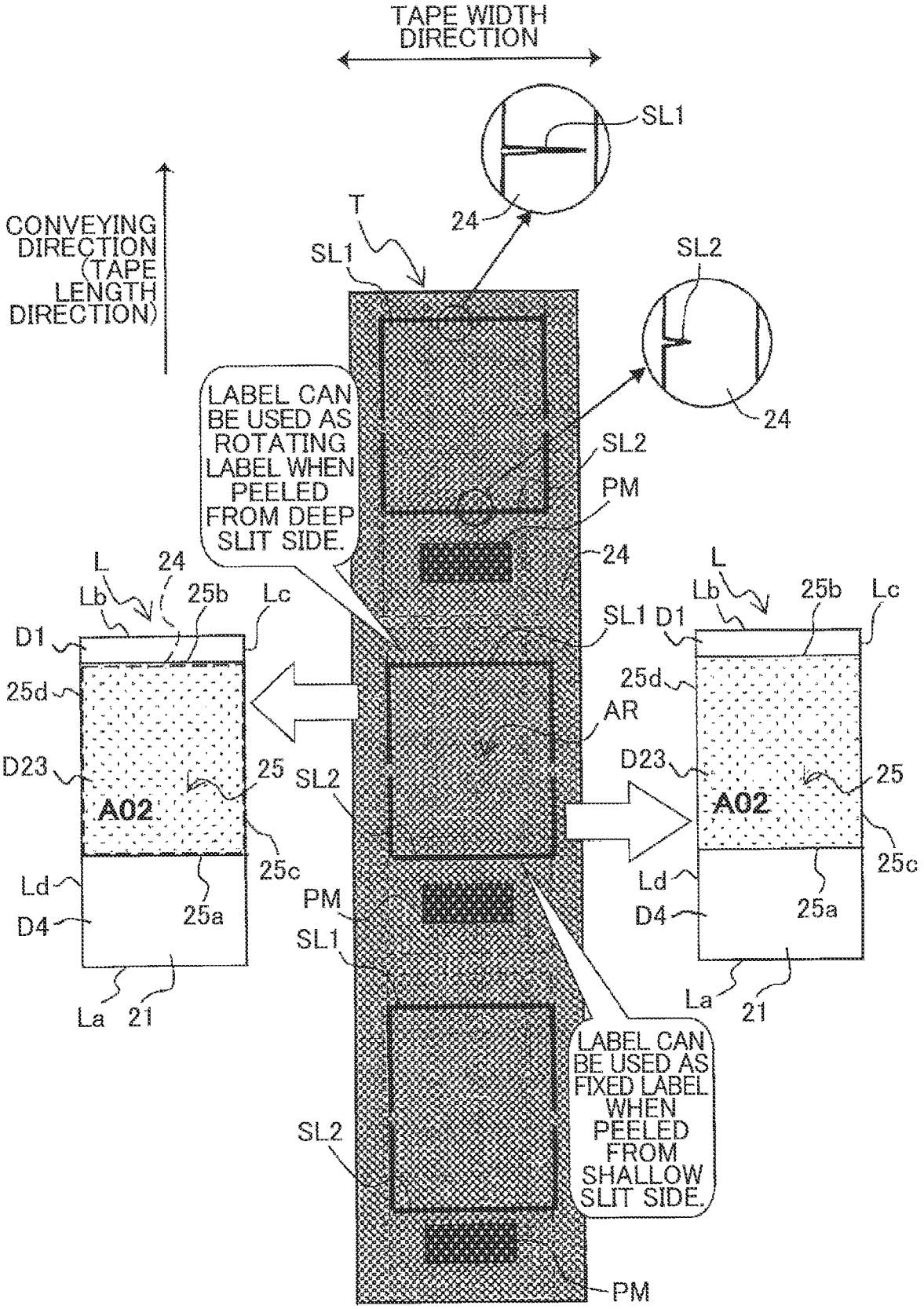
FIG. 15 is a schematic diagram showing a printing tape according to a third variation of the first embodiment of the present disclosure.

FIG. 15 shows an example of the third variation in which the break line S is formed of slits SL1 and SL2, which are cuts. Content in this variation that is identical or similar to that in the first embodiment, the first variation, or the second variation will be omitted from the following description and primarily points of difference will be described.

A rear view of the printing tape T according to the present variation is schematically shown in the left-right center of FIG. 15. Rather than the penetrating slit SL and perforation SM, the break line S according to this variation is configured of slits SL1 and SL2, which are cuts of differing depths. In this variation, the top side in the tape length direction of the break line S shown in FIG. 15 will be the first side, the bottom side in the tape length direction of the break line S shown in FIG. 15 will be the second side, the left side in the tape width direction of the break line S shown in FIG. 15 will be the third side, and the right side in the tape width direction of the break line S shown in FIG. 15 will be the fourth side. The slit SL1 is configured of a deeper cut than the slit SL2 and is formed in the entire first side and parts of the third and fourth sides above the center in the tape length direction (hereinafter the slit SL1 will also be called the "deep slit"). The slit SL2 on the other hand is configured of a shallower cut than the slit SL1 and is formed in the entire second side and parts of the third and fourth sides below the center in the tape length direction (hereinafter the slit SL2 will also be called the "shallow slit").

With the break line S according to the present variation, the print label L can be used as a rotating label when the print label L is peeled from the deep slit SL1 side, i.e., from the top side to the bottom side in the tape length direction, as illustrated in the left side of FIG. 15. The slit SL1 is broken by the force with which the cut-out area AR is bonded to the print label L, and the print label L is separated from the printing tape T while the release material layer 24 in the cut-out area AR remains stuck to the adhesive layer 22, as in the first embodiment. On the other hand, the print label L can be used as a fixed label when peeled off from the shallow slit SL2 side, i.e., from the bottom side toward the top side in the tape length direction, as illustrated in the right side of FIG. 15. The slit SL2 is not broken by the force with which the cut-out area AR is adhered to the print label L, and the print label L separates from the printing tape T while the release material layer 24 including that in the cut-out area AR remains on the printing tape T, leaving the entire back surface of the adhesive layer 22 exposed, as in the first embodiment. As in the first embodiment and first variation, the positions of the deep slit SL1 and shallow slit SL2 are not particularly limited, provided that they are opposite one another. The deep slit SL1 may be formed in the first side and the shallow slit SL2 may be formed in the opposing second side. Naturally, perforations or the like with modified depths of cut may be used in suitable combinations.

Fourth Variation of the First Embodiment

Figure 16A:
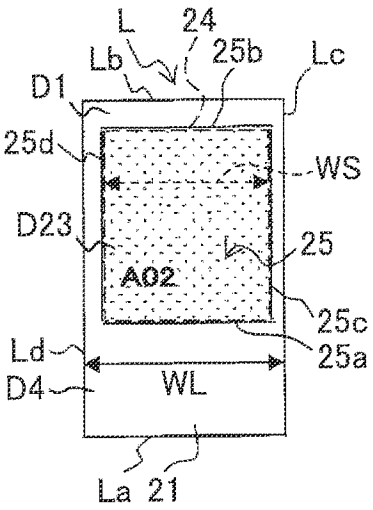
Figure 16B:
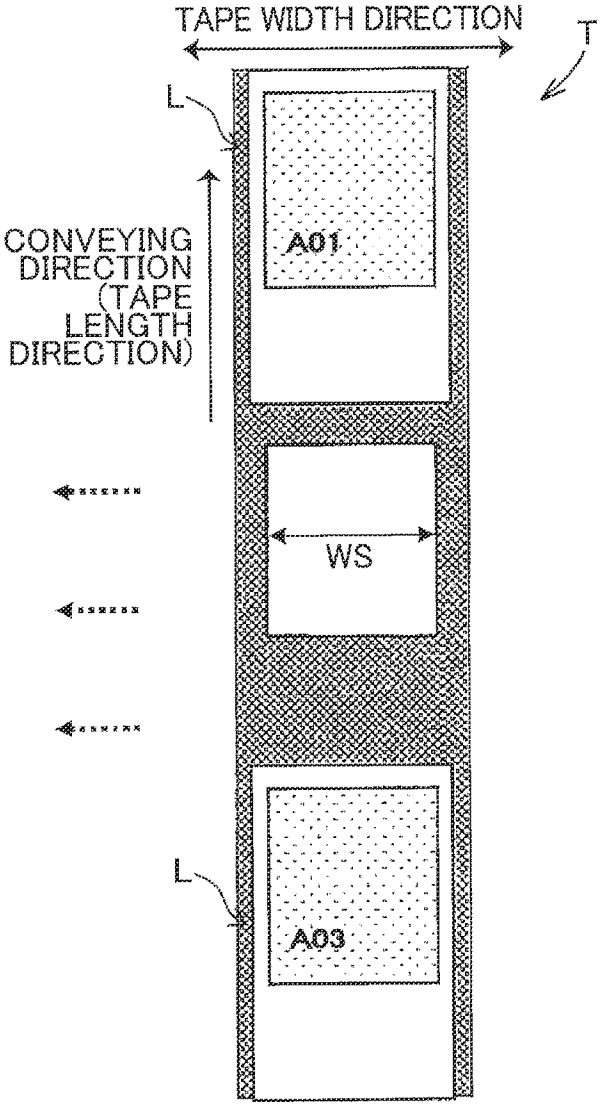
Figure 16C:
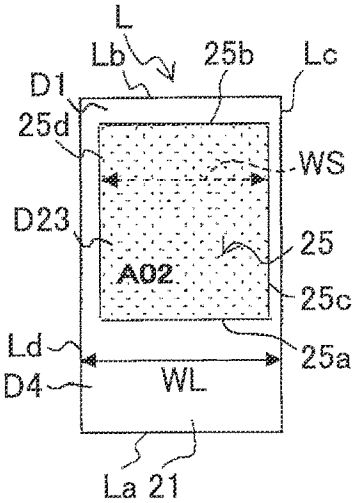
Figure 17A:
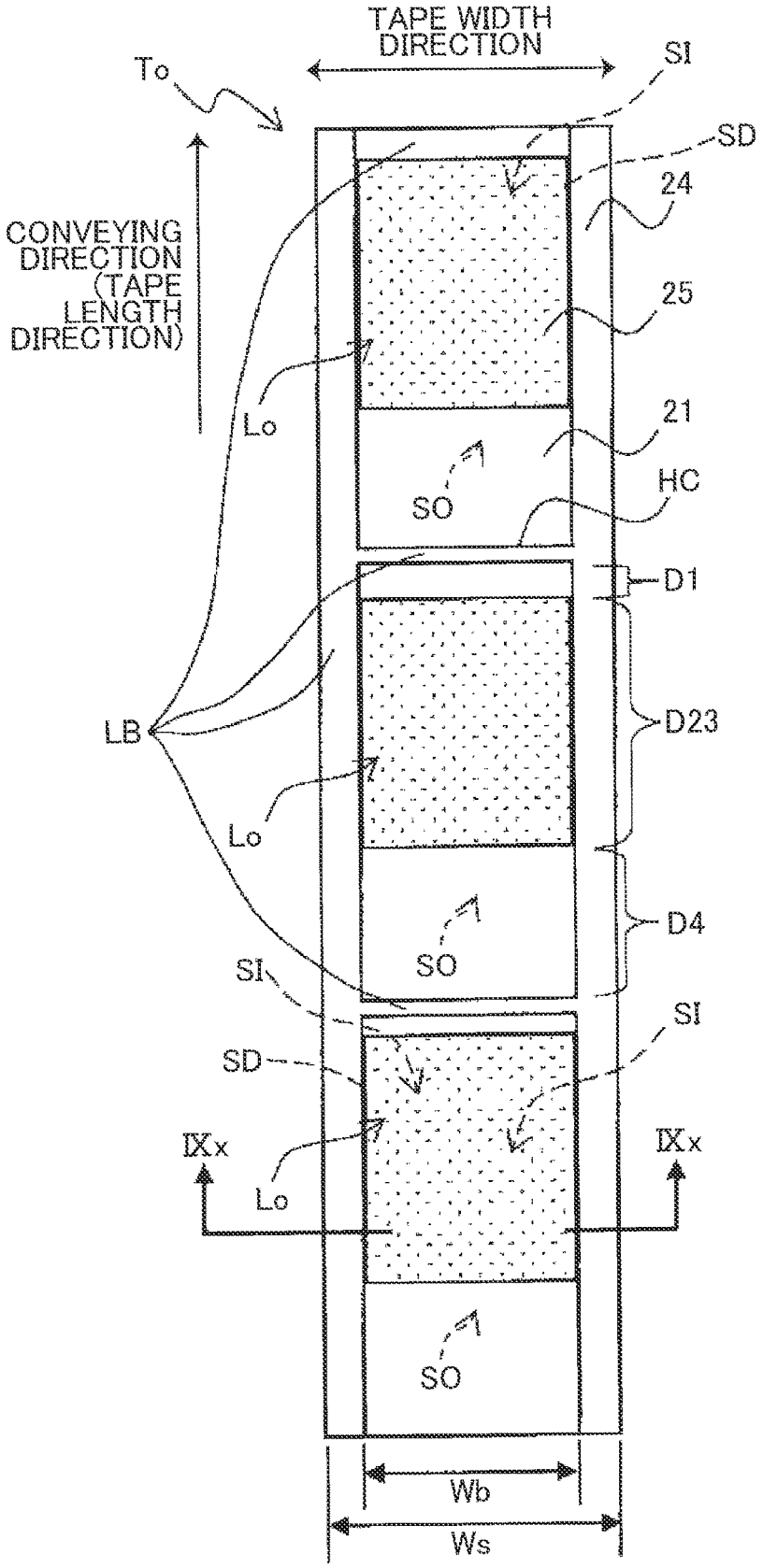
Figure 17B:
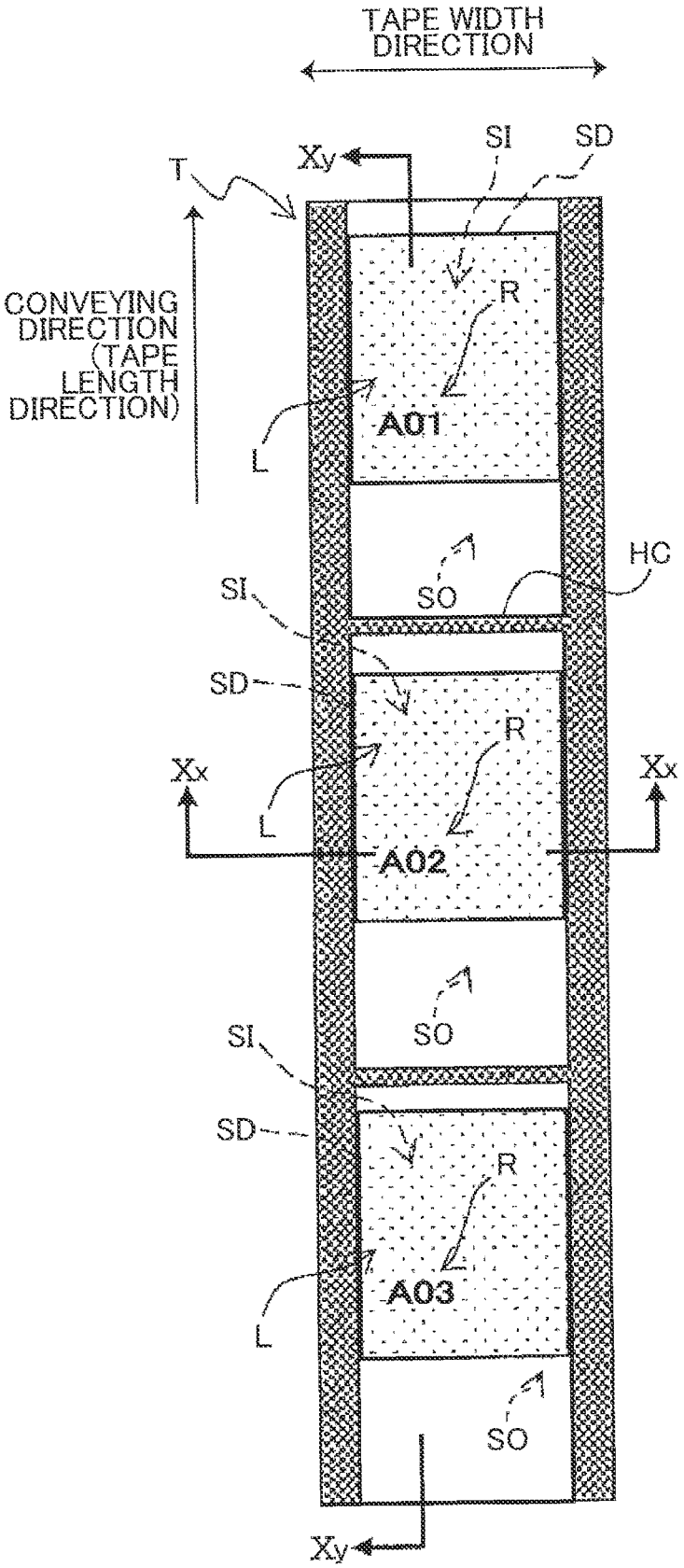
Figure 17C:
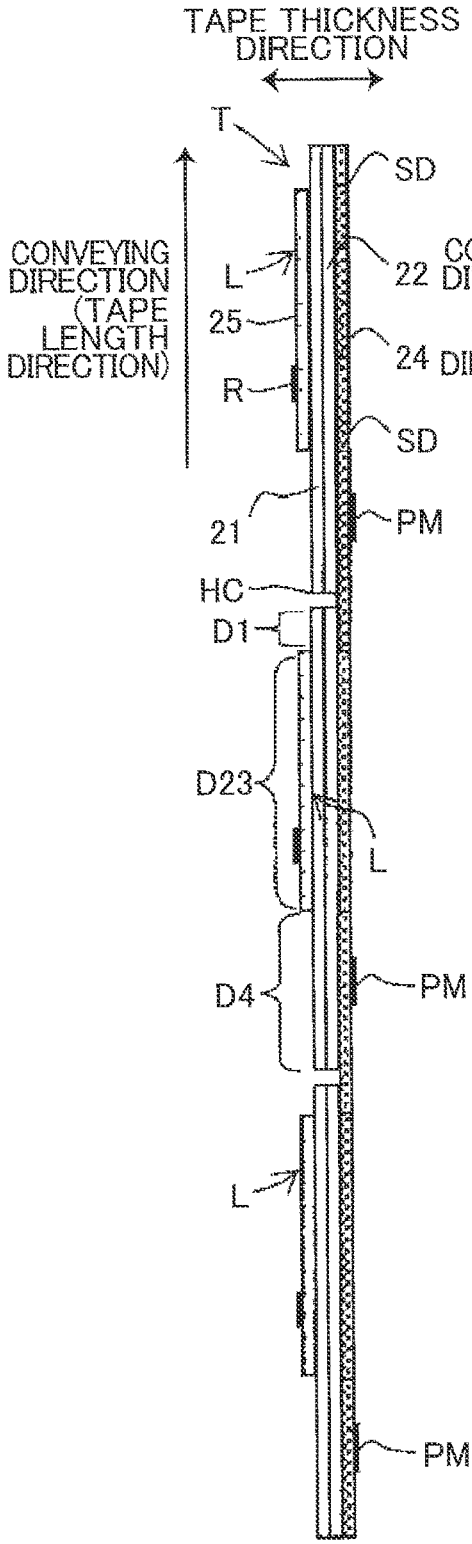
Figure 17D:
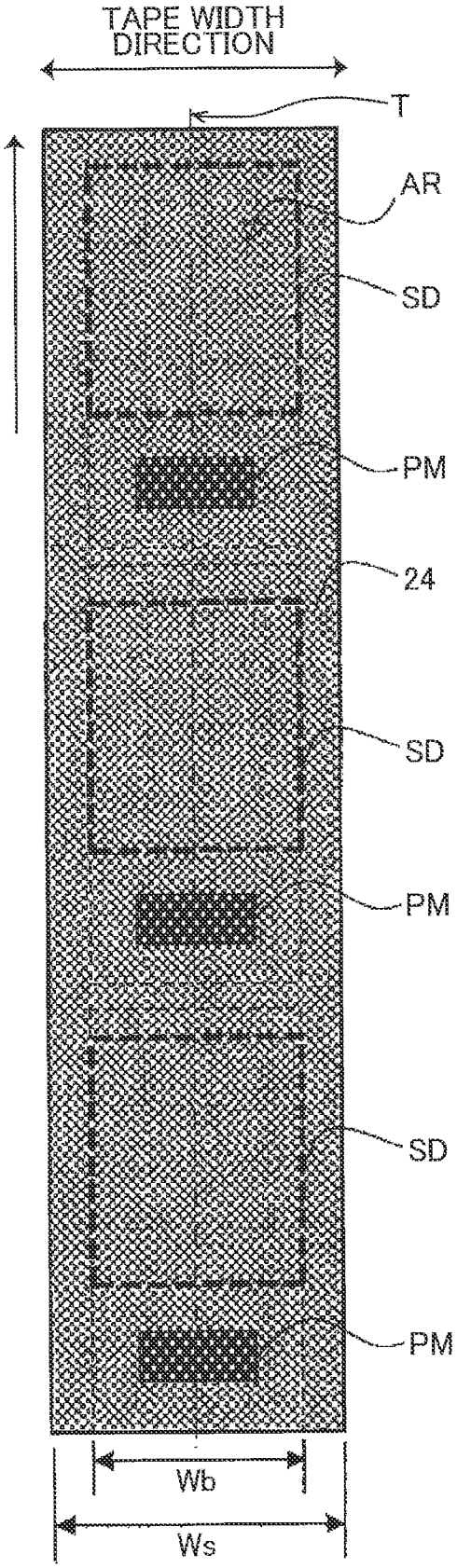
Figure 17E:
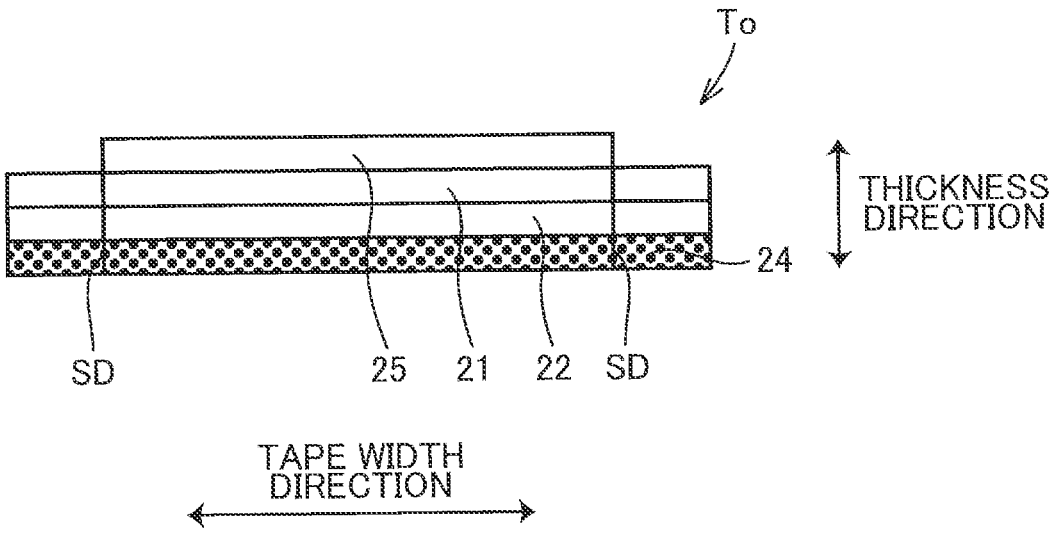
Figure 17F:
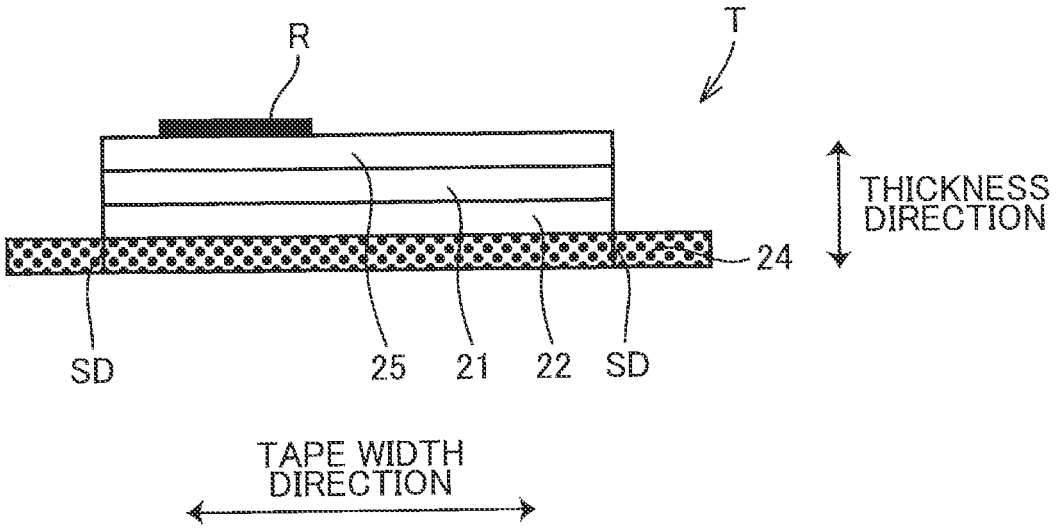

FIGS. 16A through 16C schematically show the printing tape T according to a fourth variation of the first embodiment. FIG. 16B is a plan view showing the printing tape T after the print label L has been peeled off as a rotating label. FIG. 16A is a plan view showing the print label L peeled off as a rotating label. FIG. 16C is a plan view showing the print label L peeled off as a fixed label.

In the first embodiment and the first through third variations described above, the main label part Lo (or print label L) is affixed to the release material layer 24 so as to extend across the first side and second side of the cut-out area AR. However, a dimension WS of the cut-out area AR in the tape width direction may be smaller than a dimension WL of the main label part Lo (or print label L) in the tape width direction, as in the fourth variation shown in FIGS. 16A through 16C. Making the print label L side slightly larger than the cut-out area AR in this way can reduce the occurrence of tearing failures in the cut-out area AR when peeling the print label L from the easy-to-break side (the first side) toward the hard-to-break side (the second side). Therefore, the print label L and cut-out area AR can be peeled together off the release material layer 24. The remaining configuration in the fourth variation is identical or similar to that in the first embodiment and the first through third variations and will be omitted from this description.

Second Embodiment

Next, a second embodiment of the present disclosure will be described with reference to FIGS. 17A through 19E. In the first embodiment and the first through fourth variations, the break line S for the cut-out area AR is configured to include different types of holes or cuts or series of holes or series of cuts so that the first side is an easy-to-break side, and the second side is a hard-to-break side. In this embodiment, the structure of the break line S for the cut-out area AR is different from that in the first embodiment and first through fourth variations and, as a result, the methods for using a label as a rotating label and a fixed label differ. Hence, content in this embodiment that is identical or similar to that in the first embodiment and first through fourth variations will be omitted from the following description, and primarily the structure of the break line S for the cut-out area AR and the selective use of labels as rotating labels and fixed labels will be described.

FIGS. 17A through 17F according to the present embodiment correspond to FIGS. 2A through 2F. As illustrated in the drawings, the break line S according to this embodiment is formed by a short-pitch perforation SD (signifying that the pitch of the holes and connected parts is smaller than that in the perforation SM; also called cuts) having a dotted-line configuration. That is, the break line S is formed in a square shape configured of first through fourth sides. The first through fourth sides are configured by the short-pitch perforation SD, which is an example of the holes or cuts or series of holes or series of cuts that are uniform and of the same type. The short-pitch perforation SD of the break line S is further configured so that the force fixing the cut-out area AR to the region of the release material layer 24 outside the cut-out area AR is greater than the adhesive force between the print label L (or main label part Lo) and the cut-out area AR irrespective of whether a force is applied to peel the print label L (or main label part Lo) from the first side toward the second side or from the second side toward the first side, for example.

Figure 18A:
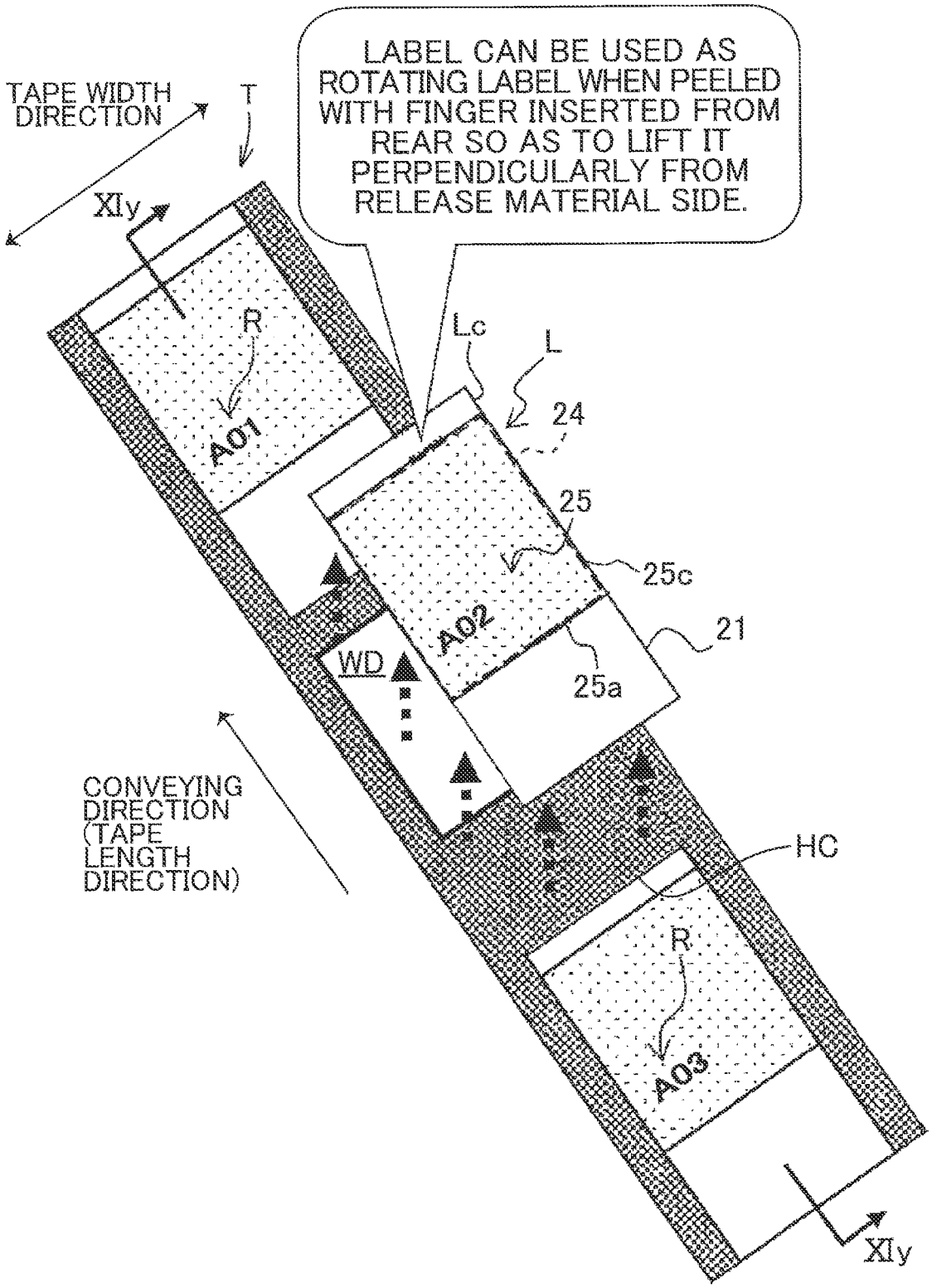
Figure 18B:
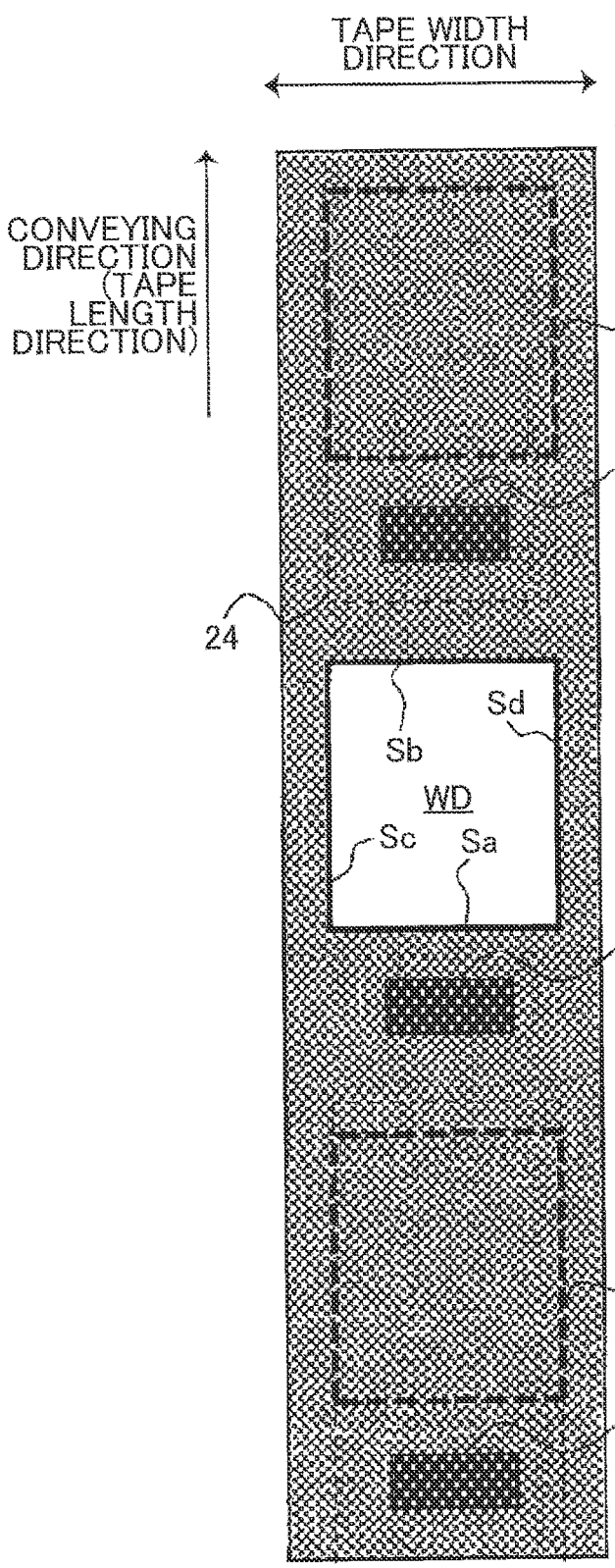
Figure 18C:
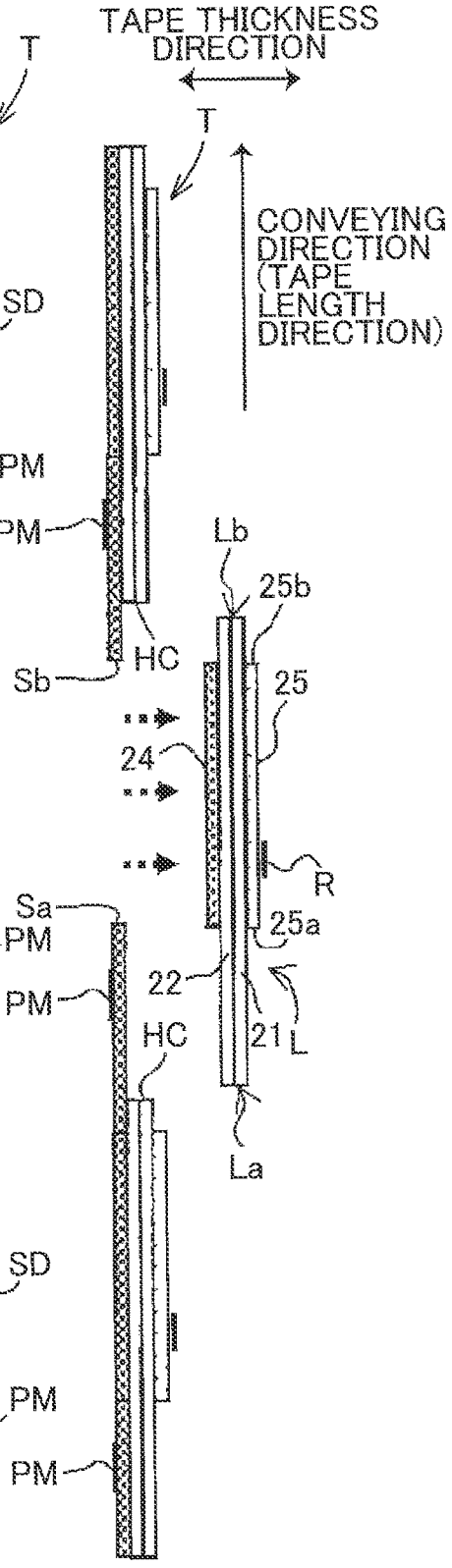

First, the method of peeling off a print label L when the print label L is to be used as a rotating label will be described with reference to FIGS. 18A through 18C. When the user wishes to use a print label L as a rotating label, the user presses a finger or the like against the back surface side (the rear side or far side in the drawing) of the cut-out area AR toward the front surface side (the front side or near side in the drawing) to lift the print label L perpendicular to the surface of the printing tape T, as shown in FIG. 18A. When the print label L is peeled by a finger or the like inserted from the rear side so as to lift the print label L perpendicularly from the release material layer 24 side in this way, the short-pitch perforation SD breaks, producing a rectangular hole WD enclosed by the sides Sa, Sb, Sc, and Sd. The hole WD is produced in the region of the release material layer 24 corresponding to the cut-out area AR, as illustrated in FIGS. 18B and 18C. At this time, the cut-out area AR of the release material layer 24 remains stuck to the adhesive layer 22 at a position in the adhesive-variable area D23 of the print label L. Accordingly, the print label L can be used as a rotating label, as in the first embodiment and the like. The structure and method of attaching the print label L when used as a rotating label is identical to those in the first embodiment and the like and will be omitted from this description.

Next, the method of peeling off a print label L when the print label L is to be used as a fixed label will be described with reference to FIGS. 19A through 19E. When the user wishes to use a print label L as a fixed label, the user accesses (grips, for example) and peels off the print label L. More specifically, the user peels the print label L from the right side in the drawing (serving as the second side in this case) toward the left side in the drawing (serving as the first side in this case), as shown in FIG. 19A, or peels the print label L from the left side toward the right side in the drawing, as illustrated in FIG. 19B, or, while not shown in the drawing, peels the print label L from the top side in the drawing (serving as the third side in this case) toward the bottom side in the drawing (serving as the fourth side in this case) or peels from the bottom side toward the top side in the drawing.

Figure 19A:
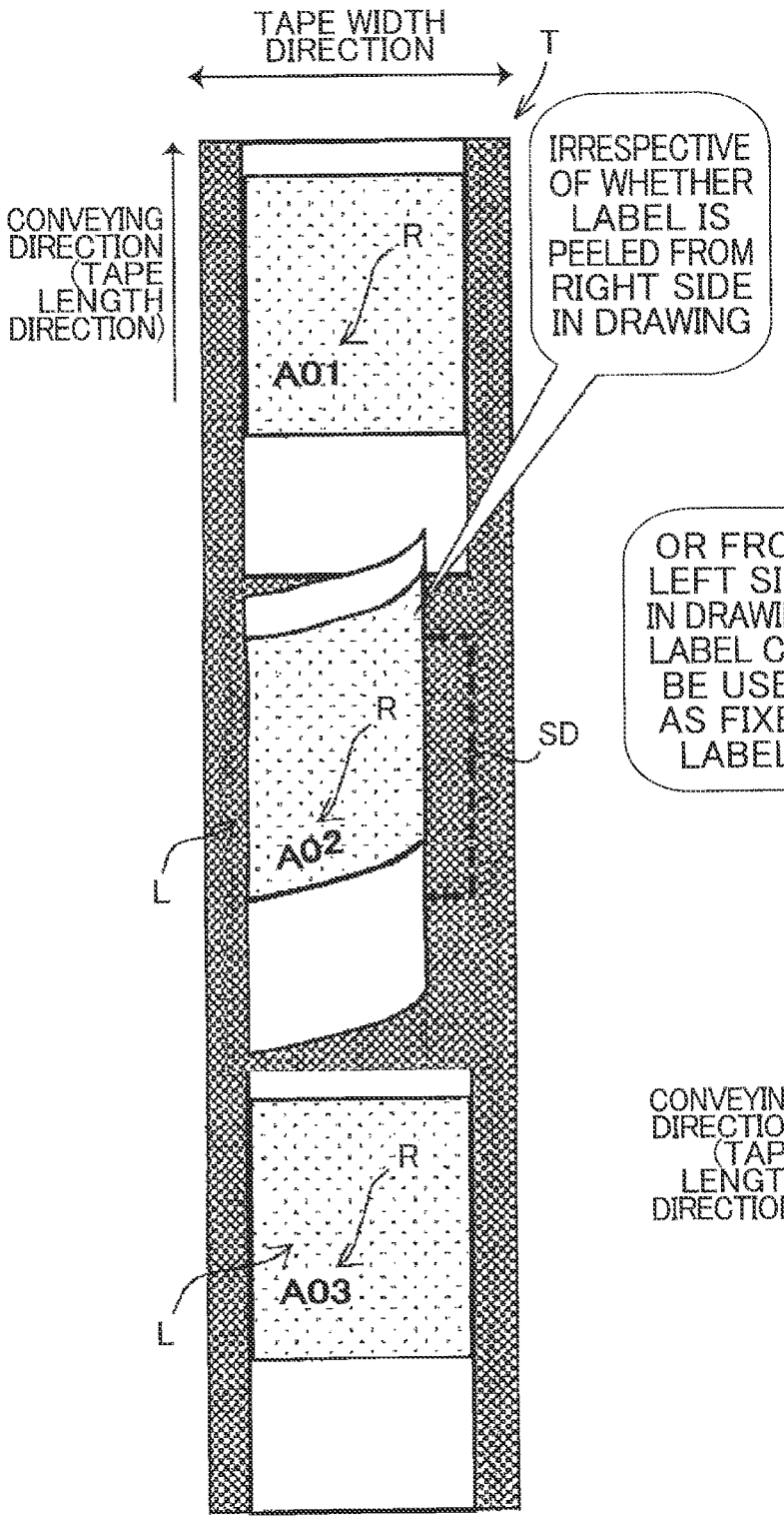
Figure 19B:
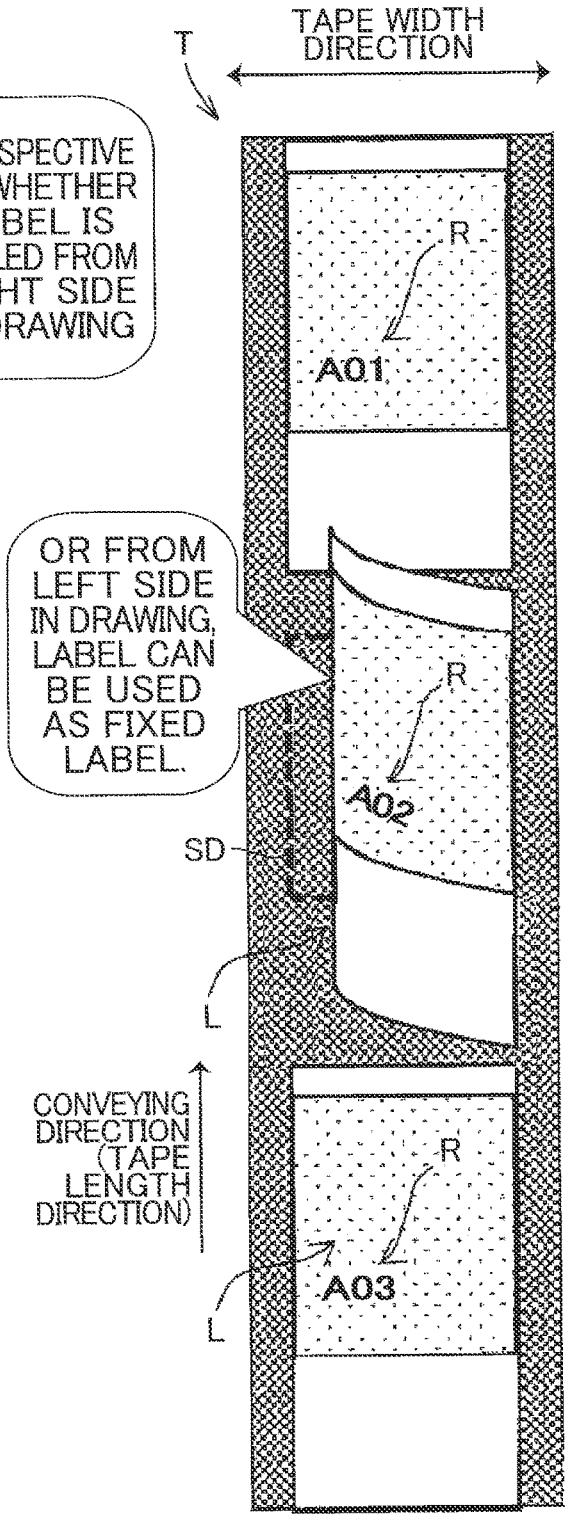
Figure 19C:
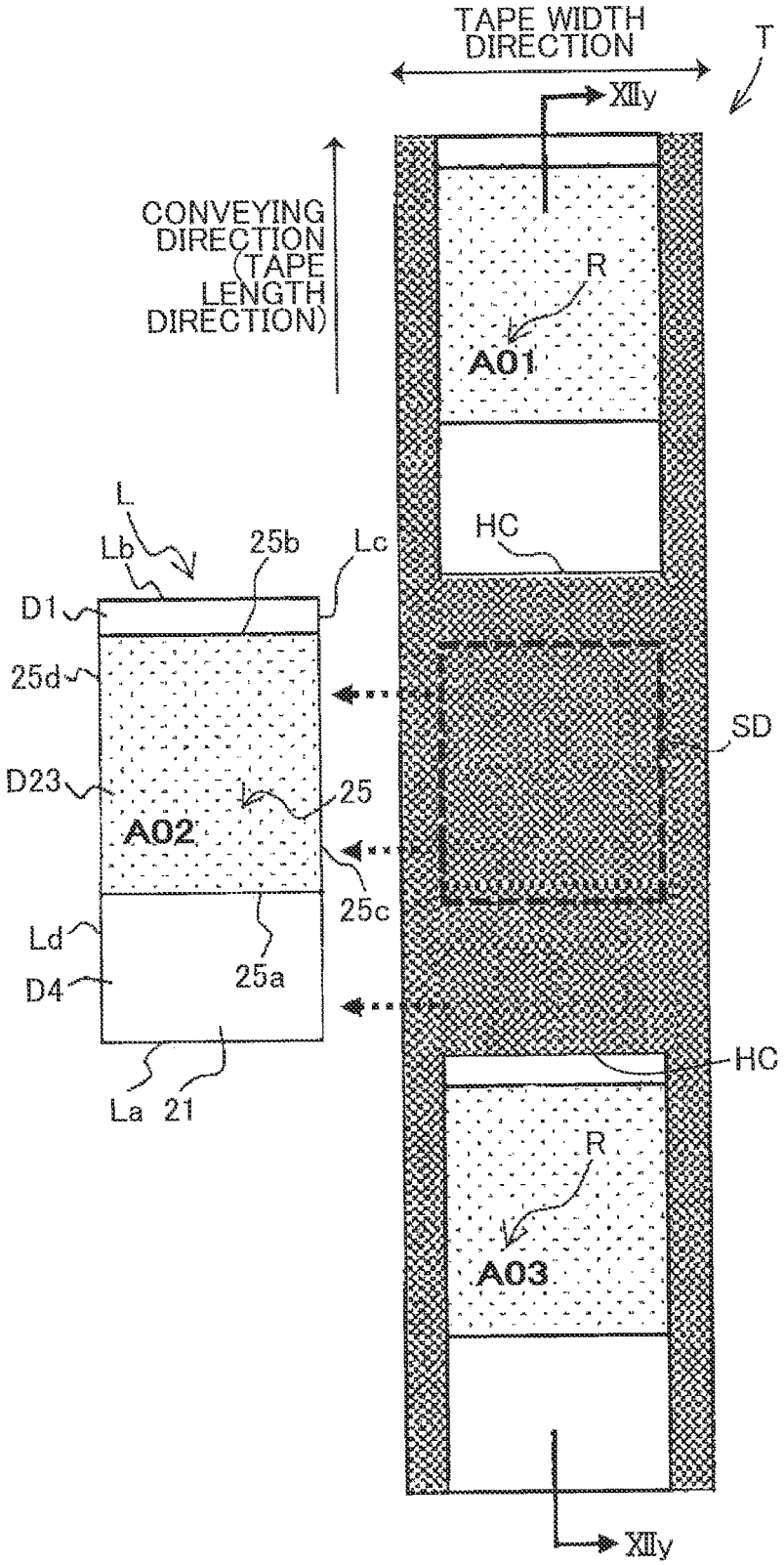
Figure 19D:
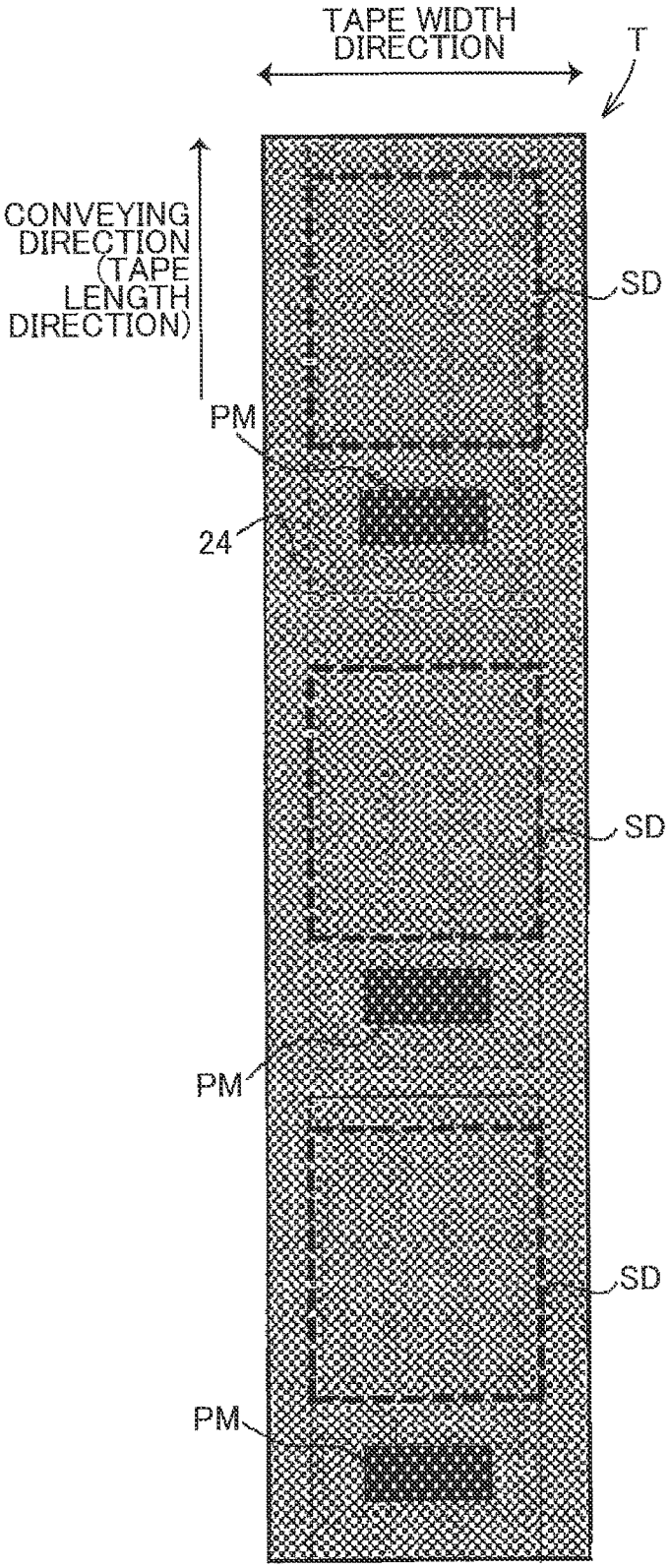
Figure 19E:
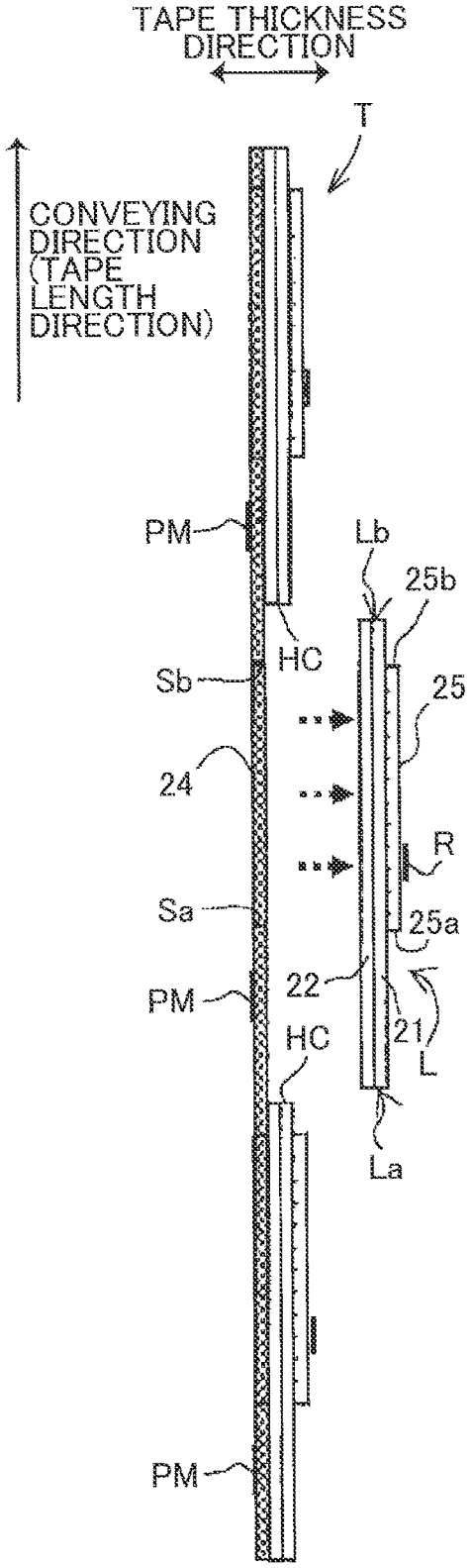

When peeling the print label L off in these ways, the cut-out area AR is not separated from but remains on the release material layer 24, as illustrated in FIGS. 19A and 19B). As described above, the break line S is configured of the short-pitch perforation SD. The short-pitch perforation SD is configured so that the force for fixing the cut-out area AR to the region of the release material layer 24 outside the cut-out area AR, i.e., the force required for breaking the short-pitch perforation SD is stronger than the adhesive force between the print label L and the cut-out area AR. Accordingly, the cut-out area AR is maintained in a fixed state to the surrounding release material layer 24 by the perforation SD. When the print label L is separated from the printing tape T, the short-pitch perforation SD does not break and the print label L and cut-out area AR are separated, as shown in FIGS. 19D and 19E. Thus, the adhesive-variable area D23 of the print label L has an adhesive property owing to the adhesive layer 22. Therefore, the print label L can be used as a fixed label, as in the first embodiment and the like. The structure and method of attaching the print label L for use as a fixed label are identical to those in the first embodiment and the like and will be omitted from this description.

As described above, in the present embodiment, regardless of whether the printing label, i.d., the main label part Lo of the print label L, is peeled off from the first side toward the second side or from the second side toward the first side, the force fixing the cut-out area AR to the surrounding region and acting to keep the cut-out area AR on the release material layer 24 side is greater than the adhesive force applied by the printing label to the cut-out area AR. Accordingly, a continuous break line is not formed on either the first side or the second side in the initial stage of peeling and peeling progresses without the cut-out area AR beginning to tear. Hence, the printing label alone is ultimately peeled off the release material layer 24 while the cut-out area AR remains on the release material layer 24 side. Therefore, as described above, by wrapping the printing label around an object with the exposed adhesive surface contacting the object, the printing label can be used as a fixed label that does not rotate relative to the object.

On the other hand, when the printing label is to be used as a rotating label, the user pushes the cut-out area AR of the release material layer 24 from the release material layer 24 side toward the printing label side with a finger, for example. As a consequence, a continuous break line is forcibly formed along the first side and second side, enabling the printing label and the cut-out area AR to be peeled together from the release material layer 24. Hence, as described above, by wrapping the printing label around an object with the cut-out area AR contacting the object, the printing label can be used as a rotating label that is rotatable relative to the object. As with the first embodiment and the variations thereof, the present embodiment naturally can be modified in various ways, such as giving the break line S a configuration other than the short-pitch perforation SD.

Third Embodiment

Next, a third embodiment of the present disclosure will be described with reference to FIGS. 20A through 20G. As with the second embodiment, the structure of the break line S for the cut-out area AR in the present embodiment differs from that in the first embodiment and the like and, as a result, the methods for using a printing label as a rotating label and a fixed label differ. Hence, content in the present embodiment that is identical or similar to that in the first embodiment, the first through fourth variations, and the second embodiment will be omitted from the following description, and primarily the structure of the break line S for the cut-out area AR and the selective use of printing labels as rotating labels and fixed labels will be described.

Figures 20A, 20B, 20C, 20D, 20E, 20F, 20G:
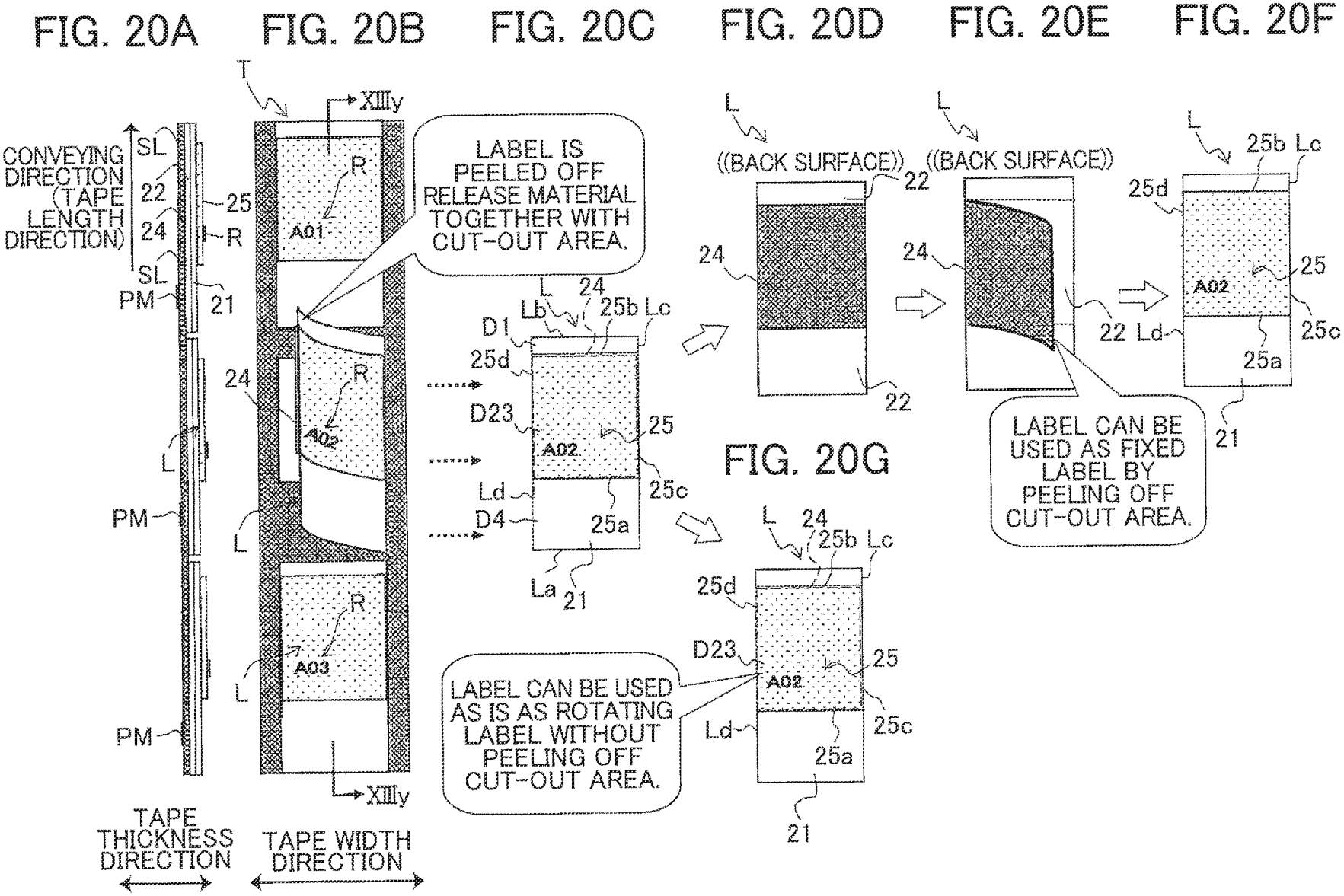

FIG. 20B is a plan view of a printing tape T when peeling the print label L. FIG. 20A is a vertical cross-sectional view of the printing tape T taken along the section XIIIy-XIIIy prior to the print label L being peeled off. As shown in FIGS. 20A and 20B, the break line S for the cut-out area AR in the present embodiment is formed by a slit SL. That is, the break line S is formed in a square shape configured of first through fourth sides. These first through fourth sides are configured by the slit SL, which is an example of the holes or cuts or series of holes or series of cuts that are uniform and of the same type.

FIG. 20C is a plan view of the print label L that has been peeled off the printing tape T. Since the entire periphery of the cut-out area AR is configured of a slit SL, as described above, the cut-out area AR of the release material layer 24 remains stuck to the back surface of the print label L and is separated from the printing tape T together with the print label L when the print label L is peeled off the printing tape T from any direction, as illustrated in FIGS. 20B and 20C (Step 2).

FIG. 20D is a rear view of the print label L that has been separated from the printing tape T. FIG. 20E is a schematic view of a print label L to be used as a fixed label. FIG. 20F is a plan view of the print label L to be used as a fixed label. As shown in FIG. 20D, a portion of the adhesive layer 22 on the rear surface of the print label L is covered by the cut-out area AR of the release material layer 24 when the print label L is separated from the printing tape T. Hence, when the user wishes to use the print label L as a fixed label, the user peels the cut-out area AR from the print label L, as shown in FIGS. 20E and 20F, and wraps the print label L around an object so that the exposed adhesive layer 22 is in contact with the object (Step 3A), as in the first embodiment. This enables the print label L to be used as a fixed label. The structure and method of attaching a print label L to be used as a fixed label are identical to those in the first embodiment and the like and will be omitted from this description.

FIG. 20G is a schematic drawing showing a print label L to be used as a rotating label. As described above, a portion of the adhesive layer 22 on the rear surface of the print label L is covered by the cut-out area AR of the release material layer 24 when the print label L is separated from the printing tape T, as shown in FIG. 20D. Therefore, when wishing to use the print label L as a rotating label, the user uses the print label L as is without peeling the cut-out area AR off the print label L, as shown in FIG. 20G, and wraps the print label L around an object so that the cut-out area AR is in contact with the object (Step 3B). This enables the print label L to be used as a rotating label. The structure and method of attaching a print label L to be used as a rotating label is identical to that in the first embodiment and the like and will be omitted from this description.

As described above, when the print label L in the present embodiment is used as is, as shown in FIG. 20G, the print label L can be used as a "rotating label" that does not adhere to the cable 302, as in the first embodiment. However, by further peeling off the cut-out area AR that is stuck to the print label L, as illustrated in FIGS. 20D and 20E, the adhesive layer 22 becomes exposed. This enables the print label L to be used as a "fixed label" that adheres to the cable 302, as in the first embodiment.

Embodiments of the present disclosure have been described above in detail while referring to the accompanying drawings. However, it goes without saying that the technical scope of the present disclosure is not limited to the embodiment described herein. Those skilled in the art to which the present disclosure belongs may arrive at many modifications, adjustments, and combinations within the scope of the technical ideas in the present disclosure defined by the claims. Therefore, technologies produced from these modifications, adjustments, combinations, and the like naturally also fall within the technical scope of the disclosure.

When descriptions such as "perpendicular," "parallel," and "flat" appear in the above description, these descriptions are not intended to be taken in their strictest sense. In other words, "perpendicular," "parallel," and "flat" may signify "substantially perpendicular," "substantially parallel," and "substantially flat" to allow for design and manufacturing tolerances and error.

When dimensions and sizes are described as being "identical," "equivalent," "different," and the like in appearance in the above description, these terms are not intended to be taken in their strictest sense. In other words, the terms "identical," "equivalent," and "different" may signify "substantially identical," "substantially equivalent," and "substantially different" to allow for design and manufacturing tolerances and error.

In addition to what has already been described, the methods according to the above-described embodiment and the variations thereof may be used in suitable combinations.

In addition, although not illustrated individually, the present disclosure may be implemented with various modifications without departing from the spirit of the disclosure.

What is claimed is:

1. A medium configured to be mounted in and printed with a printer, the medium comprising:

a release material provided with a cut-out area, the cut-out area being surrounded by a hole or a cut or a series of holes or a series of cuts and having at least a first side and a second side, the first side and the second side opposing each other; and a printing label affixed to the release material so as to extend across the first side and the second side of the cut-out area, wherein the first side and the second side are configured to include different types of the holes or the cuts or the series of holes or the series of cuts from each other, and wherein a dimension of the cut-out area in a width direction is smaller than a dimension of the printing label in the width direction.

2. The medium according to claim 1, wherein a total length of the hole or the cut or the series of holes or the series of cuts in the first side is greater than a total length of the hole or the cut or the series of holes or the series of cuts in the second side.

3. The medium according to claim 1, wherein a depth of the hole or the cut or the series of holes or the series of cuts in the first side is greater than a depth of the hole or the cut or the series of holes or the series of cuts in the second side.

4. The medium according to claim 1, wherein at least a portion of the printing label is transparent or semitransparent.

5. A medium configured to be mounted in and printed with a printer, the medium comprising:

a release material provided with a cut-out area, the cut-out area being surrounded by a hole or a cut or a series of holes or a series of cuts and having at least a first side and a second side, the first side and the second side opposing each other; and a printing label affixed to the release material so as to extend across the first side and the second side of the cut-out area, wherein a fixing force by which the cut-out area is fixed to an area of the release material outside the cut-out area is smaller than an adhesive force between the printing label and the cut-out area when a first force is applied to peel off the printing label from the first side toward the second side, and wherein the fixing force is greater than the adhesive force between the printing label and the cut-out area when a second force is applied to peel off the printing label from the second side toward the first side.

6. The medium according to claim 5, wherein the adhesive force between the printing label and the cut-out area is equal to or greater than 0.01 N/20 mm and equal to or smaller than 2 N/20 mm.

7. The medium according to claim 5, wherein the first side and the second side are configured to include different types of the holes or the cut or the series of holes or the series of cuts from each other.

8. The medium according to claim 5, wherein a total length of the hole or the cut or the series of holes or the series of cuts in the first side is greater than a total length of the hole or the cut or the series of holes or the series of cuts in the second side.

9. The medium according to claim 5, wherein a depth of the hole or the cut or the series of holes or the series of cuts in the first side is greater than a depth of the hole or the cut or the series of holes or the series of cuts in the second side.

10. The medium according to claim 5, wherein a dimension of the cut-out area in a width direction is smaller than a dimension of the printing label in the width direction.

11. The medium according to claim 5, wherein at least a portion of the printing label is transparent or semitransparent.

12. A medium configured to be mounted in and printed with a printer, the medium comprising:

a release material provided with a cut-out area, the cut-out area being surrounded by a hole or a cut or a series of holes or a series of cuts and having at least a first side and a second side, the first side and the second side opposing each other; and a printing label affixed to the release material so as to extend across the first side and the second side of the cut-out area, wherein a fixing force by which the cut-out area is fixed to an area of the release material outside the cut-out area is greater than an adhesive force between the printing label and the cut-out area irrespective of whether a peeling force is applied to peel off the printing label from the first side toward the second side or from the second side toward the first side.

* * * * *